US011123999B2

(12) United States Patent
Van Aerde

(10) Patent No.: US 11,123,999 B2
(45) Date of Patent: Sep. 21, 2021

(54) CASSETTES AND LABEL PRINTERS THEREFOR

(71) Applicant: Sanford, L.P., Atlanta, GA (US)

(72) Inventor: Geert Van Aerde, Lokeren (BE)

(73) Assignee: SANFORD, L.P., Atlanta, GA (US)

( * ) Notice: Subject to any disclaimer, the term of this patent is extended or adjusted under 35 U.S.C. 154(b) by 0 days.

(21) Appl. No.: 16/558,748

(22) Filed: Sep. 3, 2019

(65) Prior Publication Data

US 2020/0070551 A1 Mar. 5, 2020

Related U.S. Application Data

(60) Provisional application No. 62/726,378, filed on Sep. 3, 2018.

(51) Int. Cl.
*B41J 15/04* (2006.01)
*B41J 3/407* (2006.01)

(52) U.S. Cl.
CPC ..... *B41J 15/044* (2013.01); *B41J 3/4075* (2013.01)

(58) Field of Classification Search
CPC ..... B41J 15/044; B41J 3/4075
See application file for complete search history.

(56) References Cited

U.S. PATENT DOCUMENTS

| | | | |
|---|---|---|---|
| 4,511,903 | A | 4/1985 | Miyazaki et al. |
| 4,729,676 | A | 3/1988 | Smith et al. |
| 4,815,871 | A | 3/1989 | McGourty et al. |
| 4,974,977 | A | 12/1990 | Morgan et al. |
| 5,017,942 | A | 5/1991 | Asakura et al. |
| 5,078,523 | A | 1/1992 | McGourty et al. |
| 5,088,845 | A | 2/1992 | Kurachi |
| 5,141,342 | A | 8/1992 | Kawahara |
| 5,211,491 | A | 5/1993 | Harvey |
| 5,374,132 | A | 12/1994 | Kimura |
| 5,411,339 | A | 5/1995 | Bahrabadi et al. |
| 5,437,511 | A | 8/1995 | Halket et al. |
| 5,597,247 | A | 1/1997 | Inakoshi et al. |
| 5,918,989 | A | 7/1999 | Stout, Jr. et al. |
| 6,017,159 | A | 1/2000 | Tse |
| 6,604,874 | B2 | 8/2003 | Carriere et al. |
| 6,644,876 | B2 | 11/2003 | Carriere et al. |

(Continued)

FOREIGN PATENT DOCUMENTS

| | | | |
|---|---|---|---|
| CN | 1085497 | A | 4/1994 |
| CN | 1291956 | A | 4/2001 |

(Continued)

*Primary Examiner* — Sharon Polk
(74) *Attorney, Agent, or Firm* — Eversheds Sutherland (US) LLP

(57) ABSTRACT

Cassettes and associated label printers are provided. A cassette includes a plurality of surfaces, with a base surface, a top surface, and at least one side surface extending between the base surface and the top surface, wherein the plurality of surfaces at least partially define a volume for dispensably containing a supply of label material, an outlet that provides a path to dispense the supply of label material from the volume, and a locking portion for engaging a complementary locking element of a label printer. The cassettes also include one or more conductive areas or bars associated with the surface(s) of the cassette, which are configured to engaged a corresponding conductive area of the label printer.

20 Claims, 40 Drawing Sheets

(56) References Cited

U.S. PATENT DOCUMENTS

| | | | |
|---|---|---|---|
| 6,830,391 | B2 | 12/2004 | Clayvon et al. |
| 8,834,047 | B2 | 9/2014 | Van Coppenolle et al. |
| 9,346,297 | B2 | 5/2016 | Van Coppenolle et al. |
| 9,533,519 | B2 * | 1/2017 | Roctus ..... B41J 3/4075 |
| 9,815,309 | B2 | 11/2017 | Van Coppenolle et al. |
| 9,821,578 | B2 * | 11/2017 | Sakano ..... B41J 15/044 |
| 2002/0012558 | A1 | 1/2002 | Huss et al. |
| 2004/0179212 | A1 | 9/2004 | Kurashina |
| 2005/0281600 | A1 | 12/2005 | Akaiwa et al. |
| 2006/0088802 | A1 | 4/2006 | Akaiwa |
| 2008/0085142 | A1 | 4/2008 | Caveney et al. |
| 2008/0286026 | A1 | 11/2008 | Kubota et al. |
| 2012/0170959 | A1 | 7/2012 | Vandermeulen et al. |
| 2014/0340463 | A1 | 11/2014 | Van Coppenolle et al. |

FOREIGN PATENT DOCUMENTS

| | | | |
|---|---|---|---|
| CN | 1376115 | A | 10/2002 |
| CN | 1517223 | A | 8/2004 |
| CN | 1709702 | A | 12/2005 |
| CN | 1762720 | A | 4/2006 |
| CN | 101022956 | A | 8/2007 |
| CN | 101039807 | A | 9/2007 |
| CN | 101060985 | A | 10/2007 |
| DE | 4218924 | C1 | 12/1993 |
| EP | 1308299 | A1 | 5/2003 |
| EP | 1738914 | A2 | 1/2007 |
| JP | 56013193 | A | 2/1981 |
| JP | 6026862 | | 2/1985 |
| JP | 63207673 | A | 8/1988 |
| JP | 01047579 | A | 2/1989 |
| JP | 6447579 | A | 2/1989 |
| JP | 64047579 | | 2/1989 |
| JP | 02072991 | | 3/1990 |
| JP | 08058203 | | 3/1996 |
| JP | 10100503 | A | 4/1998 |
| JP | 11066246 | | 3/1999 |
| JP | 3333324 | B2 | 10/2002 |
| WO | 2006/013466 | A2 | 2/2006 |
| WO | 2006/024913 | A2 | 3/2006 |
| WO | 2008/122630 | A1 | 10/2008 |

* cited by examiner (i)

(ii)

(i)

(ii)

(iii)

CASSETTES AND LABEL PRINTERS THEREFOR

CROSS-REFERENCE TO RELATED APPLICATIONS

This application claims priority benefit of U.S. Provisional Patent Application No. 62/726,378, filed Sep. 3, 2018, which is incorporated by reference herein in its entirety.

FIELD OF THE DISCLOSURE

The present disclosure relates to label printers, and particularly to a label printer with cassette detection means and to cassettes for use in such label printers.

BACKGROUND

Label printers are known, which use a supply of tape housed in a cassette, received in the label printer. For example, the tape may include an image-receiving layer and a backing layer, which are secured to one another via an adhesive layer. Such label printers may include a cutting mechanism for cutting off a portion of the tape after an image has been printed onto the image-receiving layer so that the portion of tape having the image can be used as a label. After the tape has been cut, the cut portion of the tape is pulled from the printer through a slit in the printer housing. The backing layer can then be removed allowing the image-receiving layer to be secured to an object using the adhesive layer.

Known label printers include a cassette-receiving bay in which a cassette is received for printing. A printhead is provided in the cassette-receiving bay for cooperating with the supply of tape to print thereon. A platen may also be provided in the cassette-receiving bay positioned at a side of the tape opposite to the printhead when the cassette is received in the cassette-receiving bay. During printing, the printhead cooperates with the platen, with the tape passing therebetween for printing thereon. The platen may be driven by a motor for propagating the tape during printing. Alternatively, the platen may be freely rotatable and an additional drive roller may be provided for driving the tape during printing.

In an alternative arrangement to that described above, a platen may be provided within the cassette. In such an arrangement, the tape cooperates with a surface of the platen. When received in the cassette-receiving bay the platen in the cassette cooperates with a drive mechanism in the cassette-receiving bay for driving the tape during printing. Alternatively, the platen is freely rotatable and an additional drive roller may be provided for driving the tape. During printing, the printhead in the cassette-receiving bay cooperates with the platen in the cassette with tape passing therebetween for printing thereon.

In one arrangement, the printhead is moveable between a non-printing position and a printing position. In an alternative arrangement, the platen is moveable between a non-printing position and a printing position. In yet another arrangement, both the platen and printhead are movable to have non-printing and printing positions.

The tape may be of a direct thermal type on which printing is achieved by direct application of heat from printing elements on the printhead. Alternatively, an ink ribbon may be provided, whereby ink is transferred from the ribbon to an image receiving tape by application of heat to the ink ribbon via printing elements on the printhead. The cassette may include a roll of die cut labels rather than a continuous tape.

One or more problems exist in the above-described arrangements, in that for good quality printing the tape and/or ink ribbon must be correctly aligned with the printhead during printing. Furthermore, the tape must remain correctly aligned with the printhead while printing occurs and must smoothly pass the printhead to ensure good quality printing. In order to ensure that this is the case, it is advantageous to prevent the cassette from moving during printing and cutting. Furthermore, the position of the cassette within the cassette-receiving bay should be predefined and readily reproducible whenever a cassette is inserted in the cassette-receiving bay. The problem is exacerbated in hand held printers that may be moved around during printing. In such an apparatus, it is even more important that the cassette be locked in a fixed position during printing.

WO 2006/013466 (DYMO) discloses a cassette locking and ejecting arrangement for a label printer apparatus. A label printer comprising a cassette-receiving bay, in which a tape cassette is inserted, is provided. The cassette-receiving bay is provided with a plurality of spring-loaded ejecting members for ejecting a cassette from the cassette-receiving bay. When a cassette is inserted in the cassette-receiving bay, a pair of locking members hold the cassette in place against the biasing force exerted by the ejecting members. To eject the cassette, the locking members are disengaged from the cassette allowing the cassette to be pushed out of the cassette-receiving bay by the force exerted by the ejecting members.

There is a problem with the above-described arrangement, that when a cassette is inserted into the cassette-receiving bay by a user, it is possible that the cassette will not properly engage with all of the locking members. This may occur, for example, if a user presses on only one edge of the cassette during insertion. If a cassette is engaged with one, but not all, of the locking members, then although the cassette may be retained within the cassette-receiving bay against the biasing force of the ejecting members, the cassette may not be aligned properly with respect to the platen and printhead for printing.

WO 2006/013466 (DYMO) has a pair of locking members, which are biased, by means of a spring, towards a locking position to lock a cassette inserted into the cassette-receiving bay in place. However, in the event that the label printer apparatus is subjected to a sudden impact, i.e., if it is dropped by a user, it is possible that the locking members will be moved against the biasing force of the spring to release the cassette. Accordingly, when a user subsequently resumes printing with the label printer apparatus, the cassette will not be properly locked in the cassette receiving bay in the correct position for printing, and printing will be adversely effected or impossible.

Furthermore, in the case that a cassette inserted into a cassette receiving bay is not properly engaged by one or more of a plurality of locking members, it may not be apparent to a user, which locking members are not engaged properly with the cassette and what action is required in order to rectify the problem.

The cassette and printer embodiments described herein are directed at addressing one or more of the above-described difficulties with known assemblies.

SUMMARY OF THE DISCLOSURE

In one aspect, cassettes are provided, including a plurality of surfaces that include a base surface, a top surface, and at least one side surface extending between the base surface and the top surface, wherein the plurality of surfaces at least partially define a volume for dispensably containing a supply of label material, an outlet disposed on one of the plurality of surfaces, wherein the outlet provides a path to dispense the supply of label material from the volume, at least one locking portion configured to receive at least one locking element of a label printer, wherein the locking portion is nonconductive, and a first flat conductive area disposed on the at least one side surface, wherein the first flat conductive area is configured to engage a corresponding conductive area of the label printer.

In another aspect, cassettes are provided, including a plurality of surfaces that include a base surface, a top surface, and at least one side surface extending between the base surface and the top surface, wherein the plurality of surfaces at least partially define a volume for dispensably containing a supply of label material, an outlet disposed on one of the plurality of surfaces, wherein the outlet provides a path to dispense the supply of label material from the volume, at least two conductive areas disposed on the at least one side surface, wherein the at least two conductive areas are connected via a conductive connection, and a locking portion for engaging a complementary locking element of a label printer.

In yet another aspect, cassettes are provided, including a plurality of surfaces that include a base surface, a top surface, and at least one side surface extending between the base surface and the top surface, wherein the plurality of surfaces at least partially define a volume for dispensably containing a supply of label material, a locking portion configured to receive a locking element of a label printer; an outlet for the supply of label material, wherein the outlet provides a path to dispense the supply of label material from the volume, and at least one conductive bar protruding from at least one of the plurality of surfaces and configured to engage a corresponding conductive area of the label printer, wherein the at least one conductive bar is configured to engage the label printer at a position separate from the locking element.

BRIEF DESCRIPTION OF THE DRAWINGS

Referring now to the drawings, which are meant to be exemplary and not limiting, and wherein like elements are numbered alike. The detailed description is set forth with reference to the accompanying drawings illustrating examples of the disclosure, in which use of the same reference numerals indicates similar or identical items. Certain embodiments of the present disclosure may include elements, components, and/or configurations other than those illustrated in the drawings, and some of the elements, components, and/or configurations illustrated in the drawings may not be present in certain embodiments.

DETAILED DESCRIPTION

Various embodiments of label printers and cassettes therefore will now be described, with reference to the figures. It should be understood that elements of the various embodiments may be described with reference to a particular printer or cassette design, but may be combined or otherwise implemented in or with other embodiments, designs, or the elements thereof, as would be understood by one of ordinary skill in the art.

Figure 1:
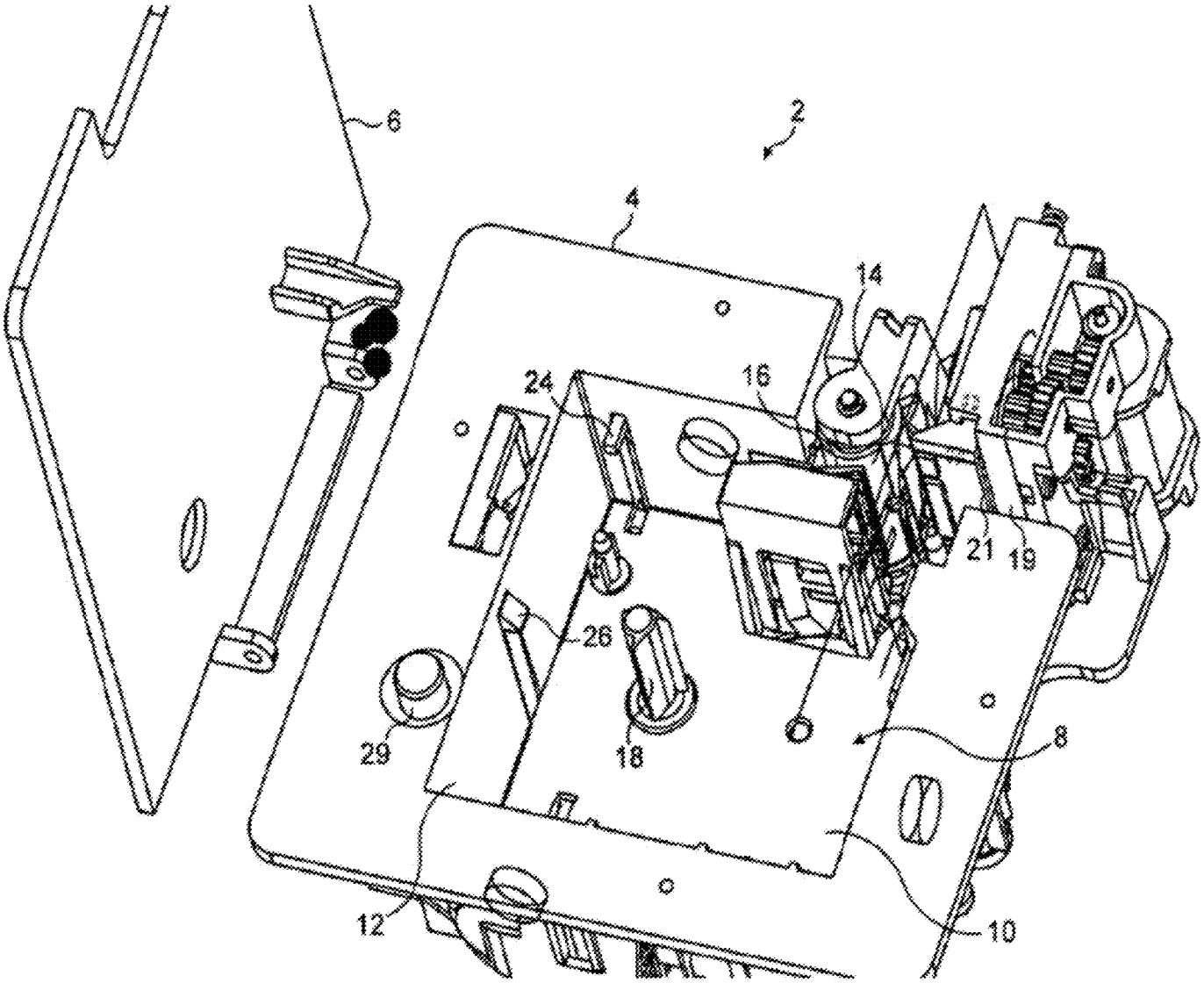
FIG. 1 is a top perspective view of an embodiment of a label printer according to the present disclosure, the label printer having its lid open and no cassette present.

Referring to FIG. 1, the label printer 2 comprises a body 4, a lid (or cover) 6 and a cassette-receiving bay 8. The cassette-receiving bay 8 has an opening in a top portion of the body for vertical insertion of a cassette. The lid 6 is hinged for closing over the top opening. In an alternative embodiment, the lid (or cover), may be a detachable lid which is completely detachable from the body 4 of the label printer 2 when in an open position.

The cassette-receiving bay 8 comprises a recess forming an opening for receiving a cassette. The recess is formed by a base 10 and sides 12 extending from the base 10 to the top opening. A platen 14 and a printhead 16 are provided in the cassette-receiving bay 8. The printhead 16 is movable towards the platen 14 whereby, during printing, the printhead 16 cooperates with the platen 14, with tape passing therebetween for printing thereon. The platen 16 is driven by a motor (not shown) for propagating the tape during printing. An ink ribbon take-up sprocket 18 extends from the base 10 of the cassette-receiving bay 8 for cooperating with an ink ribbon take-up spool of a cassette when inserted into the cassette-receiving bay 8. The sprocket 18 is driven by a motor (not shown) for winding the ink ribbon around the ink ribbon take-up spool during printing. A slit 19 is provided in the body 4 of the label printer forming an exit through which the tape passes after printing. A cutting mechanism 21 is provided adjacent the exit slit 19 for cutting off the printed portion of tape to provide a printed label.

A first ejector element 24 is visible on a sidewall of the cassette-receiving bay 8. Also visible in FIG. 1 is a locking element 26 of a locking mechanism (which is not visible) on the left hand side of the cassette-receiving bay 8. An actuator button 29 is provided on the surface of the body 4 for actuating the locking mechanism.

Figure 2:
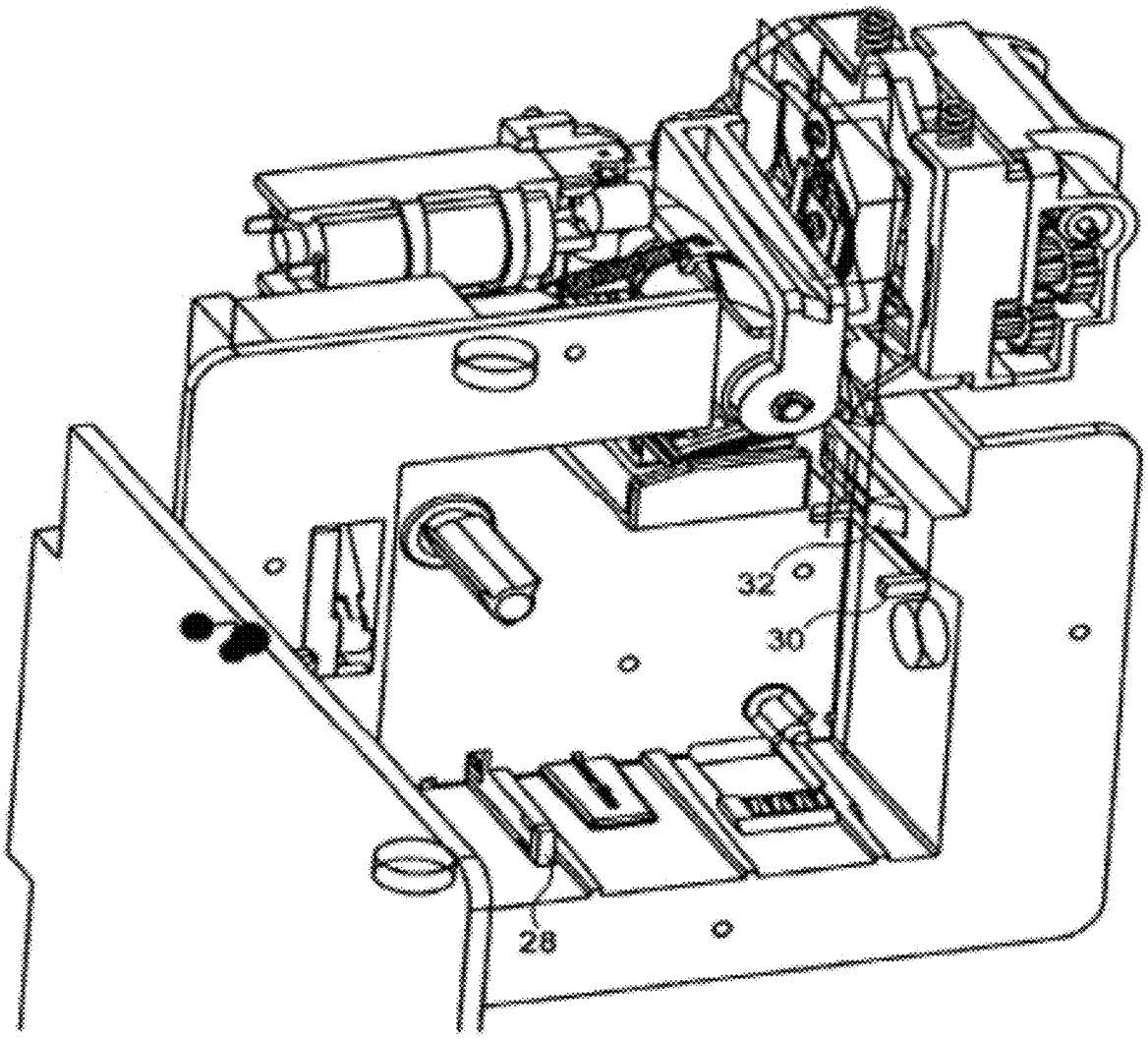
FIG. 2 is another top perspective view of the label printer shown in FIG. 1.
Figure 3:
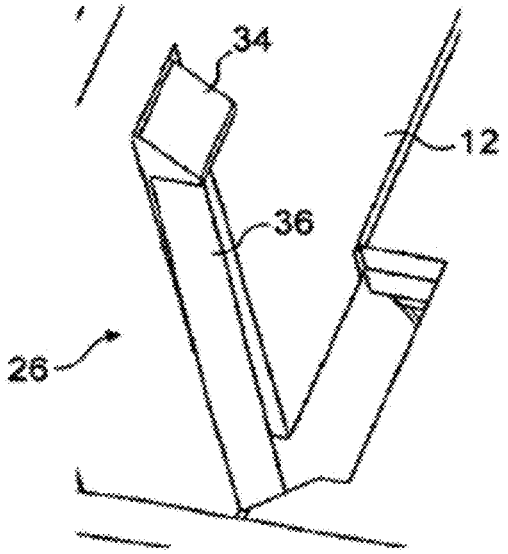
FIG. 3 is a view illustrating the position of a first locking element of the label printer shown in FIG. 1.
Figure 4:
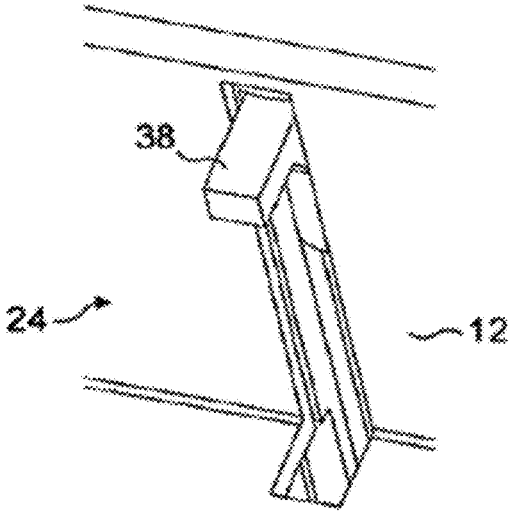
FIG. 4 is a view illustrating the position of a first ejector element of the label printer shown in FIG. 1.
Figure 5:
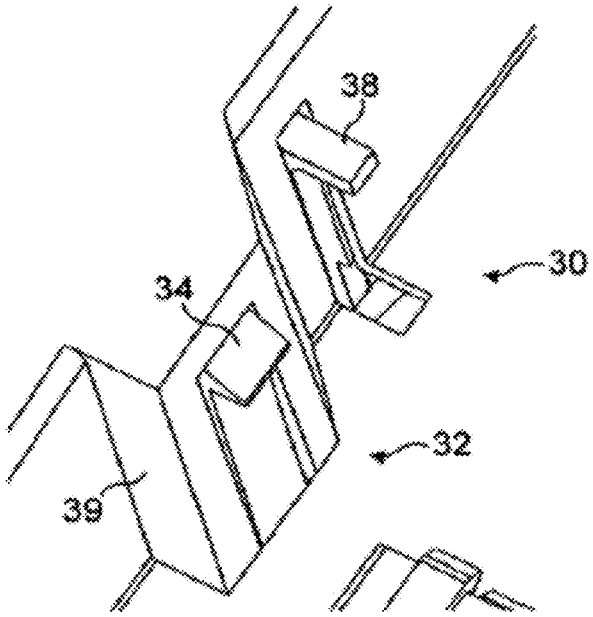
FIG. 5 is a view illustrating the position of a second locking element of the label printer of FIG. 2.
Figure 6:
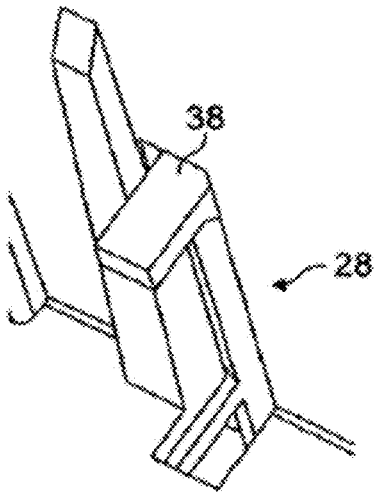
FIG. 6 is a view illustrating the position of a second ejector element of the label printer shown in FIG. 2.

Referring to FIG. 2, a second ejector element 28 of a second ejector mechanism (which is not visible) is shown on the opposite side wall of the cassette receiving bay 8 to the first ejector element 24. A third ejector element 30 of a third ejector mechanism (which is not visible) is positioned on the right hand side of the cassette receiving bay 8. A second locking element 32 of the locking mechanism (which is not visible) is positioned on the right hand side of the cassette-receiving bay 8.

Referring to FIGS. 3, 4, 5, and 6, each of the locking and ejector elements 24, 26, 28, 30, 32 are provided at the sides of the cassette-receiving bay 8 and extend into the cassette-receiving bay 8 through openings in the sides for interaction with an inserted cassette.

Each locking element 26, 32 comprises a projection 34 and an elongate element 36 extending in a direction from the base 10 to the top opening of the cassette-receiving bay 8. The projection 34 is at a top end of the elongate element 36 and extends towards a central portion of the cassette-receiving bay 8 through a corresponding opening in the sidewall 12 of the cassette-receiving bay 8. Each projection 34 has a sloped upper surface for cooperating with a cassette inserted into the cassette-receiving bay 8 for moving the locking element from a locking position to an unlocked position. One of the sidewalls of the cassette-receiving bay 8 has a portion 39 projecting into the cassette-receiving bay 8 forming a guide for a corresponding recess in a cassette when inserted into the cassette-receiving bay 8. The locking element 32 is positioned in an opening in the guide 39 and extends therefrom into the cassette-receiving bay 8 thereby forming a combined guiding and locking arrangement.

Each ejecting element 24, 28, 30 extends from the side wall of the cassette-receiving bay 8 part way into the cassette-receiving bay 8 and has a free end unconnected to any other structural elements. The ejector elements 24, 28, 30 comprise an elongate element 38 extending in a perpendicular direction relative to the side wall through an opening in the side wall.

Figure 7:
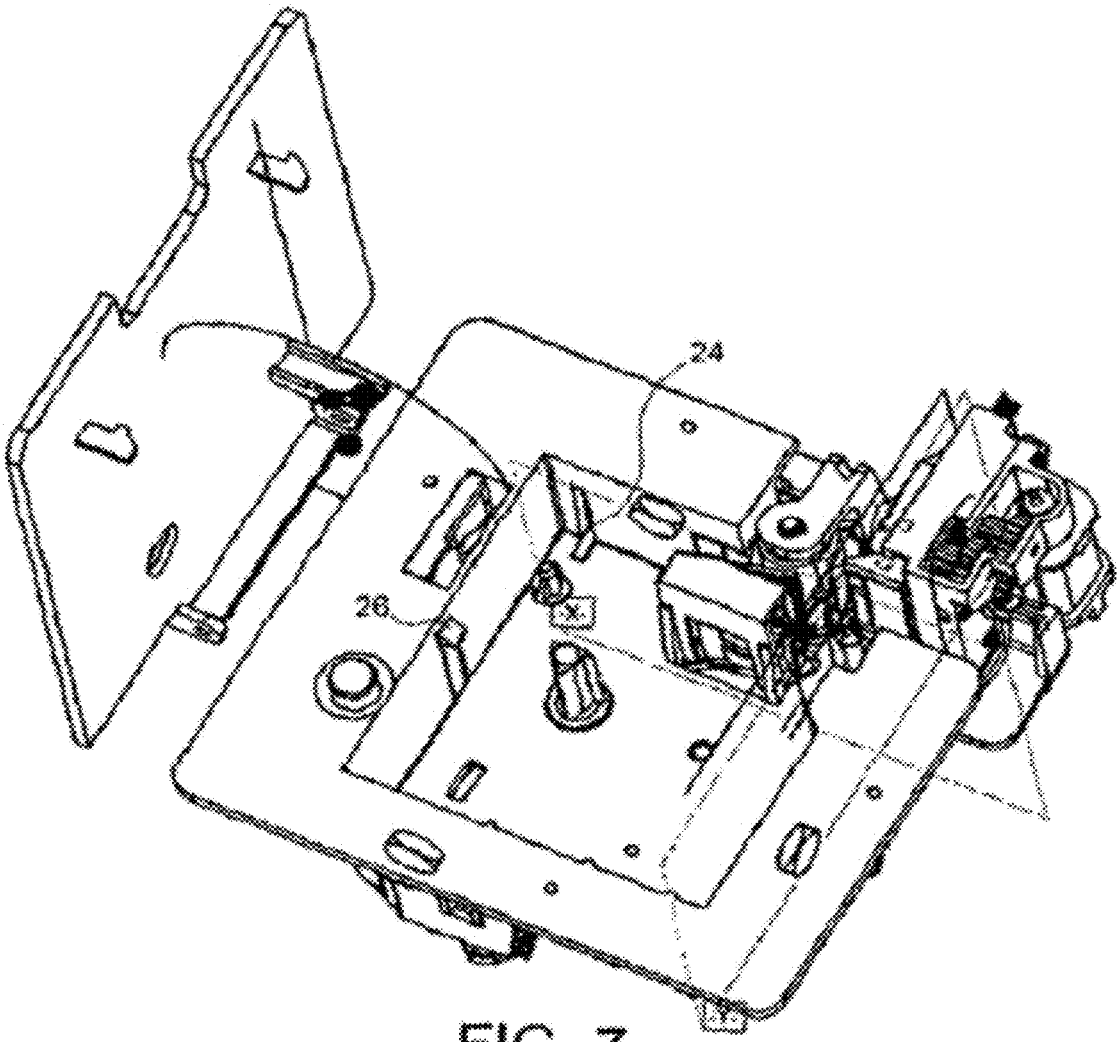
FIG. 7 is a top perspective view of the label printer of FIG. 1 illustrating the positions of a first locking element and a first ejector element with a cassette installed in the cassette-receiving bay (the cassette is not shown for clarity).
Figure 8:
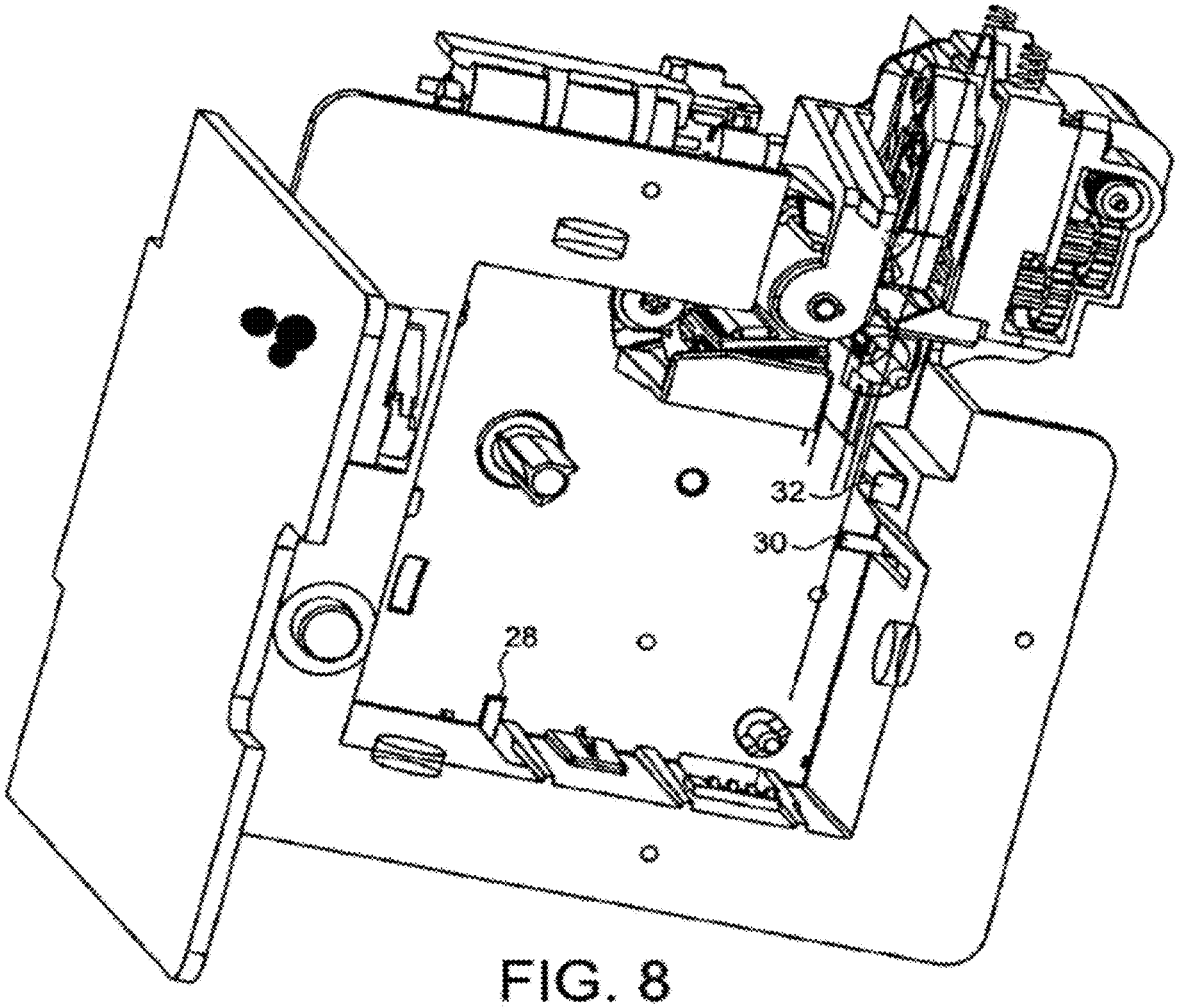
FIG. 8 is another top perspective view of the label printer shown in FIG. 7.
Figure 9:
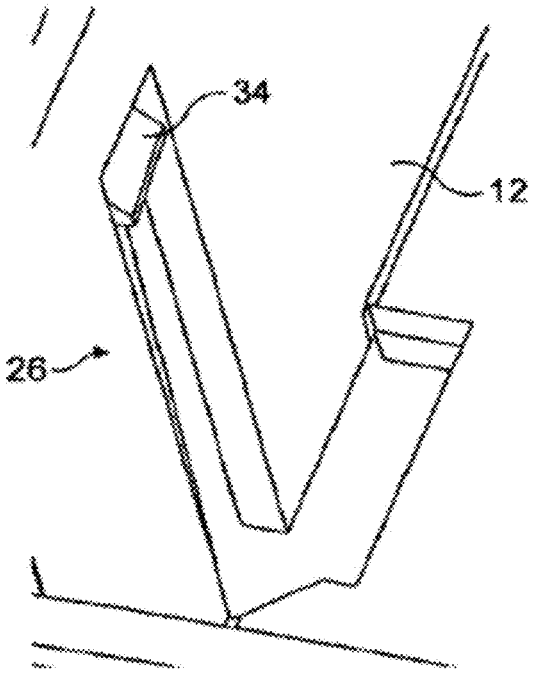
FIG. 9 is a view illustrating the position of the first locking element shown in FIG. 3 during insertion/ejection of a cassette.
Figure 10:
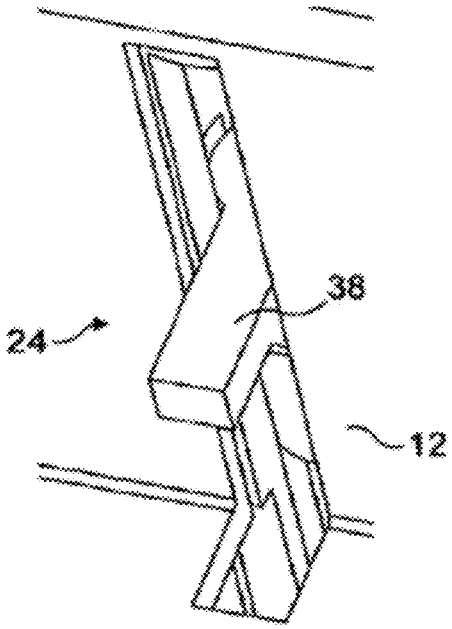
FIG. 10 is a view illustrating the position of the first ejector element shown FIG. 4 during insertion/ejection of a cassette.
Figure 11:
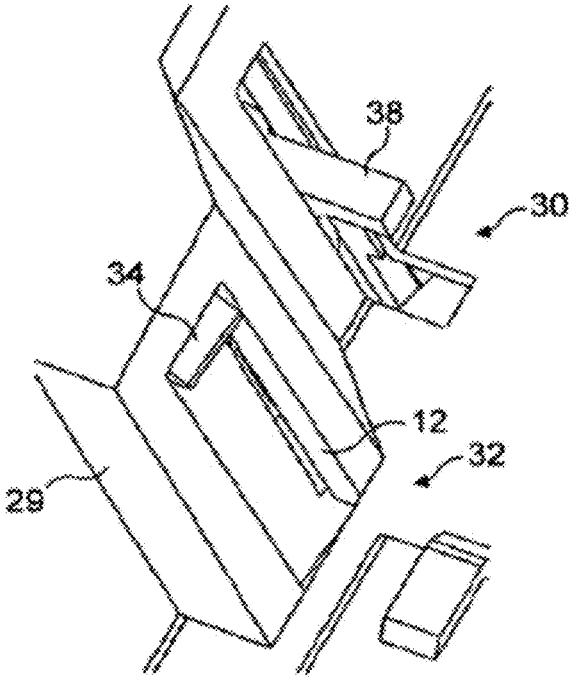
FIG. 11 is a view illustrating the positions of the second locking element and the second ejector element shown in FIG. 5 during insertion/ejection of a cassette.
Figure 12:
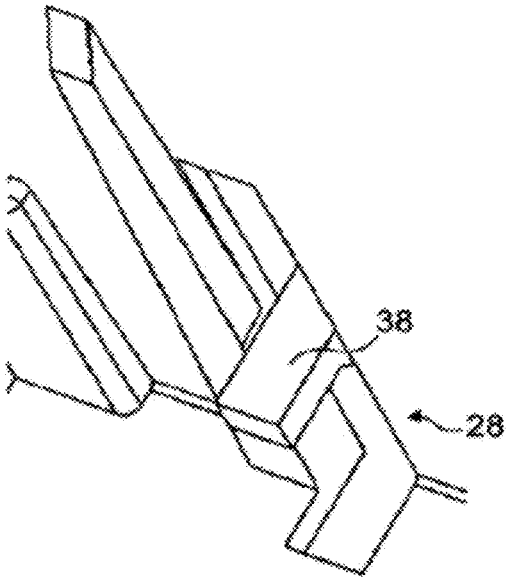
FIG. 12 is a view illustrating the position of the third ejector element shown in FIG. 6 during insertion/ejection of a cassette.

Referring to FIGS. 7 and 8, when a cassette is installed in the cassette-receiving bay 8, the first, second and third ejector elements 24, 28, 30 are pushed down to the base 10 and the first and second locking elements 26, 32 are in the locking position.

FIGS. 9, 10, 11, and 12 illustrate the positions of the locking and ejector elements 24, 26, 28, 30, 32 when the cassette is being inserted into the cassette-receiving bay 8. In FIGS. 9, 10, 11, and 12, the cassette is not shown for clarity.

During insertion, the cassette contacts the locking and ejector elements 24, 26, 28, 30, 32. The projections 34 of the locking elements 26, 32 have sloped upper surfaces such that as the cassette is inserted the locking elements 26, 32 are pushed backwards by the cassette into corresponding openings in the sidewalls 12. The locking elements 26, 32 are in their unlocked position. The locking elements 26, 32 are spring loaded to move into the locking position when the cassette is fully loaded as shown in FIGS. 7 and 8. The locking elements 26, 32 prevent the cassette from moving in an upward direction by interacting with locking features in the cassette. The ejectors 24, 28, 30 are spring loaded and cooperate with an underside of the cassette.

To eject a cassette, the ejector button 29 is actuated by a user pressing down on it, which unlocks the mechanism by moving the locking elements 26, 32 backwards into their corresponding openings in the sidewalls 12 of the cassette-receiving bay 8. The cassette is thus released and the ejectors 24, 28, 30 push the cassette upwards for easy removal from the printer 2.

Figure 13:
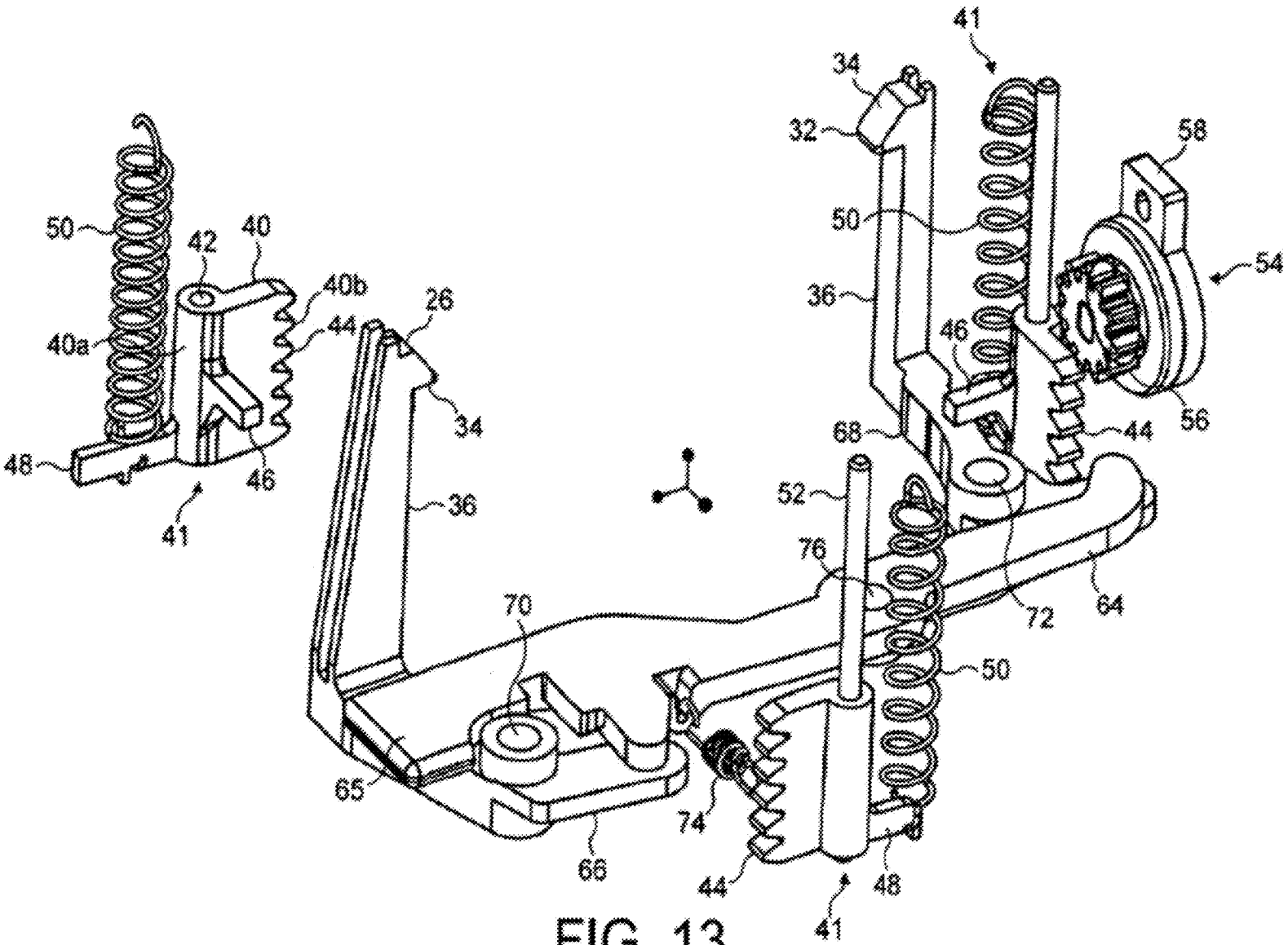
FIG. 13 is a view of the ejector mechanisms and the locking mechanism of the label printer of FIG. 1.

Referring to FIG. 13, the locking mechanism and the ejector mechanisms will now be described in more detail. The ejectors 41 each comprise a body portion 40. Adjacent to a first edge 40*a* thereof, the body portion 40 has hole 42 formed therethrough, the axis of the hole arranged so as to be parallel to the first edge 40*a* of the body portion 40. The hole 42 has a circular cross-section. Along a second edge 40*b* of the body portion 40, opposite the first edge 40*a*, the body portion 40 comprises a rack portion 44. An ejector element 46 extends perpendicularly from the plane of the body portion 40, which extends between the first and second edges 40*a*, 40*b*, from a point adjacent to the first edge 40*a* of the body portion 40, i.e., adjacent to the hole 42. The ejector element 46 is arranged to extend through a slit (not shown) in the sidewall 12 of the cassette-receiving bay 8. Each ejector 41 further comprises a biasing member 48 at the bottom end of the first edge 40*a* of the body portion 40. The biasing member 48 extends in the plane of the body portion 40 perpendicular to the axis of the hole 42. The biasing member 48 is coupled to one end of an expansion spring 50, for biasing the ejector element 46 towards the top end of the corresponding slit (not shown) in the sidewall 12 of the cassette-receiving bay 8. The top end of the slit in the sidewall 12 is the end adjacent to the top opening of the cassette-receiving bay 8, with the bottom end of the slit being that which is adjacent to the base 10 of the cassette-receiving bay 8.

The body portion 40 of the ejector mechanism 41 is mounted on a shaft 52, which extends through the hole 42 in the body portion 40. A damper 54 is disposed adjacent to the rack portion 44 of the body portion 40. The damper 54 comprises a pinion (or gear) 56 which is rotatably mounted to a damper mount part 58.

Figure 14:
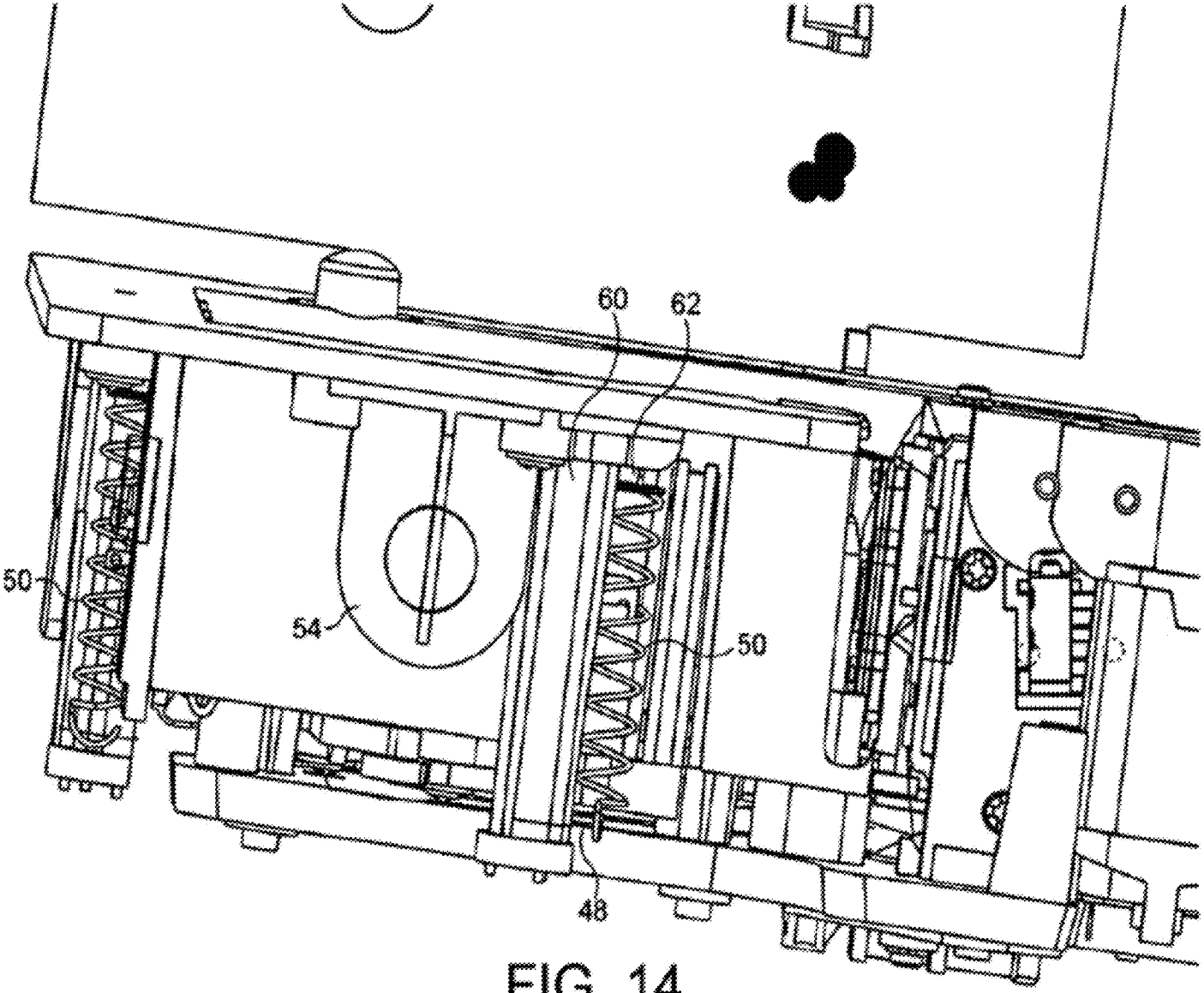
FIG. 14 is a side perspective view of the right hand side of the label printer of FIG. 1, showing an ejector mechanism.

FIG. 14 shows an ejector mechanism 41 of the label printer 2. As can be seen from FIG. 14, the ejector mechanism 41 comprises an ejector housing 60. The ejector housing 60 is approximately cylindrical in shape. The shaft 52 of the ejector mechanism 41 is disposed to be co-axial with the ejector housing 60. Accordingly, the body portion 40 is slidably mounted within the ejector housing 60, by means of the shaft 52 passing through the hole 42 formed at the first end 40*a* of the body portion 40. The ejector housing 60 comprises a first elongate opening along its length (not shown). The first elongate opening of the ejector housing 60 is aligned with a corresponding slit formed in a sidewall 12 of the cassette receiving bay 8. The ejector element 46 of the ejector mechanism 41 protrudes into the cassette-receiving bay 8 through the first elongate opening and through the slit in the sidewall 12, so as to interact with a cassette. The ejector housing 60 further comprises a second elongate opening (not shown) through which the biasing member 48 of the body portion 40 extends. As can be seen in FIG. 14, the biasing member 48 is attached to the lower end of the spring 50, i.e., the end of the spring 50 closest to the base 10 of the cassette receiving bay 8. The ejector housing 60 comprises a fixed extension 62 disposed at an upper end of the housing 60, adjacent to the top of the second elongate opening. The upper end of the spring 50 is attached to the fixed extension 62. Accordingly, the spring 50 acts so as to bias the body portion 40 of the ejector mechanism 41 towards the upper end of the housing 60. The ejector housing 60 further comprises a third elongate opening (not shown), through which the rack portion 44 at the second edge 40 *b* of the body portion 40 extends. The third elongate opening is aligned relative to a damper 54, such that the rack portion 44 meshes with the pinion 56 of the damper 54.

Figure 15:
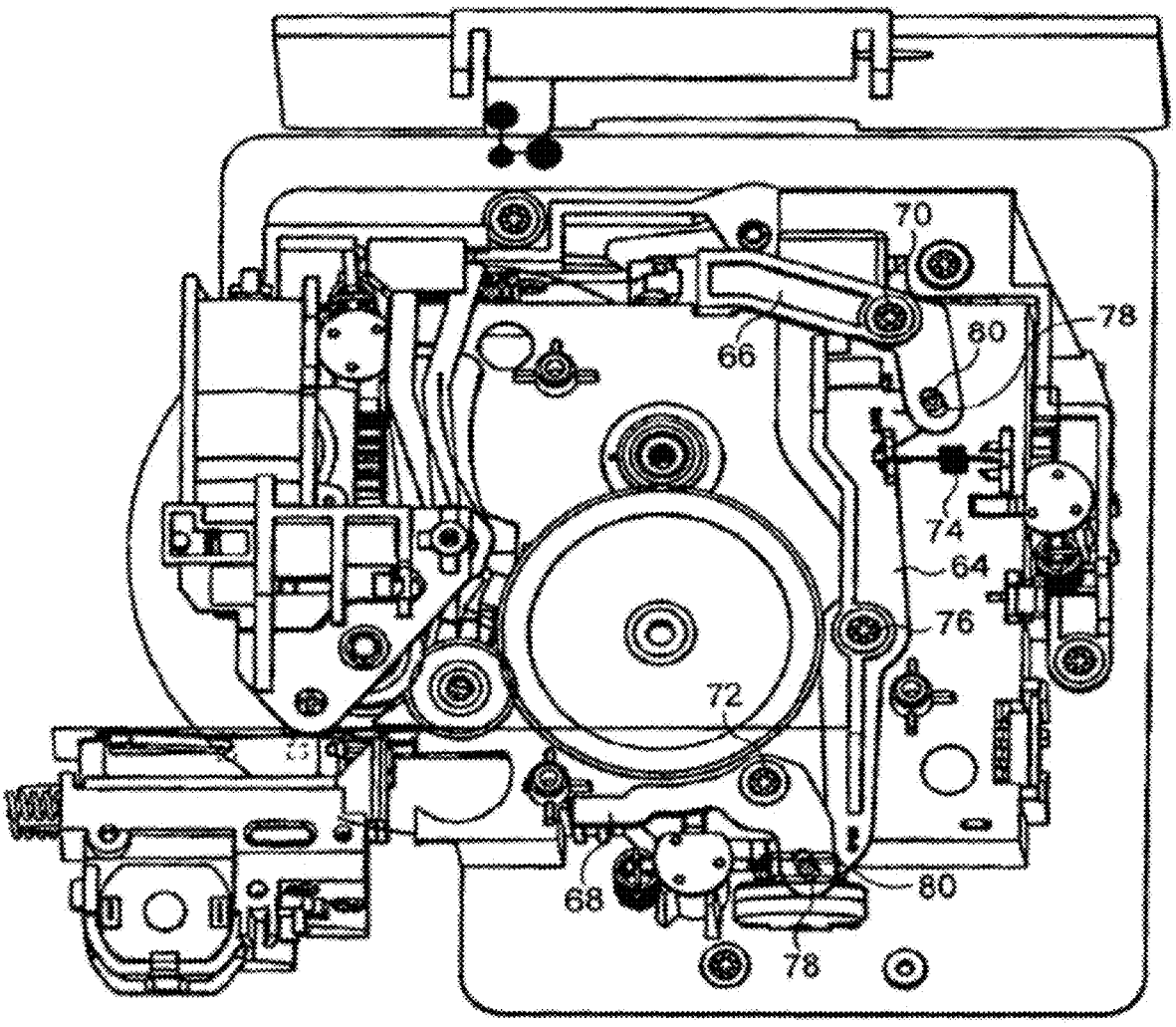
FIG. 15 is a bottom perspective view of the label printer of FIG. 1.

Referring to FIGS. 13 and 15, the locking mechanism will now be described in more detail. The locking mechanism comprises the two locking elements 26, 32. As described previously, the locking elements 26, 32 each comprise an elongate element 36 and a projection 34. Each projection 34 has a sloped upper surface for cooperating with a cassette inserted into the cassette-receiving bay 8 for moving the locking elements 26, 32 from the locking position to the unlocked position. The locking elements 26, 32 are coupled by an actuating bar 64. Each of the locking elements 26, 32 is coupled to the actuating bar 64 by a respective coupling member 66, 68 extending in a perpendicular direction relative to the locking element. The locking elements 26, 32 have respective centers of rotation 70, 72 on opposite sides of the actuating bar 64 to each other. The centers of rotation 70, 72 comprise pivot points attached to the printer body 4. A return spring 74 is provided for biasing the locking elements 26, 32 towards the locking position. The actuating bar 64 has a center of rotation 76, which also comprises a pivot point attached to the printer body 4. The first locking element 26 is rotatably coupled to the actuating bar 64 by means of a slot 78, provided in the distal end of the coupling member 66 relative to the first locking element 26, which cooperates with a pin 80 provided at a first end 65 of the actuating bar 64. The second locking element 32 is similarly rotatably coupled to a second end of the actuating bar 64.

Figure 16:
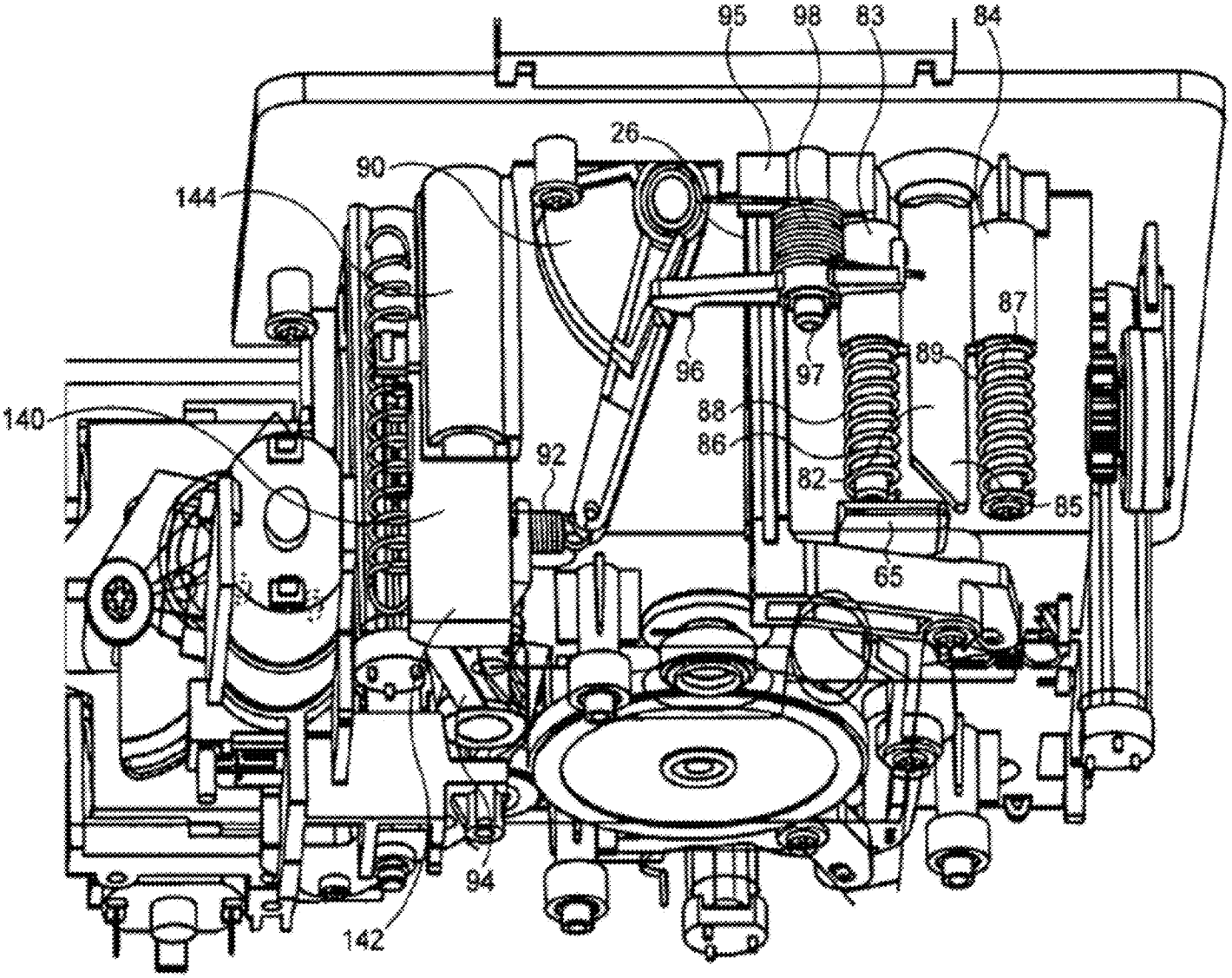
FIG. 16 is a side perspective view of the left hand side of the label printer of FIG. 1, showing a printhead stop mechanism according to the present disclosure, when the lid of the label printer is open and no cassette is inserted.

Referring to FIG. 16, the ejector button 29 is disposed adjacent to the cassette-receiving bay 8, so as to be pressed by a user to eject a cassette from the cassette-receiving bay 8 when the lid 6 is open and a cassette is inserted. The ejector button 29 comprises an actuator part 82. The upper end of the actuator part (not shown) has a circular cross-section and extends through an opening in the upper surface of the label printer 2, such that it can be pressed by a user. The lower end of the actuator part 82 comprises first and second tubular portions 83, 84 and a flange part 85 disposed therebetween.

The flange part 85 of the ejector button actuator part is angled at the lower end thereof, at an angle of approximately 450. First and second button guide shafts 86, 87 are mounted to the printer body 4 and pass through the first and second tubular portions 83, 84 of the actuator part 82, respectively, so as to guide the motion of the actuator part 82 when pressed by a user. First and second eject button springs 88, 89 are disposed on the first and second guide shafts 86, 87, respectively, so as to bias the actuator part 82 towards the top of the label printer 2.

Figure 17:
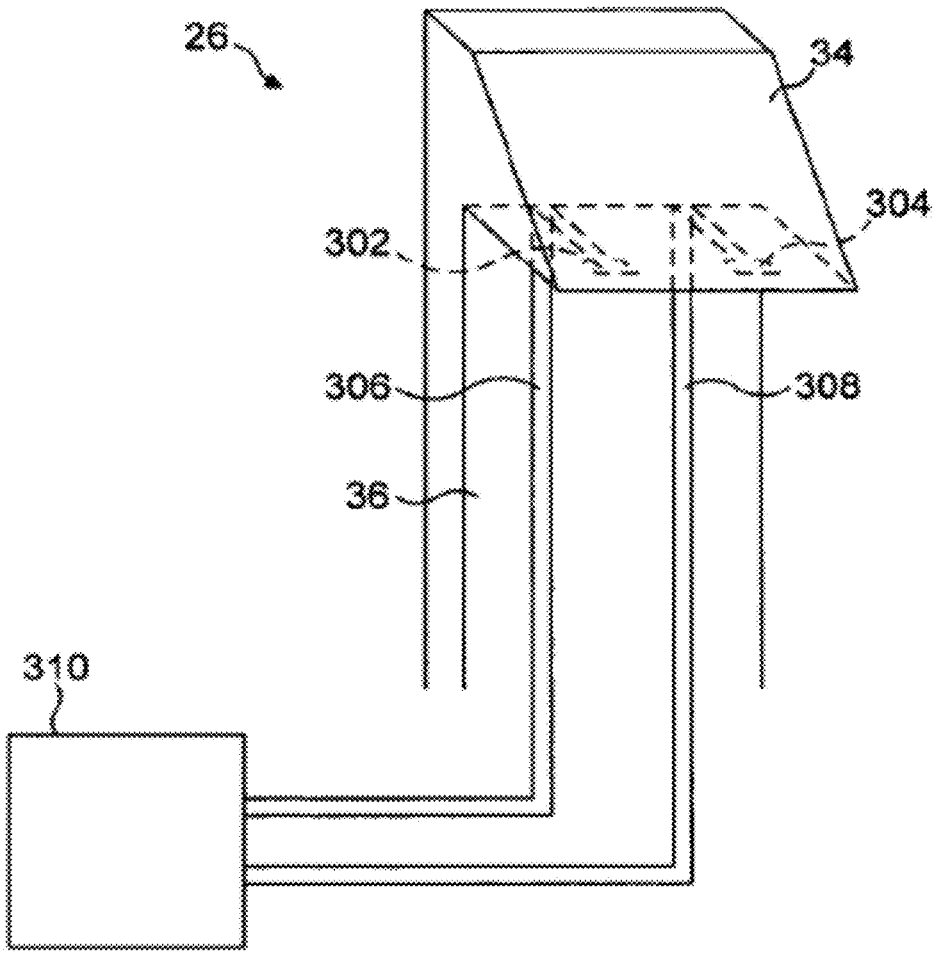
FIG. 17 is an enlarged view of the first locking element shown in FIG. 4, showing cassette detection means according to a first embodiment of the present disclosure.

Referring to FIG. 17, the first locking element 26 comprises cassette detection. The cassette detection comprises first and second contact pads 302, 304, which are connected to cassette detection circuitry 310 by means of respective first and second conduction connections such as wires, conductive pads, conductive material, etc. 306, 308. These conduction connections will be referred to as wires in the following but as will be appreciated this is by way of example only and the wires can be replaced by any other suitable conduction arrangement. The first and second contact pads 302, 304 are disposed on the lower surface (that is the surface which engages the cassette) of the projection 34 of the first locking element 26. The first wire 306 is connected to the first contact pad 302 at one end and extends from the first contact pad 302 along the surface of the elongate element 36 and is connected at the other end to the cassette detection circuitry 310. Similarly, the second wire 308 connects the second contact pad 304 to the cassette detection circuitry 310. In the this embodiment, the second locking element 32 is similarly provided with first and second contact pads 302, 304 that are connected to the cassette detection circuitry 310 via first and second wires 306, 308, respectively.

Figure 18:
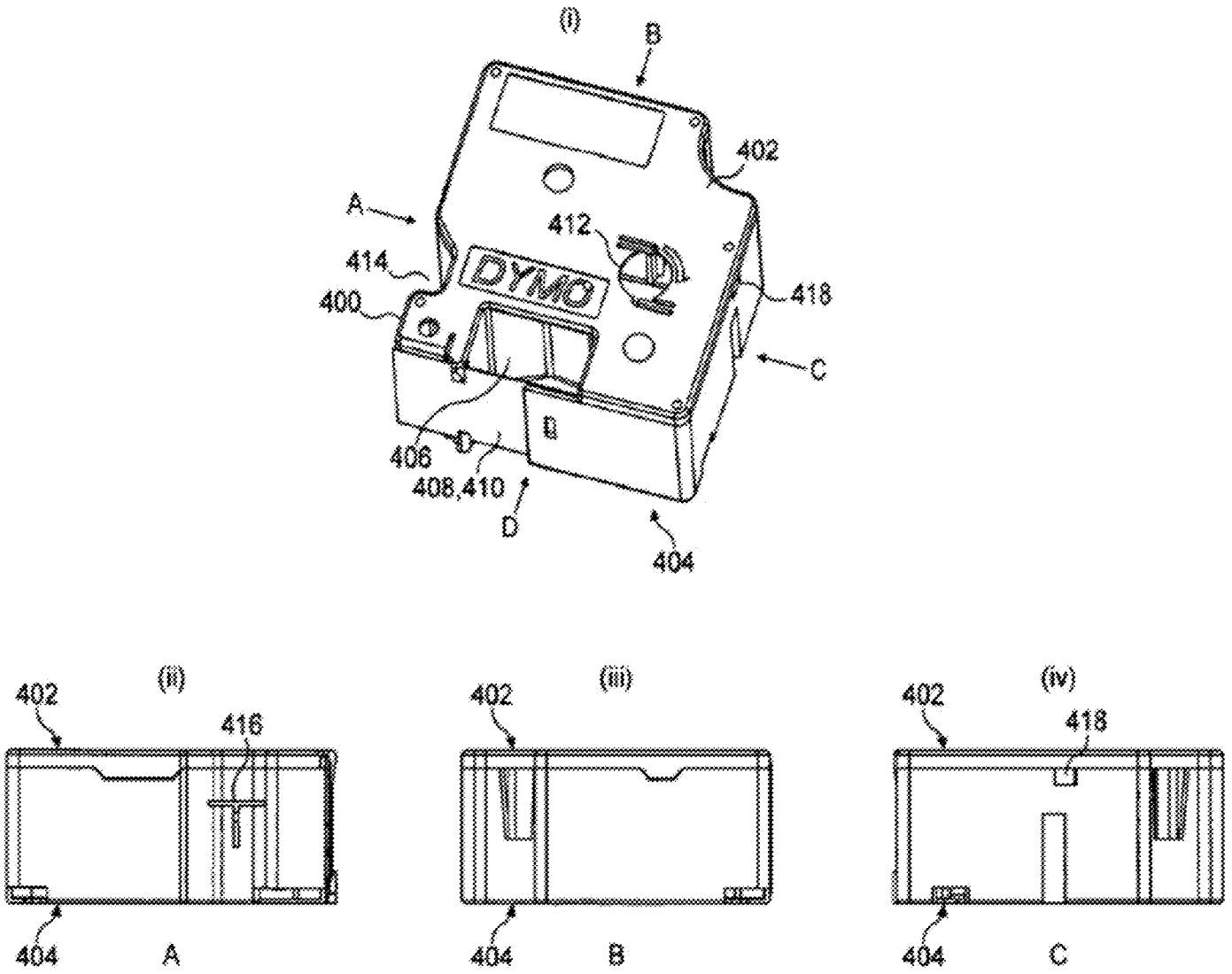
FIG. 18 shows four views of a 24 mm cassette for use with the cassette detection means of FIG. 17: (i) a top perspective view; (ii) side A; (iii) side B; and (iv) side C.

Referring to FIG. 18, the cassette 400 comprises a housing having a top 402, a base 404, and side surfaces A, B, C and D. The cassette houses an ink ribbon and a print receiving tape, or alternatively the cassette houses only a print receiving tape. In both embodiments, the print receiving tape may be continuous image receiving medium or the print receiving tape may be die cut labels on a continuous backing layer. An opening 406 is provided in the cassette housing through which the printhead of the label printer passes when the cassette is inserted into the cassette-receiving bay of the label printer. The tape and ink ribbon 408, 410 pass the opening 406 whereby the ink ribbon and tape 408, 410 are nipped between the platen and the printhead of the printer in use. An ink ribbon take-up spool 412 is provided which cooperates with a sprocket in the printer for driving the ink ribbon during printing.

As shown in FIGS. 18(*i*) and (ii), side A of the cassette comprises a recess 414 extending from the base 404 to the top 402 of the cassette to form a guide. A locking member 416 is provided in the recess 414 in the form of a rib extending across the recess in a direction parallel to the base and the top of the cassette. Providing the locking member 416 in a recess 414 saves space and allows for a smaller printer and/or a larger cassette. As shown in FIG. 18(*iii*), side C of the cassette comprises another locking member 418 in the form of an opening in the sidewall for cooperating with a locking element of the printer.

The recess 414 and locking member 416 of the label cassette may be arranged to form a combined guiding and locking arrangement, which cooperates with a complementary guiding and locking arrangement in the cassette-receiving bay of the printer.

The upper surface of locking member 416 is provided with an electrically conductive contact pad 417. Similarly, the base of the opening that forms the locking member 418 is also provided with an electrically conductive contact pad 429.

Figure 19:
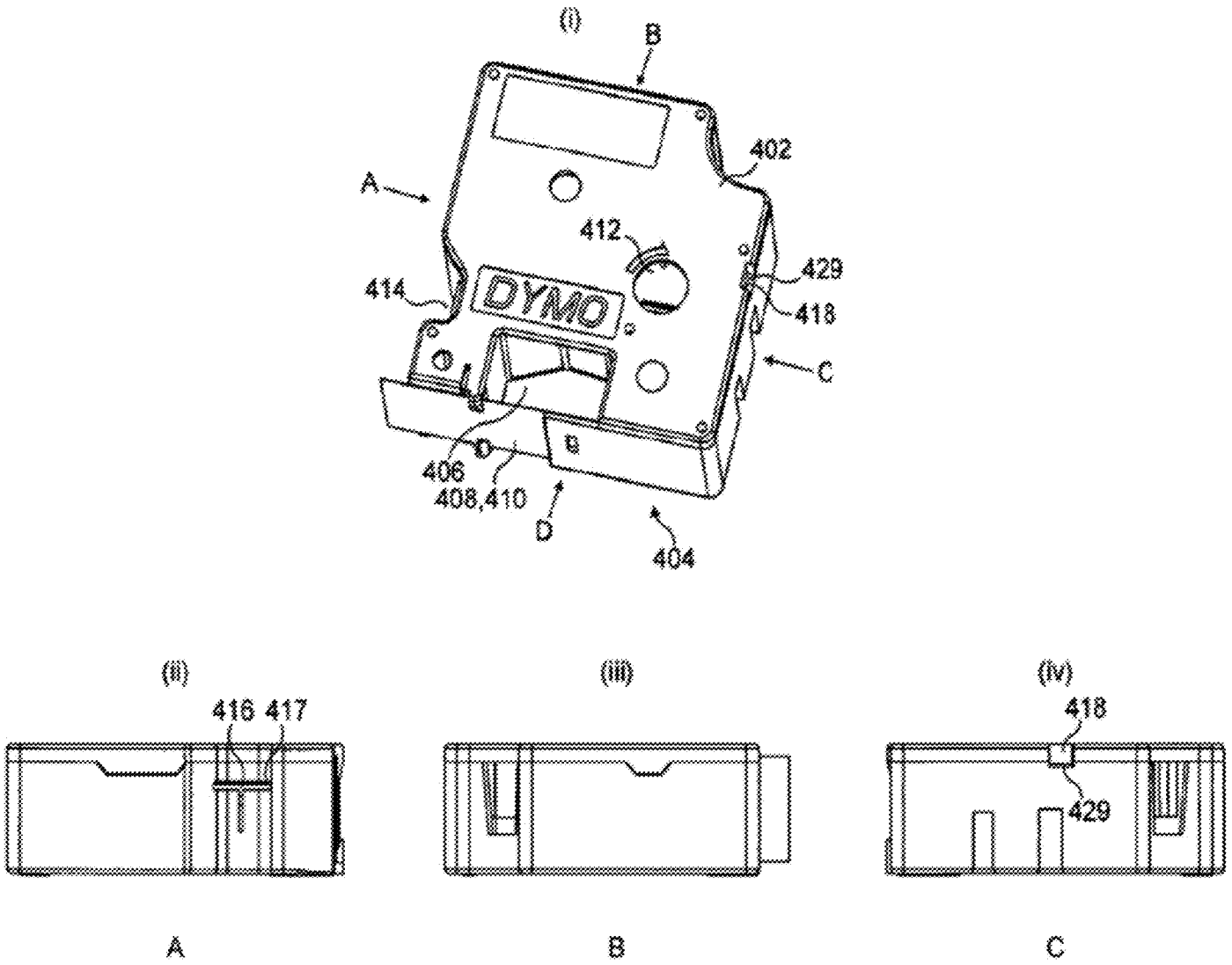
FIG. 19 shows four views of a 19 mm cassette for use with the cassette detection means of FIG. 17: (i) a top perspective view; (ii) side A; (iii) side B; and (iv) side C.
Figure 20:
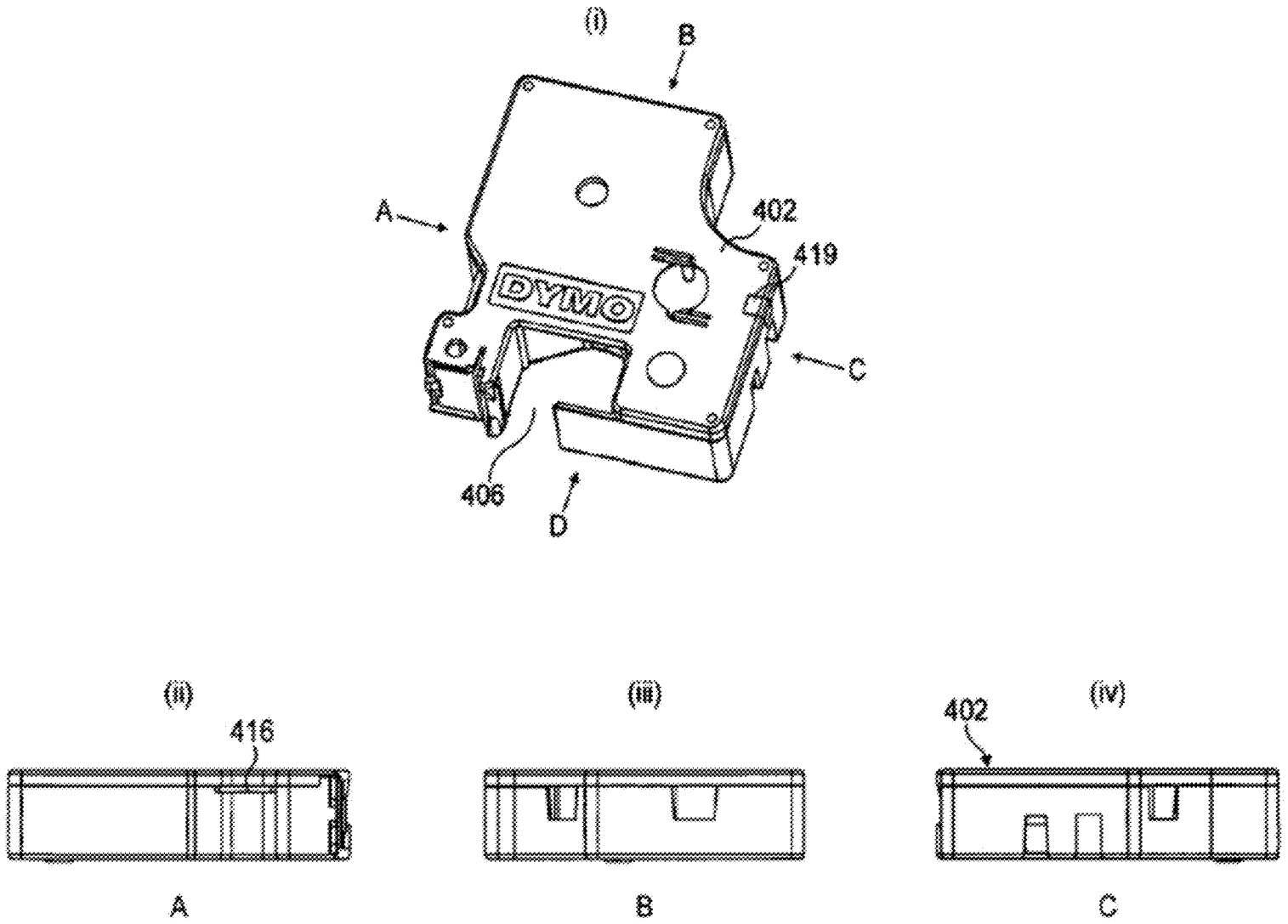
FIG. 20 shows four views of a 12 mm cassette for use with the cassette detection means of FIG. 17: (i) a top perspective view; (ii) side A; (iii) side B; and (iv) side C.

FIGS. 19 and 20 show similar structural features of a 19 mm cassette and a 12 mm cassette respectively. The cassettes form a set comprising label cassettes of differing widths as measured from the base to the top. It can be seen by comparing FIGS. 18-20 that the ratio of a distance between the base and the locking members and a distance between the locking members and the top increases on decreasing width. That is, the smaller the width of the cassette then the higher the locking members are located on the cassette. In fact, the 12 mm cassette does not have a locking opening in side C at all and in this case, the top of the label cassette 102 interacts with the locking element 26 in the printer. In the case of the 12 mm cassette, an electrically conductive contact pad 419 is provided on the top of the cassette 102, such that the contact pad 419 is in contact with the second locking element 32 of the label printer 2, when the cassette is inserted into the cassette-receiving bay 8. This aforementioned arrangement allows for label cassettes of differing widths to be positioned and locked in the correct printing position in a label printer.

The operation of the above-described locking mechanism, ejector mechanisms and cassette detection means will now be described. When there is no cassette inserted in the cassette-receiving bay 8, the spring 50 of each ejector mechanism 41 is in an unextended state and, accordingly, each ejector element 24, 28, 30 is disposed at the top end of the corresponding slot in the side wall 12 of the cassette-receiving bay 8. The locking elements 26, 32 of the locking mechanism are biased towards the locking position, by means of the return spring 74 acting on the actuating bar 64.

When a cassette is inserted into the cassette receiving bay 8, the base of the cassette presses down on each ejector element 24, 28, 30. This, in turn, causes the body portion 40 of each ejector to move downwards along the shaft 52 and causes the spring 50 to extend. As the body portion 40 moves downwards, the rack portion 44 is meshed with the pinion 56 of the damper 54. Accordingly, the pinion 56 of the damper 54 is rotated as the cassette is inserted and provides a resistance to the force applied to the cassette by a user who inserts the cassette into the cassette receiving bay 8. The resistance provided by the pinion 56 engaging with the rack portion 44 is preferably selected so as not to be so great that a user requires excessive force to insert a cassette into the cassette-receiving bay 8, which could damage components of the ejector mechanisms.

When the cassette has been inserted fully into the cassette-receiving bay, the locking elements 26, 32 engage with corresponding portions of the cassette, so as to hold the cassette in the cassette-receiving bay 8 against the force exerted on the base of the cassette by the ejector elements 24, 28, 30. More specifically, the projection 34 of the first locking element 26 engages with locking member 418 of the cassette. Accordingly, the first and second contact pads 302, 304 of the first locking element 26 are in contact with the conductive pad 429 of the locking member 418. The conductive pad 429 of the locking member 418 is dimensioned such that a conductive connection between the first and the second pad is created when the locking element engages the locking member. Similarly, the projection 34 of the second locking element 32 engages with locking member 416 of the cassette. Accordingly, the first and second contact pads 302, 304 of the second locking element 32 are in contact with the conductive pad 417 of the locking member 416. The conductive pad 417 of the locking member 416 is dimensioned such a conductive connection is created between the first and the second pad when the locking element engages the locking member.

The cassette detection circuitry 310 may detect the engagement of the first and second locking elements 26, 32 with the locking members 418, 416 of the cassette, by measuring the resistance, voltage or current, or by substituting the measured value into an analog or digital measurement between the first and second contact pads 302, 304 of each locking element 26, 32. For example, if a voltage is applied to the first contact pad then a current will flow between the first and second contact pads 302, 304, via the respective conductive pads of the cassette locking members 418, 416. Accordingly, the cassette detection circuitry can determine whether the first and second locking elements 26, 32 are properly engaged with the cassette by detecting the flow of the current.

Figure 21:
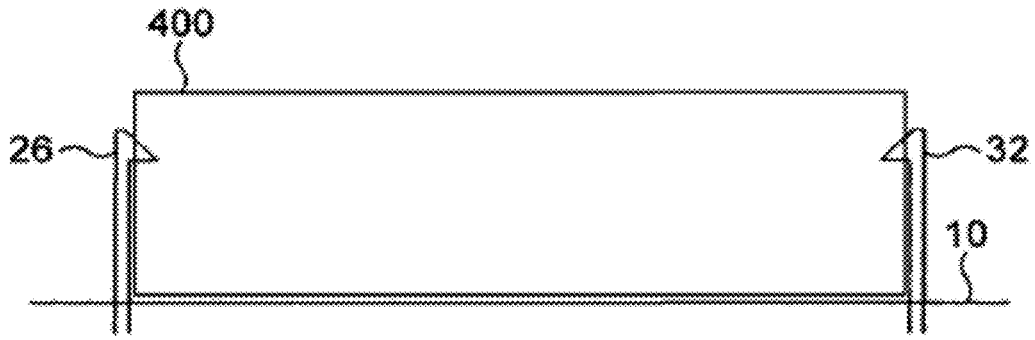
FIG. 21 shows a schematic representation of a cassette inserted in a cassette receiving bay where: (i) the first and second locking elements are properly engaged with the cassette; and (ii) the first locking element is properly engaged with the cassette and the second is not engaged with the cassette.
Figure 21:
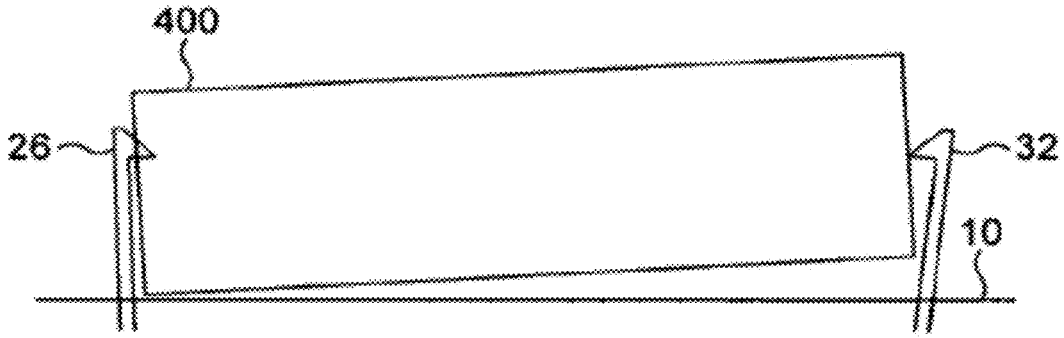

Referring to FIG. 21 (*i*), when the cassette is correctly inserted and both the first and second locking elements 26, 32 are properly engaged, the cassette detection circuitry determines that the cassette is correctly inserted and printing may be commenced. Referring to FIG. 21 (*ii*), it is possible that one of the locking elements will not be properly engaged with the cassette if, for example, the cassette is inserted with an uneven force. In this case, no current will flow between the first and second contact pads 302, 304 of the second locking element 32 because the first and second contact pads 303, 304 are not in contact with the conductive pad of the cassette locking member 416. The cassette detection circuitry will determine that the second locking element 32 is not engaged properly with the cassette.

When it is determined by the cassette detection circuitry that one or more of the locking elements 26, 32 is not properly engaged with the cassette, a label printer controller (not shown) may control the label printer to prevent printing. Furthermore, the controller may inform a user via a display means (not shown), which may be a liquid crystal display, that the cassette is not properly inserted. In the present embodiment, the cassette detection circuitry is operable to determine which of the one or more locking element 26, 32 is not properly engaged with the cassette. Accordingly, the controller may inform the user via the display means, as to which locking element/s are not engaged with the cassette and may further inform the user as to what action is required in order to correctly insert the cassette. For example, the control may display a diagram similar to FIG. 21 (*ii*) on the display means, to indicate which side of the cassette must be pressed in order for the cassette to be inserted properly. Such an indication may also be displayed in the event that one or more of the locking elements disengages from the cassette, for example, as a result of the printer being dropped and subjected to a sudden impact. The latter may also be displayed in the event that one or more of the locking elements disengages from the cassette during transport of the label printer with a cassette installed.

Once the cassette has been inserted correctly, the cassette detection circuitry detects the engagement of the locking elements 26, 32 with the cassette and the controller enables printing to commence.

After printing, a cassette may be ejected by a user pressing the eject button 29. When the eject button 29 is pressed, the downward movement of the actuating part 82 causes the angled flange part 85 to push against the first end 65 of the actuating bar 64. Referring again to FIG. 15, the actuating bar 82 rotates around its center of rotation 76 in an anti-clockwise direction (as viewed). Accordingly, the coupling member 66 of the first locking element 26 rotates clockwise around center of rotation 70, thereby moving the first locking element 26 to the unlock position. At the same time, the coupling member 68 of the second locking element 32 rotates anti-clockwise around center of rotation 72, thereby moving the second locking element 32 to the unlock position.

With the locking elements 26, 32 in the unlock position, the cassette is free to move under the force exerted by the ejector elements 24, 28, 30. As the expansion springs 50 of the ejector mechanisms 41 contract, the ejector elements 24, 28, 30 move up their corresponding slits in the sidewalls 12 of the cassette-receiving bay 8 and push the cassette out of the cassette receiving bay 8. At the same time, the rack portion 44 of each ejection mechanism 41 is meshed with the pinion 56 of the corresponding damper 54. Accordingly, the engagement of the rack portion 44 and the pinion 56 provides a resistance to the upward movement of the ejector elements 24, 28, 30. Thus, by employing a damper 54, the acceleration of an ejector element in the upward direction under the force of the expansion spring 50 is reduced. The cassette is thus gradually ejected from the cassette-receiving bay 8. The degree of resistance provided by the pinion 56 of the damper 54 may be determined by the viscosity of oil used to lubricate the pinion with respect to the damper mount part 58.

In an alternative embodiment, only one of the locking elements may be provided with contact pads for detecting engagement of that particular locking element with the cassette. In this case, the user may be informed of whether or not the locking element provided with the contact pads is properly engaged with the cassette. Preferably, the one locking element provided with contact pads is positioned adjacent the printhead such that it is detected that the cassette is positioned correctly adjacent the position where the image is formed on the tape. In another embodiment, the label printer is only provided with a single locking element for retaining a cassette in the cassette-receiving bay. In this case, the single locking element could be provided with contact pads for detecting the insertion of a cassette as described above. Preferably, the single locking element is positioned adjacent the printhead.

Figure 22:
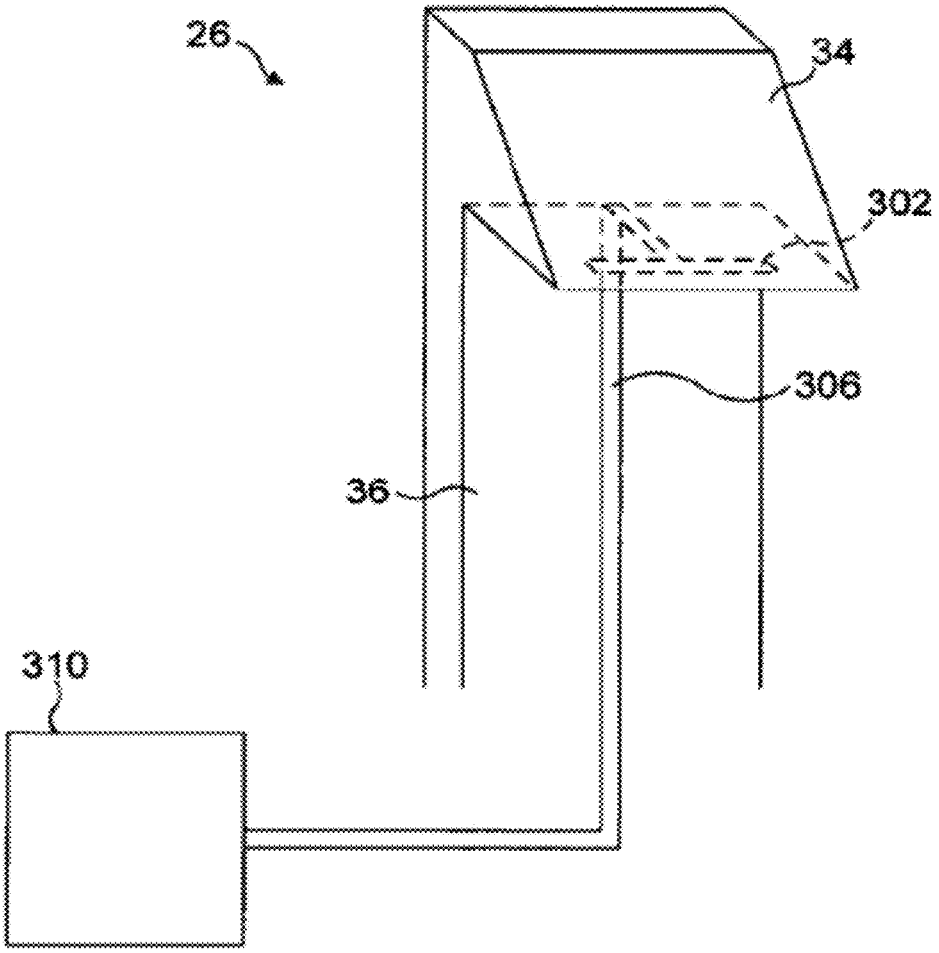
FIG. 22 is an enlarged view of the first locking element shown in FIG. 4, showing cassette detection means according to an alternative embodiment of the present disclosure.

Referring to FIG. 22, in yet another embodiment, the first locking element 26 is provided with a single contact pad 302, which is connected to cassette detection circuitry 310 by conductive connection 306, which can of course take any suitable format such as a wire or the like. Similarly, the second locking element 32 is provided with a single contact pad, which is connected to the cassette detection circuitry 310 by means of a conductive connection such as a wire 306 or the like. This arrangement can be used to detect the correct insertion of cassette of the type shown in FIGS. 23 to 25.

Figure 23:
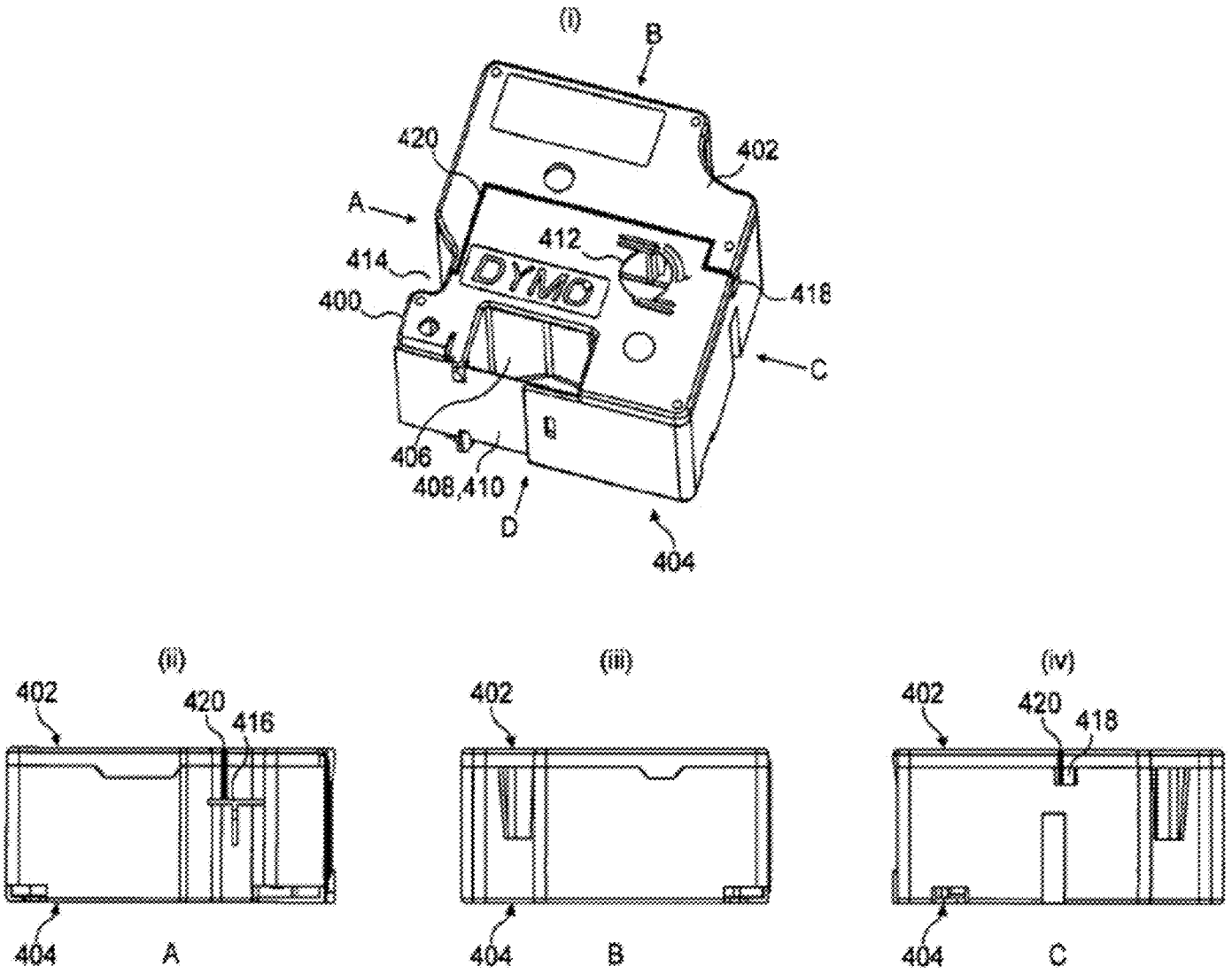
FIG. 23 shows four views of a 24 mm cassette for use with the cassette detection means of FIG. 22: (i) a top perspective view; (ii) side A; (iii) side B; and (iv) side C.

Referring to FIG. 23, the cassette 400 is the identical to that described above with reference to FIG. 18, with the exception that the conductive pads 302 of the cassette locking members 416, 418 connected by a continuous conductive connection 420 disposed on the upper surface 402 of the cassette. This connection can of course take any suitable format and in one embodiment is in the form of a metal track. The position of the connection is one example and may be provided on any other side or sides of the cassette. The position of the connection on the surface is also by way of example and may be provided at any suitable position. The continuous conductive connection could take any format and could be a form of conductive strip, tape or paint on surface of the cassette, or a thicker conductive member, which follows a path between the conductive contact pads 302. The continuous conductive connection may be arranged in the interior of the cassette, such as along a surface inside the cassette or as a component in the cassette. Accordingly, when the cassette is correctly inserted the cassette-receiving bay 8, the contact pad of the first locking element 26 is in contact with the conductive pad of the locking member 418 and the contact pad of the second locking element 32 is in contact with the conductive pad of the locking member 416. The cassette detection circuitry 310 can therefore detect that the cassette has been properly engaged by both the first and second locking elements 26, 32 by, for example, by measuring the resistance, voltage or current, or by substituting the measured values with an analog or digital measurement flowing between the contact pads of the first and second locking elements 26, 32, via the conductive connection 420.

Figure 24:
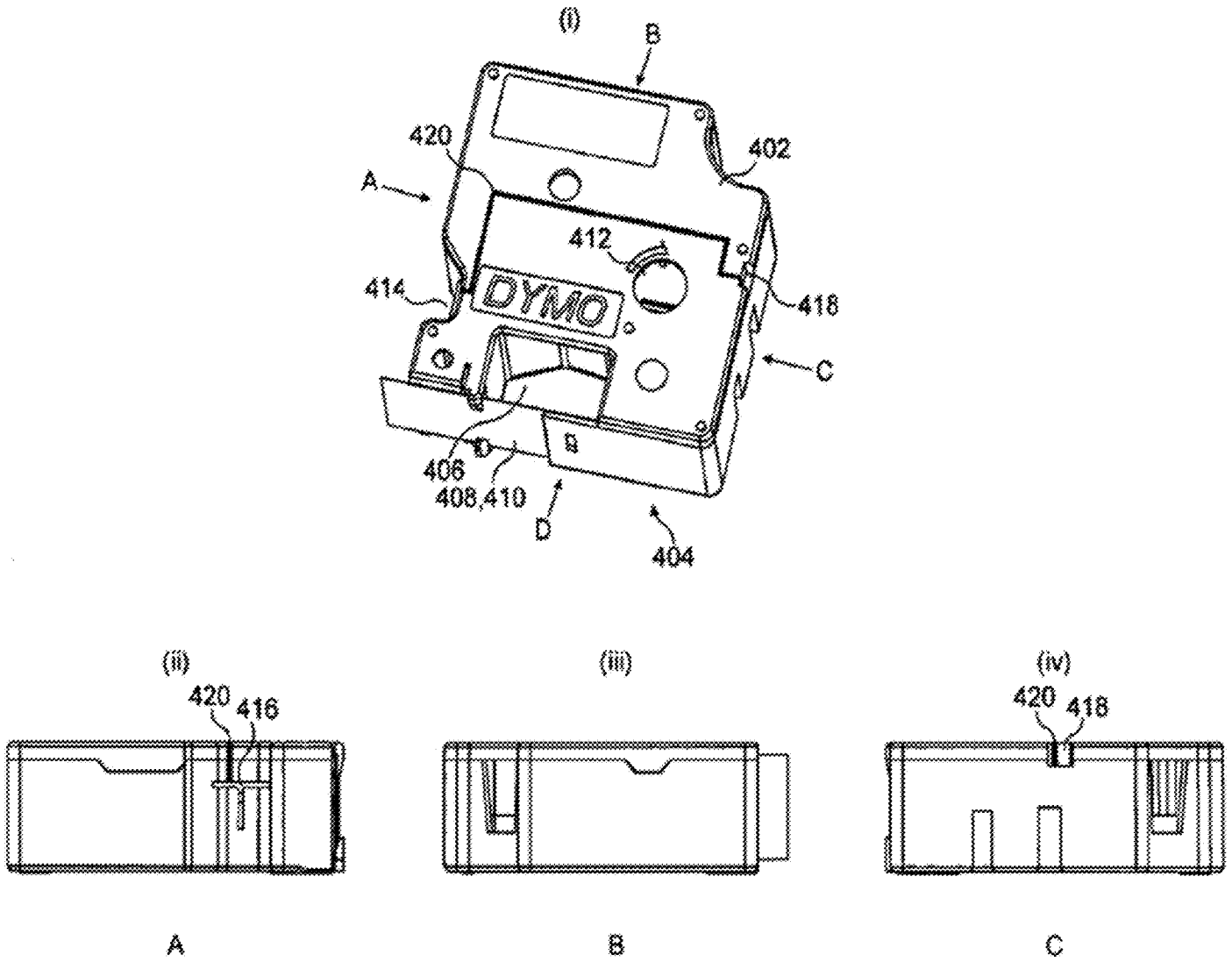
FIG. 24 shows four views of a 19 mm cassette for use with the cassette detection means of FIG. 22: (i) a top perspective view; (ii) side A; (iii) side B; and (iv) side C.
Figure 25:
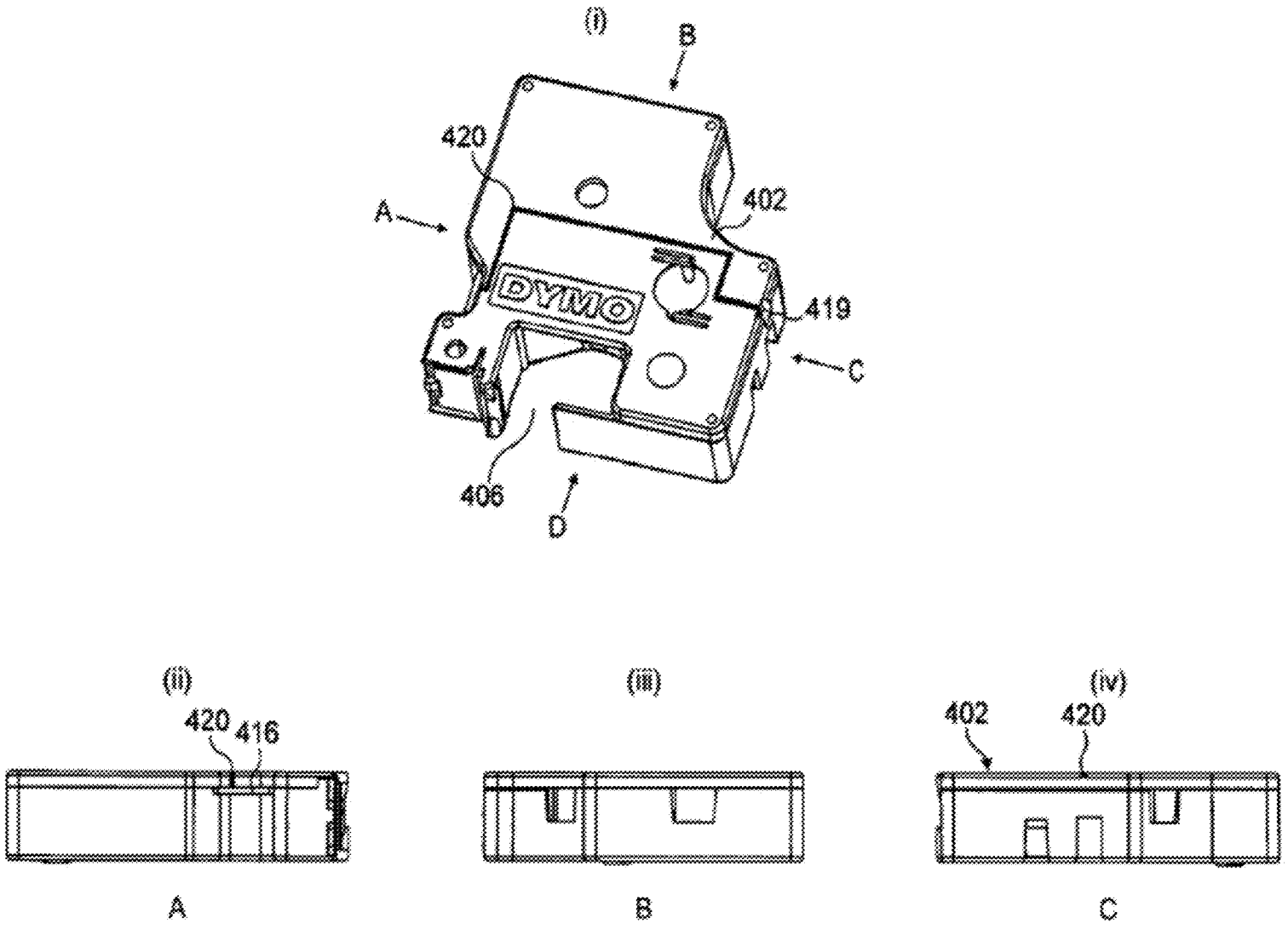
FIG. 25 shows four views of a 12 mm cassette for use with the cassette detection means of FIG. 22: (i) a top perspective view; (ii) side A; (iii) side B; and (iv) side C.

FIGS. 24 and 25 show cassettes which correspond to those shown in FIGS. 19 and 20, but with the addition of a conductive connection 420 running across the top of the cassette to between the conductive pads. The conductive pads may be formed integrally with the conductive connection.

A further embodiment will now be described with reference to FIGS. 27-35. For conciseness, any like part of the label printer 2' in these figures will be referred to with the same reference numeral as that used in FIGS. 1 and 7 but with an apostrophe (') suffix.

Figure 27:
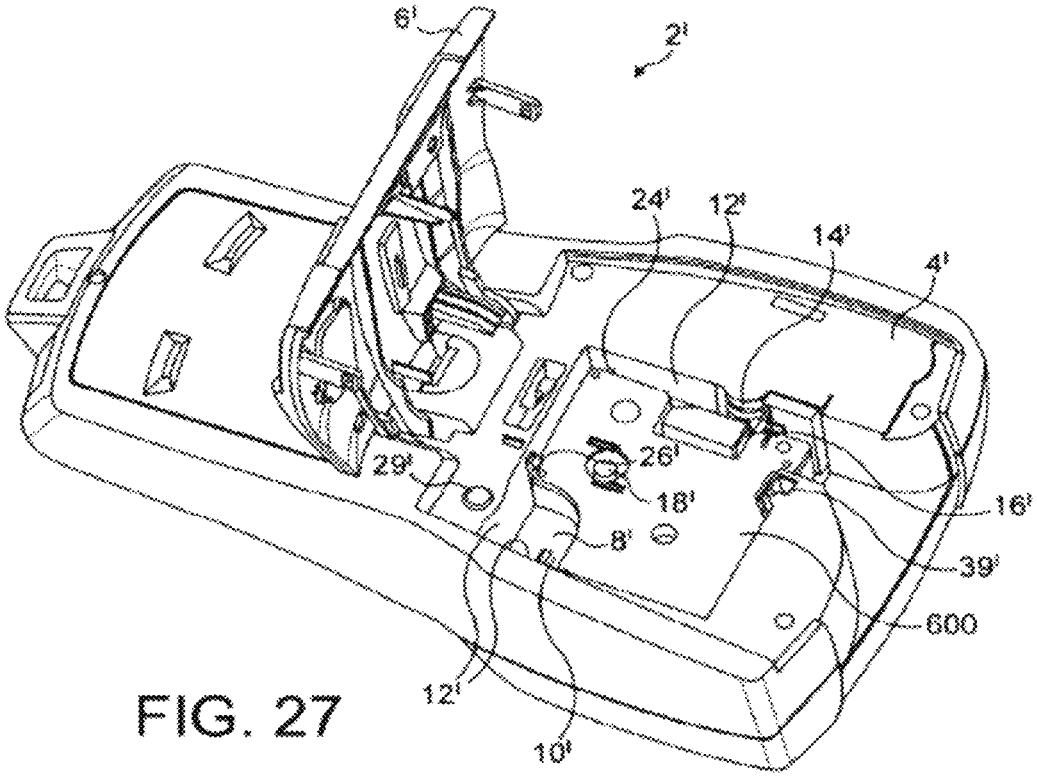
FIG. 27 is a top perspective view of another embodiment of a label printer according to the present disclosure, the label printer having its lid open and a cassette present.
Figure 28:
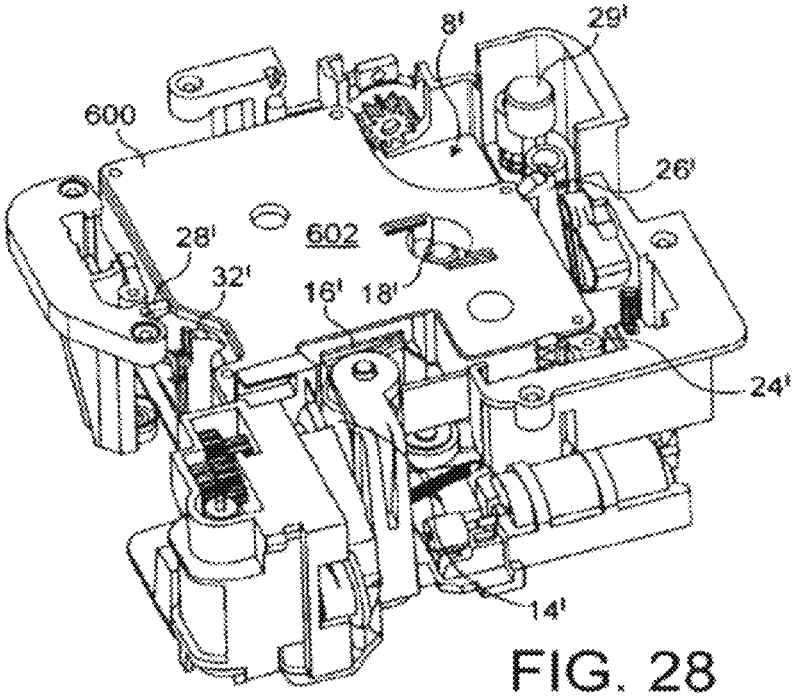
FIG. 28 is a perspective view of the label printer of FIG. 27 illustrating the positions of first and second locking elements and first and second ejector elements with a cassette installed in the cassette-receiving bay.

Referring to FIGS. 27 and 28, the label printer 2' of the further embodiment comprises a body 4', a cover 6', and a cassette-receiving bay 8' substantially as described above. A platen 14' and a printhead 16' are again provided in the cassette-receiving bay 8'. An ink ribbon take-up sprocket 18' again extends from the base 10' into the cassette-receiving bay 8'.

First and second ejector elements 24', 28' similar to those described above are visible on sidewalls of the cassette-receiving bay 8'. An actuator button 29' is again provided on the surface of the body 4' for actuating the locking mechanism. To eject a cassette 600 from the printer 2', the ejector button 29' is actuated by a user pressing down on it, which unlocks the locking mechanism as discussed above. The ejectors 24', 28' push the cassette 600 upwards for easy removal from the printer 2'. The operation of the ejectors and actuator button 29' is the same as that described above so, for conciseness, the operation of these will not be further described herein.

Also visible is a first locking element 26' of a locking mechanism (which is not visible but is the same in operation as that described above). A second locking element 32' of the locking mechanism is positioned on the sidewall of the cassette-receiving bay 8' opposite from the first locking element 26'.

As for the previously described embodiment, each of the locking elements 26', 32' is provided at a side of the cassette-receiving bay 8' and extends part way into the cassette-receiving bay 8' through an opening in the sidewall 12' of the receiving bay 8' for interaction with an inserted cassette 600. Each locking element 26', 32' comprises a body 37' comprising a projection 34' and an elongate element 36' that extends in a direction from the base 10' to the top opening of the cassette-receiving bay 8'. The projection 34' is at a top end of the elongate element 36' and extends towards a central portion of the cassette-receiving bay 8' substantially perpendicularly to the elongate axis of the elongate element 36'. One of the sidewalls of the cassette-receiving bay 8' has a guide portion 39' and one of the locking elements 32' is positioned in an opening in the guide portion 39'.

Referring to FIGS. 27-33 and 35, when a cassette 600 is installed in the cassette-receiving bay 8', the first and second locking elements 26', 32' are in the locking position. During insertion, the cassette 600 contacts the locking elements 26', 32'. The projections 34' of the locking elements 26', 32' have sloped upper surfaces for cooperating with the cassette 600 such that, as the cassette 600 is inserted into the bay 8', the locking elements 26', 32' are moved backwards by the cassette 600 from the locking position to an unlocked position in corresponding openings in the sidewalls 12'. The locking elements 26', 32' are biased to move into the locking position when the cassette 600 is correctly loaded to prevent the cassette 600 from moving in an upward direction by interacting with locking members 616, 618 of the cassette 600, which are discussed below.

Figure 33:
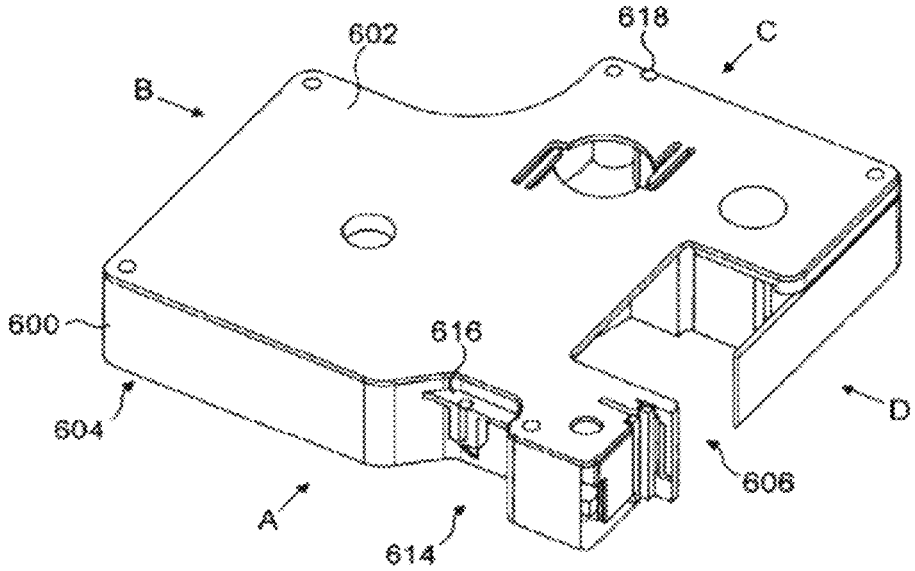
FIG. 33 shows three views of a cassette for use with the label printer of FIG. 27: (i) a top perspective view; (ii) close up of Side A; (iii) close up of side C.
Figure 33:
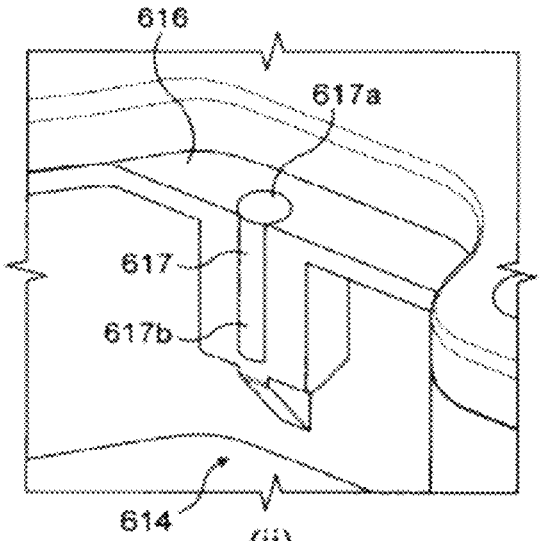
Figure 33:
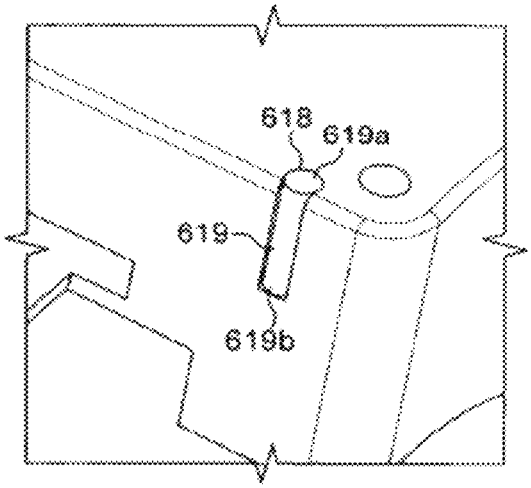

Referring to FIG. 33, a cassette 600 comprises a housing having a top 602, a base 604, and side surfaces A, B, C and D. In this embodiment, the cassette 600 houses an ink ribbon and a print receiving tape as described above. In alternative embodiments, the cassette 600 houses only a print receiving tape. The various forms of print receiving tape discussed above are equally applicable to this embodiment.

As shown in FIG. 33(*i*), and in close-up in FIG. 33(*ii*), side A of the cassette 600 comprises a recess 614 extending from the base 604 to the top 602 of the cassette 600 to form a guide. A locking member 616 is provided in the recess 614 in the form of a rib extending across the recess in a direction parallel to the base 604 and the top 602 of the cassette. This locking member 616 is for cooperating with the second locking element 32' of the printer 2'. As shown in FIG. 33(*i*), and in close-up in FIG. 33(*iii*), side C of the cassette comprises another locking member 618 in the form of a portion of the top 602 of the cassette 600 for cooperating with the first locking element 26' of the printer 2'.

The recess 614 and locking member 616 of the label cassette are arranged to form a combined guiding and locking arrangement, which cooperates with a complementary guiding and locking arrangement in the cassette-receiving bay 8' of the printer 2'.

The upper surface of locking member 616 is provided with a first contact surface 617 *a* of an electrically conductive contact pad 617. The contact pad 617 comprises a conductive area of a cylindrical bar and the first contact surface 617*a* is comprised in the top end surface of the bar. The bar is recessed into the cassette housing and extends along a side A of the cassette 600 in a direction perpendicular to the top 602 of the cassette 600. Side A of the cassette also includes a second contact surface 617*b* of the electrically conductive contact pad 617. The second contact surface 617*b* comprises an elongate side surface of the bar and runs substantially perpendicularly to the first contact surface 617*a*.

Similarly, the portion of the top 602 of the cassette 600, which forms the locking member 618, is provided with a first contact surface 619*a* of an electrically conductive contact pad 619. The contact pad 619 also comprises a conductive area of a cylindrical bar and the first contact surface 619*a* is comprised in the top end surface of the bar. The bar is recessed into the cassette housing and extends along side C of the cassette 600 in a direction perpendicular to the top 602 of the cassette 600. Side C of the cassette also includes a second contact surface 619*b* of the electrically conductive contact pad 619. The second contact surface

619*b* comprises an elongate surface of the bar and runs substantially perpendicularly to the first contact surface 619*a*.

Although in this embodiment, the contact pads 617, 619 are shown to comprise the end and outer curved surfaces of bars that have circular cross-sections, in other embodiments the bars may be replaced with blocks of different cross-sections, such as square or rectangular cross-sections. Thus, the second contact surfaces 617 *b*, 619 *b* may then comprise flat outer surfaces of respective blocks.

In other embodiments, only the contact surfaces 617*a*, 619*a*, 617*b*, 619*b* of the bars may be exposed, while the conductive paths between the surfaces are encased in the cassette housing. In still further embodiments, the bars may be attached onto the sides A and C of the cassette 600, rather than being partly or fully recessed into the sides A, C.

In other embodiments, the contact pads 617, 619 may comprise thin layers (such as film, paint or tape) applied to or set into the surface of the cassette 600. The contact surfaces 617*a*, 619*a*, 617*b*, 619*b* may then each comprise portions of the thin layers.

Referring to the cut-away view in FIG. 34, a first locking element 26' of this further embodiment will be described. The first locking element 26' comprises cassette detection. The cassette detection comprises first and second contact pads 702, 704, which comprise conductive portions of respective first and second conductive members 703, 705 that protrude from the body 37' of the first locking element 26'. The members 703, 705 comprise metal strips that pass through the first locking element 26' from the side of the elongate element 36' of the first locking element 26' from which the projection 34' projects to the side of the elongate element 36' opposite that from which the projection 34' projects. The first and second contact pads 702, 704 are located on the side of the elongate element 36' from which the projection 34' projects.

The first contact pad 702 lies adjacent the lower surface (that is the surface which engages the cassette) of the projection 34' of the first locking element 26', and in this embodiment comprises a bent portion of the end of the first conductive member 703. The second contact pad 704 lies adjacent a surface of the elongate element 36' that extends perpendicularly from the lower surface of the projection 34' of the first locking element 26'. In this embodiment, the second contact pad 704 comprises a bent portion of the end of the second conductive member 705.

The first and second conductive members 703, 705 are connected to cassette detection circuitry 710 by means of respective first and second conduction connections such as wires, conductive pads, conductive material, etc. 706, 708. The first conduction connection 706 is connected at one of its two ends to a connection point 701 of the first conductive member 703, and is connected at its other end to the cassette detection circuitry 710. The second conduction connection 708 is similarly connected to a connection point 709 of the second conductive member 705, and is connected at its other end to the cassette detection circuitry 710. As above, the conduction connections could be wires or any other suitable conduction arrangement.

In the current embodiment, the second locking element 32' is similarly provided with first and second contact pads 702, 704 that are connected to the cassette detection circuitry 710 via first and second conduction connections 706, 708, respectively.

Figure 34:
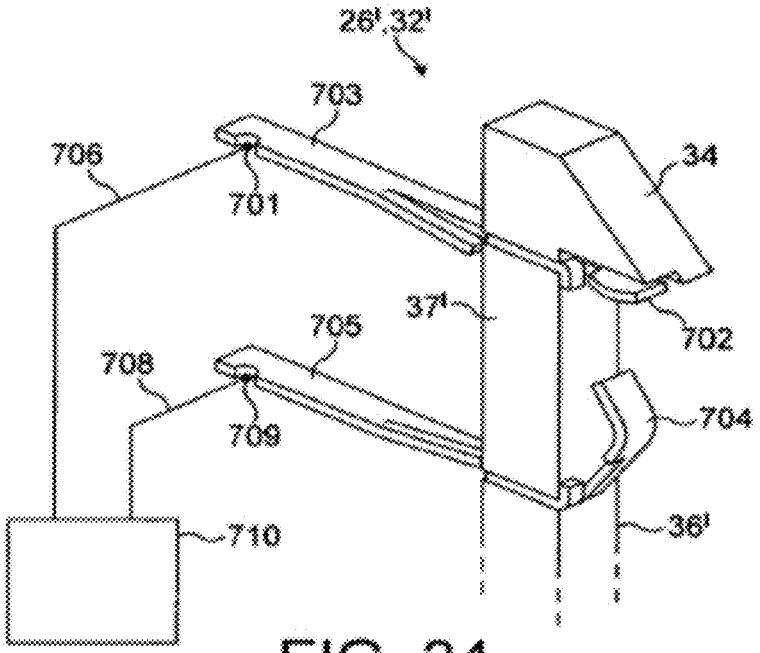
FIG. 34 shows a section view through one of the at least one locking elements of the label printer of FIG. 27 when no cassette is installed in the cassette-receiving bay.

FIGS. 29, 31, 32, and 25 illustrate in detail the cassette 600 of FIG. 33 locked in the cassette receiving bay 8' by the first and second locking elements 26, 32 of FIG. 34. As can be seen in these figures, when the cassette 600 is correctly inserted in the receiving bay 8', the locking elements 26', 32' engage with the corresponding locking members 618, 616 of the cassette 600.

More specifically, the projection 34' of the first locking element 26' engages with locking member 618 of the cassette 600. Accordingly, the first contact pad 702 of the first locking element 26' is in contact with the first contact surface 619*a* of the contact pad 619 of the locking member 618, and the second contact pad 704 of the first locking element 26' is in contact with the second contact surface 619*b* of the contact pad 619 of the locking member 618. The first and second contact surfaces 619*a*, 619*b* of the locking member 618 are each dimensioned such that a conductive connection between the first and the second contact pads 702, 704 of the first locking element 26' is created via the contact pad 619 when the first locking element 26' engages the locking member 618.

Similarly, the projection 34' of the second locking element 32' engages with locking member 616 of the cassette 600. Accordingly, the first contact pad 702 of the second locking element 32' is in contact with the first contact surface 617*a* of the contact pad 617 of the locking member 616, and the second contact pad 704 of the second locking element 32' is in contact with the second contact surface 617*b* of the contact pad 617 of the locking member 616. The first and second contact surfaces 617*a*, 617*b* of the locking member 616 are each dimensioned such that a conductive connection between the first and the second contact pads 702, 704 of the second locking element 32' is created via the contact pad 617 when the second locking element 32' engages the locking member 616.

The contact pads 702, 704 are each biased away from the body 37' of the locking element 26', 32' on which they are arranged. When a force applied to contact pad 702 in a direction substantially towards the lower surface of the projection 34' is removed, the contact pad 702 springs away from the lower surface of the projection 34' of the body 37' to a resting position. Similarly, when a force applied to contact pad 704 in a direction substantially towards the elongate element 36' (i.e., substantially perpendicular to said direction towards said lower surface) is removed, the contact pad 704 springs away from the elongate element 36' of the body 37' to its resting position.

To illustrate this, in FIG. 34 no such forces are applied to the contact pads 702, 704, so the contact pads 702, 704 are in their respective resting positions. In the cut-away view of FIG. 35, the contact pads 702, 704 of the printer 2' are shown in contact with one or other of the contact pads 617, 619 of the cassette 600 when the cassette 600 is correctly installed in the printer 2'. There is an interference fit between the contact pads 617, 619 and the contact pads 702, 704 when the cassette 600 is correctly installed in the printer 2', so the contact pads 702, 704 of the locking elements 26', 32' are moved away from their resting positions. As the contact pads 702, 704 of the locking elements 26', 32' are biased to their resting positions, good contact (and thus good electrical connection) is made between them and the contact pads 617, 619 of the cassette 600.

Figure 29:
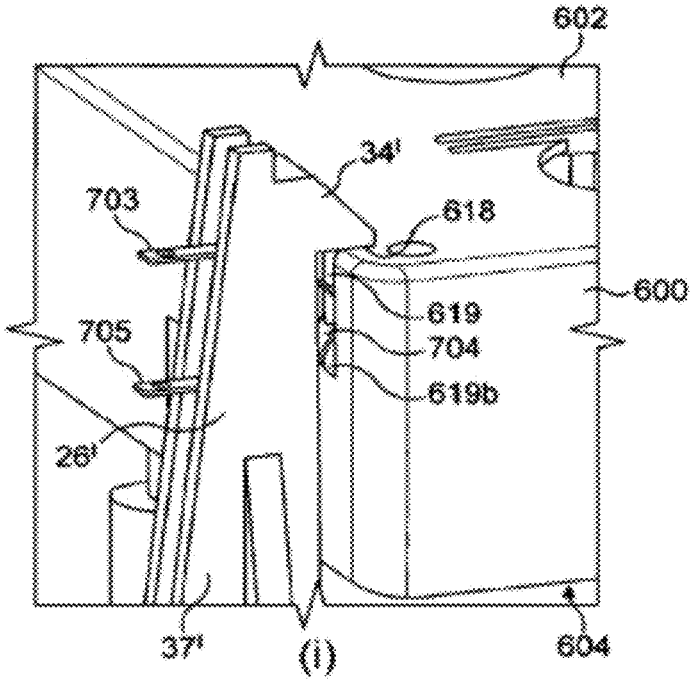
FIG. 29(*i*) is a view illustrating the interaction with a cassette of a first locking element of the label printer shown in FIG. 27, and FIG. 29(*ii*) is a view illustrating the interaction with a cassette of a second locking element of the label printer shown in FIG. 27.
Figure 29:
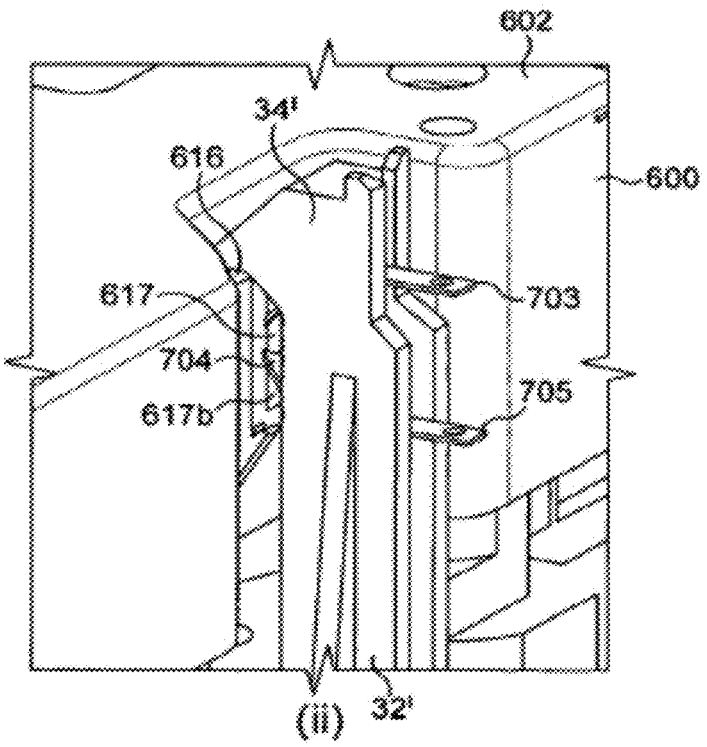
Figure 30:
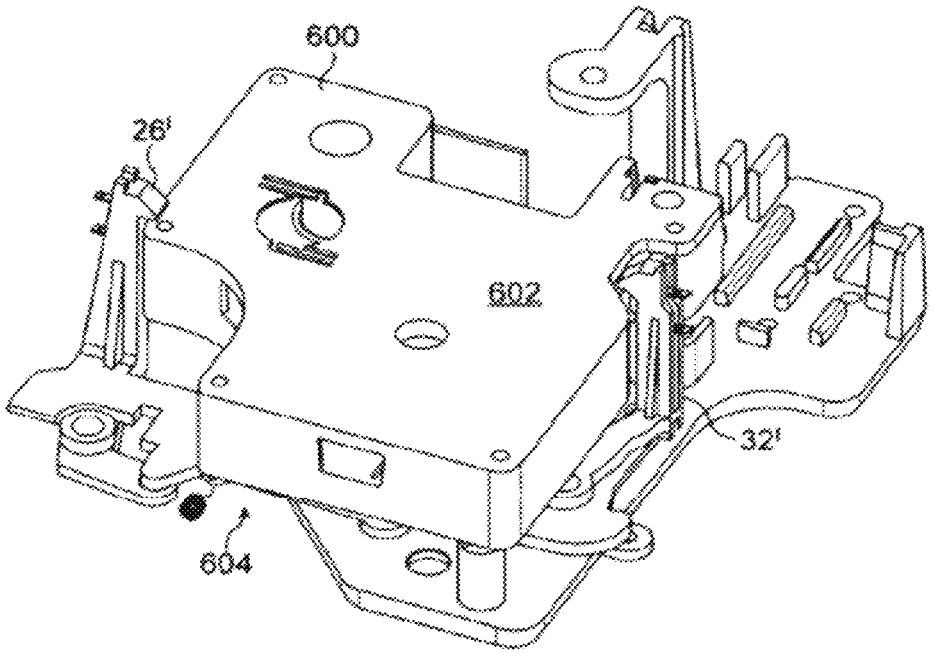
FIG. 30 is another perspective view of the label printer of FIG. 27 illustrating the positions of the first and second locking elements with a cassette installed in the cassette-receiving bay.
Figure 31:
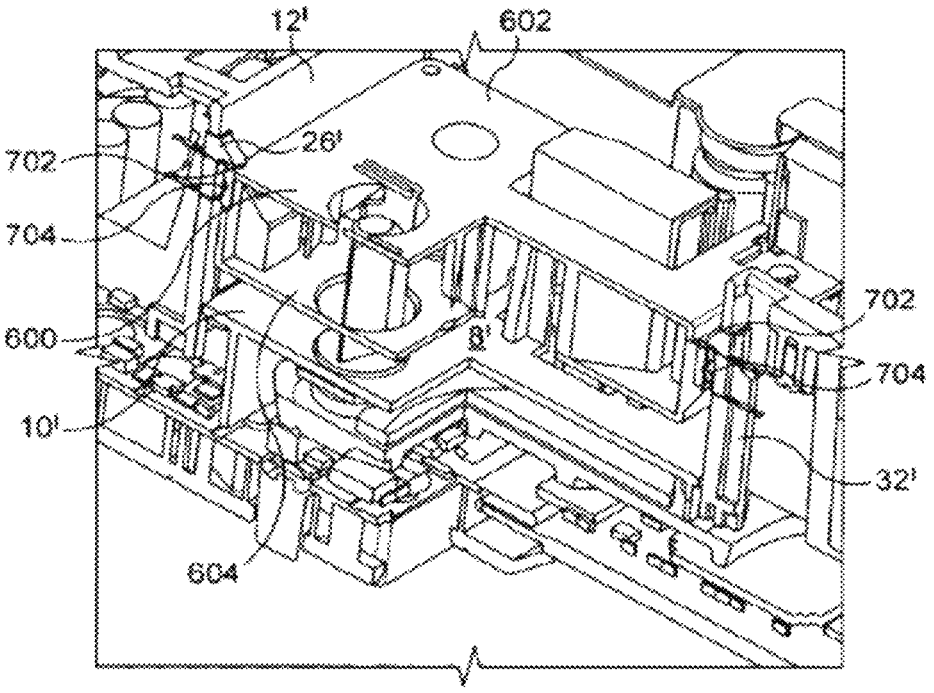
FIG. 31 is a section view through the label printer and cassette shown in FIG. 30.
Figure 32:
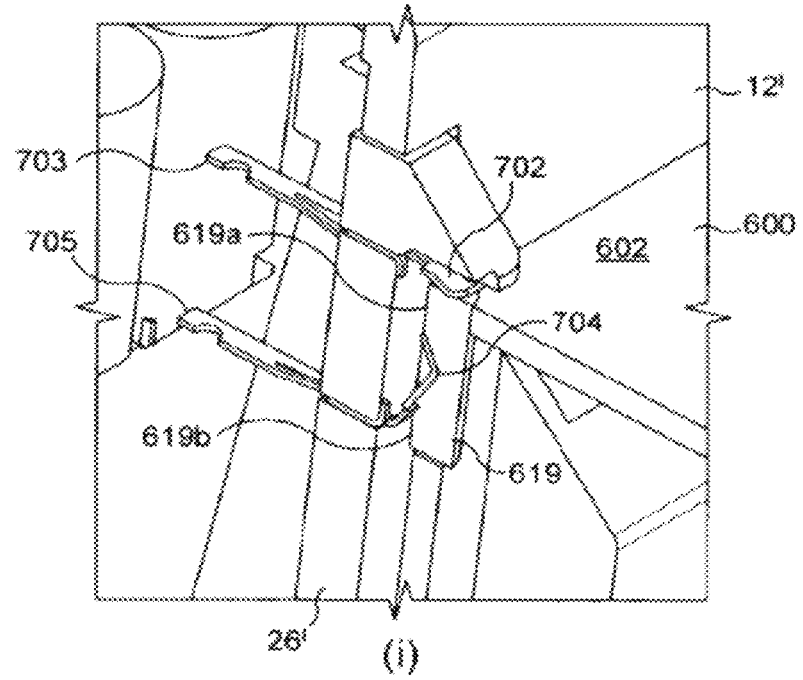
FIG. 32 is a close up view of the label printer and cassette shown in FIG. 31, with (i) showing the interaction with the cassette of the first locking element, and (ii) showing the interaction with the cassette of the second locking element.
Figure 32:
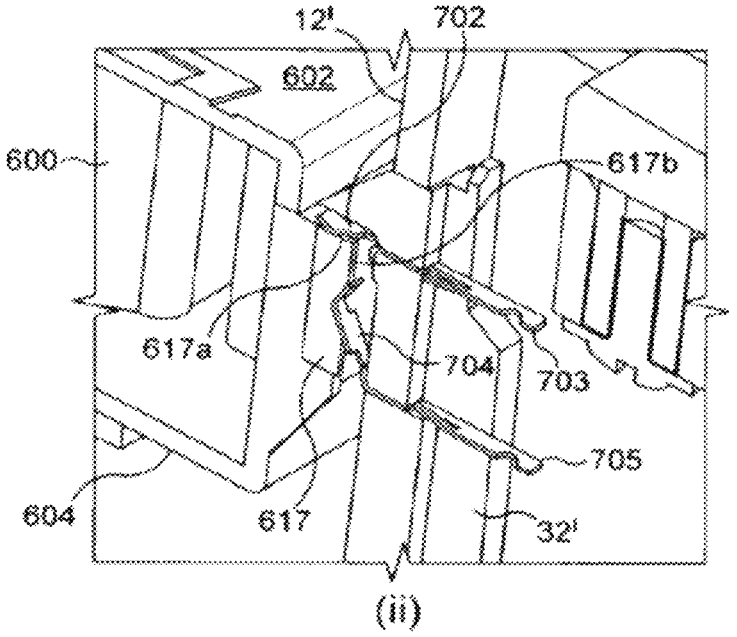
Figure 35:
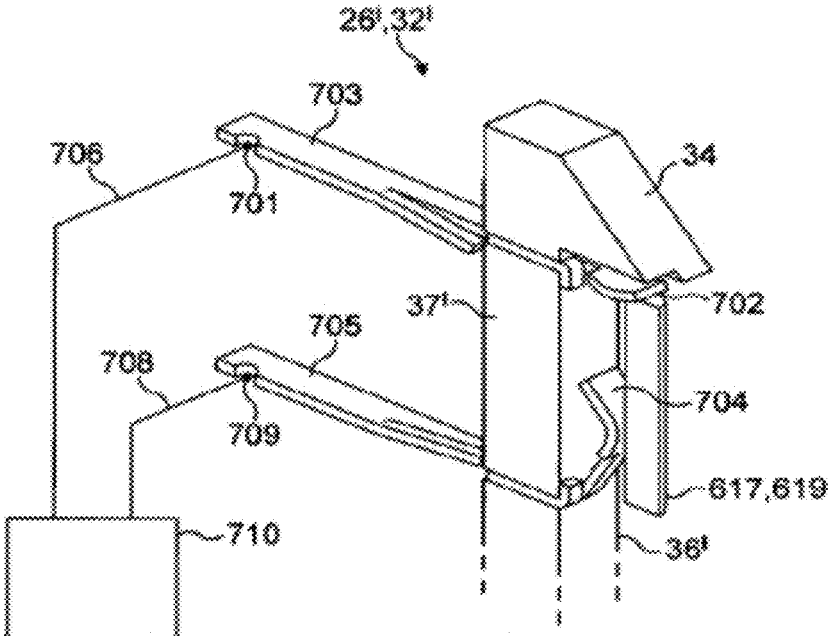
FIG. 35 shows a section view through the locking element of FIG. 34 when a cassette is correctly installed in the cassette-receiving bay.
Figure 36A:
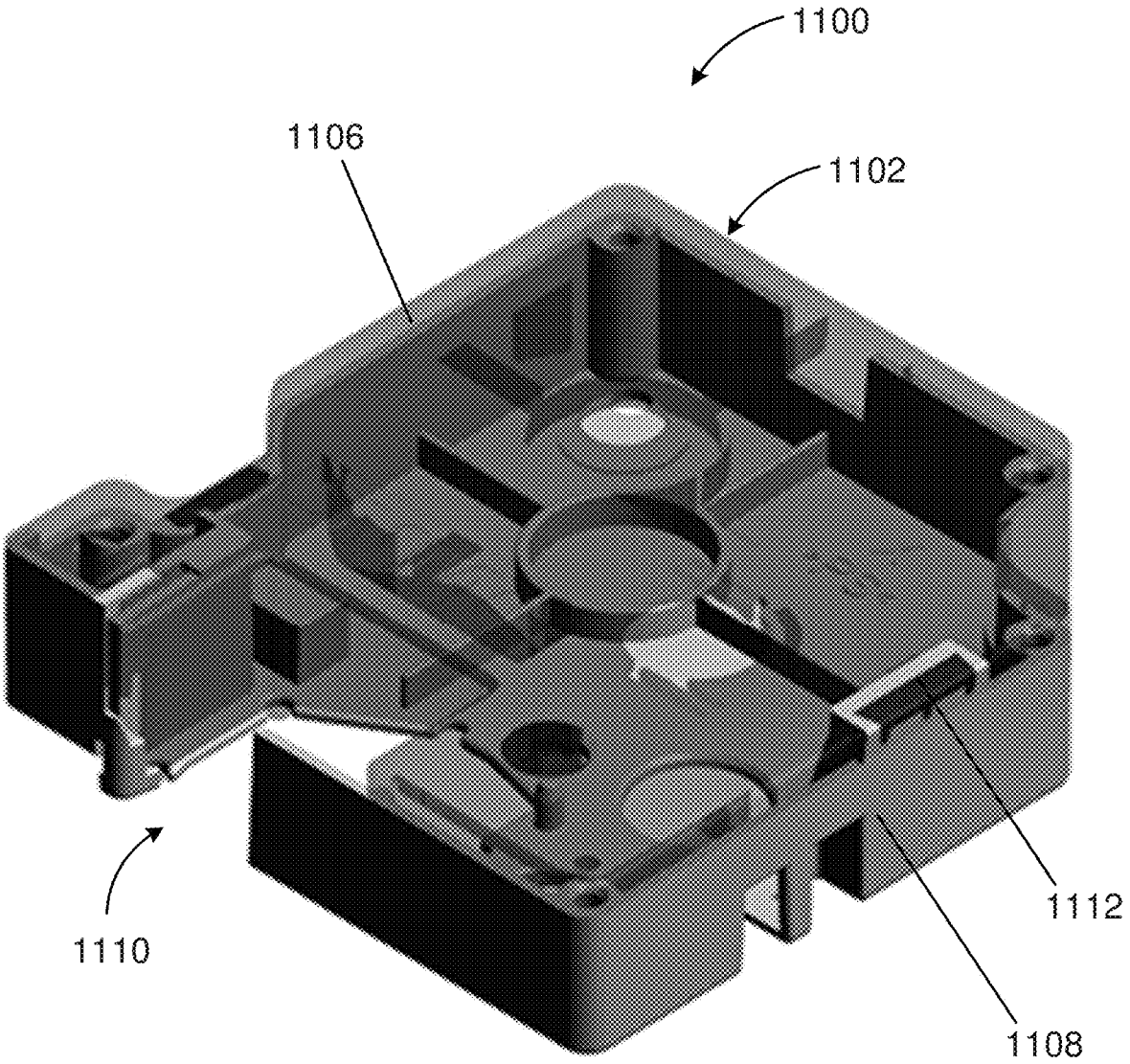
FIG. 36A is a perspective view of one embodiment of a cassette.
Figure 36B:
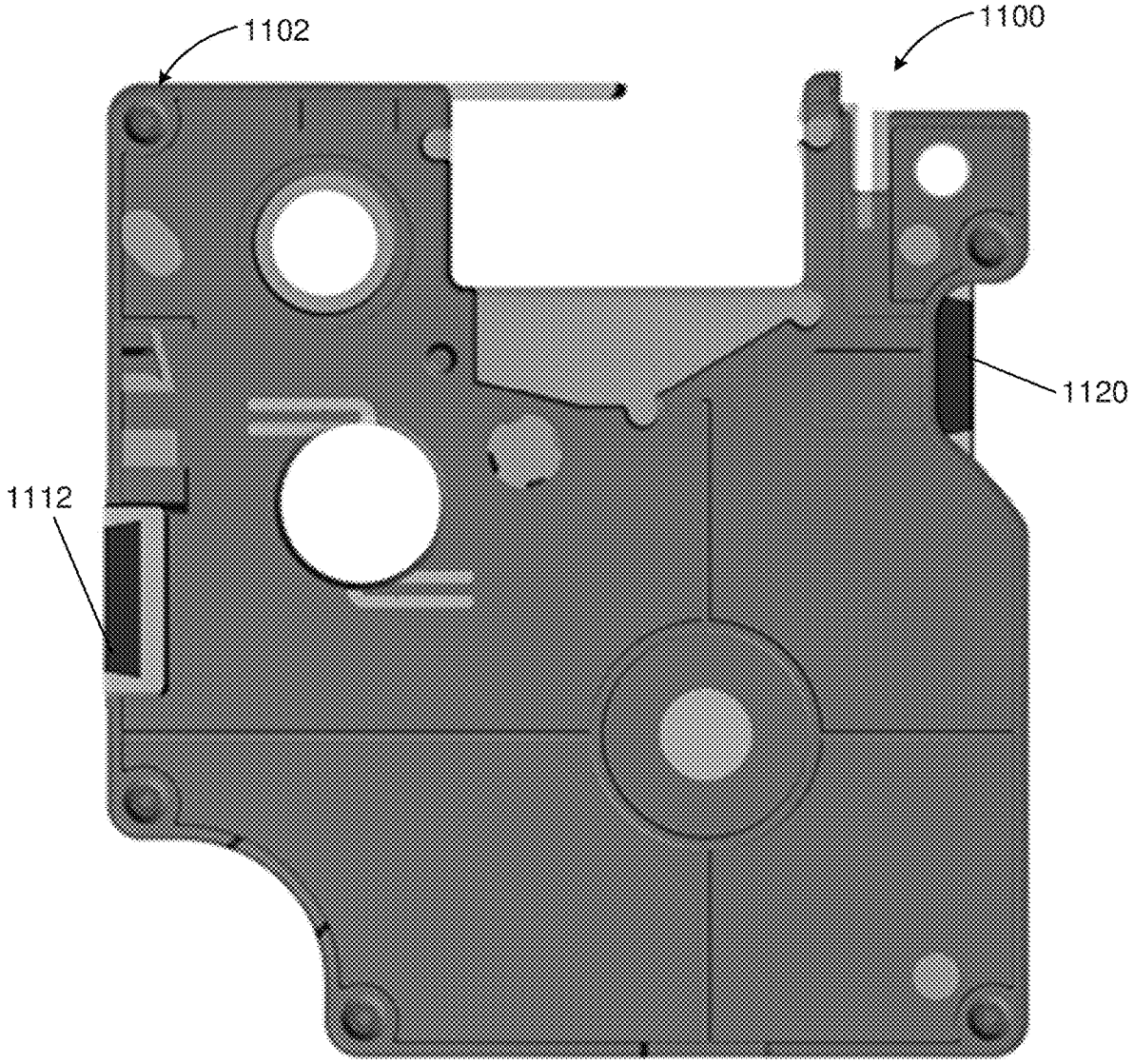
FIG. 36B is a top view of the cassette of FIG. 36A.
Figure 36C:
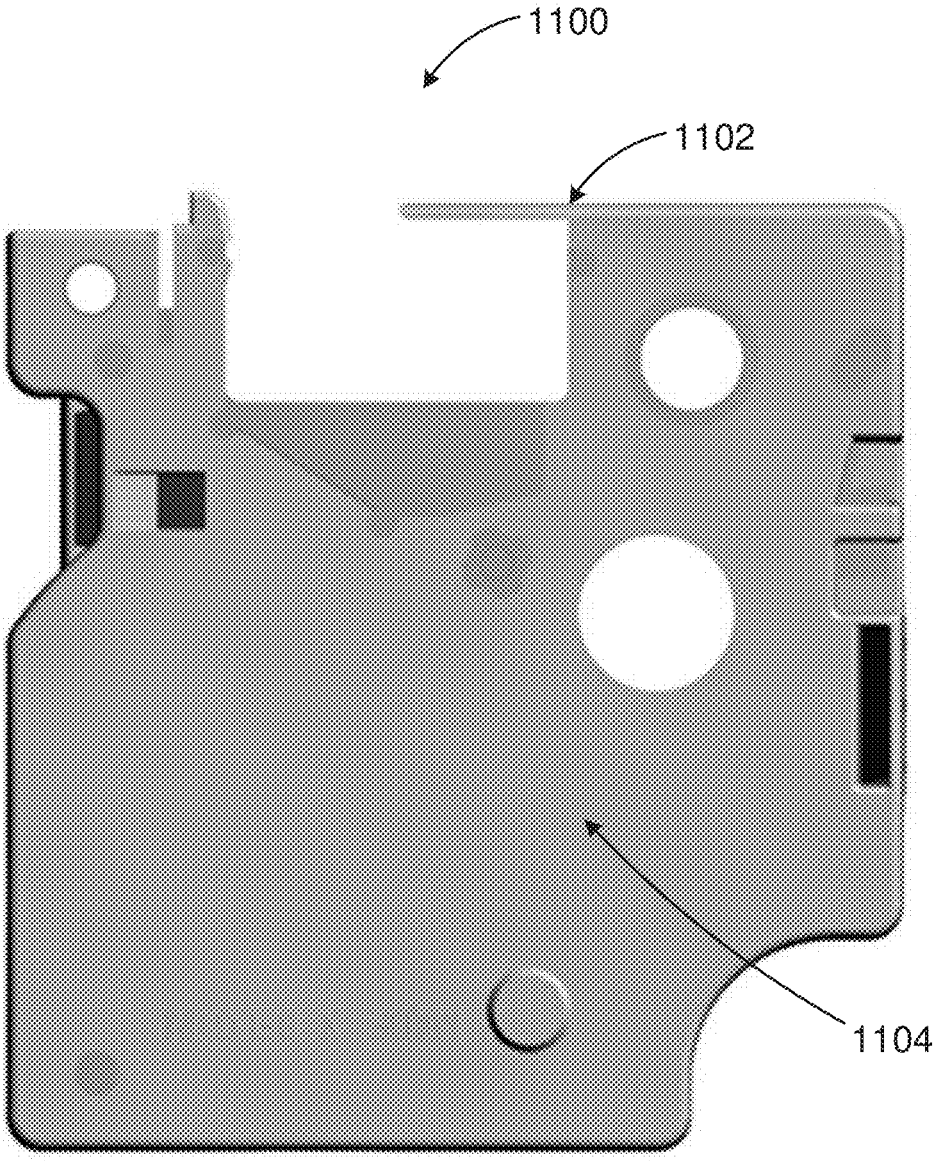
FIG. 36C is a bottom view of the cassette of FIG. 36A.
Figure 36D:
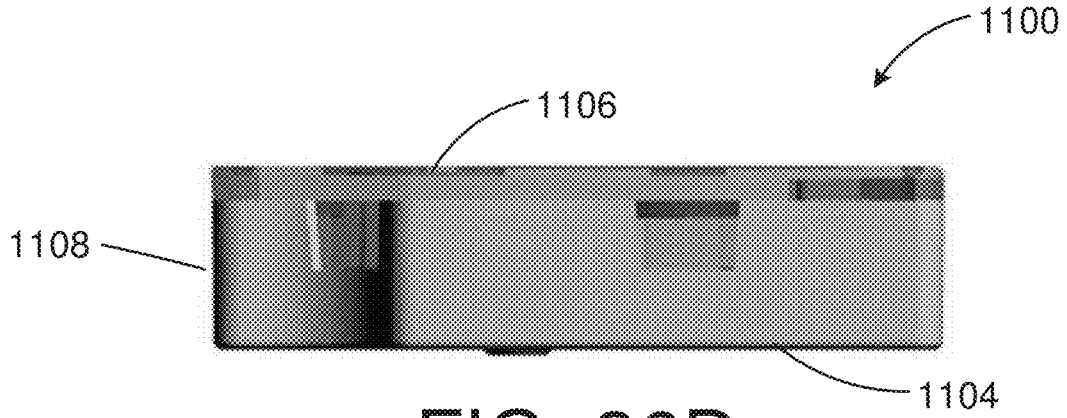
FIG. 36D is a front view of the cassette of FIG. 36A.
Figure 36E:
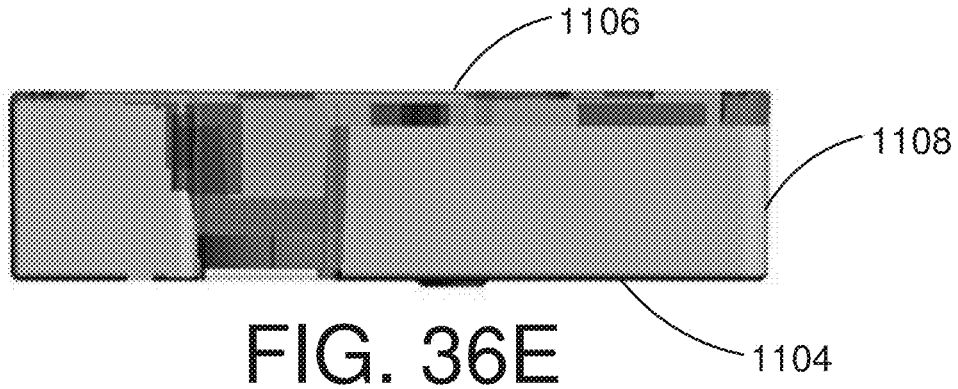
FIG. 36E is a rear view of the cassette of FIG. 36A.
Figure 36F:
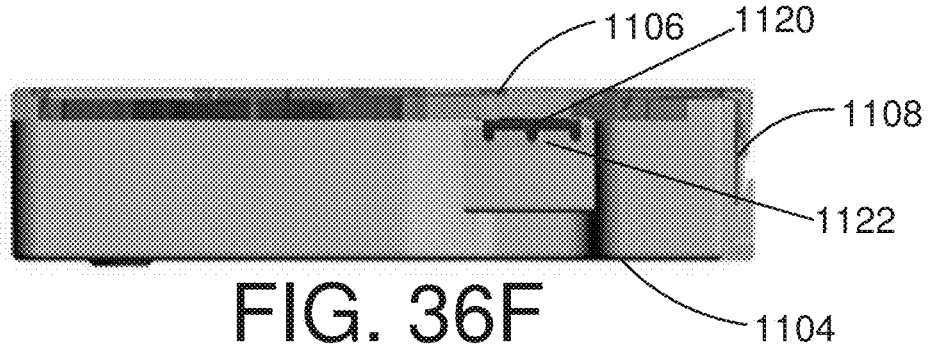
FIG. 36F is a right side view of the cassette of FIG. 36A.
Figure 36G:
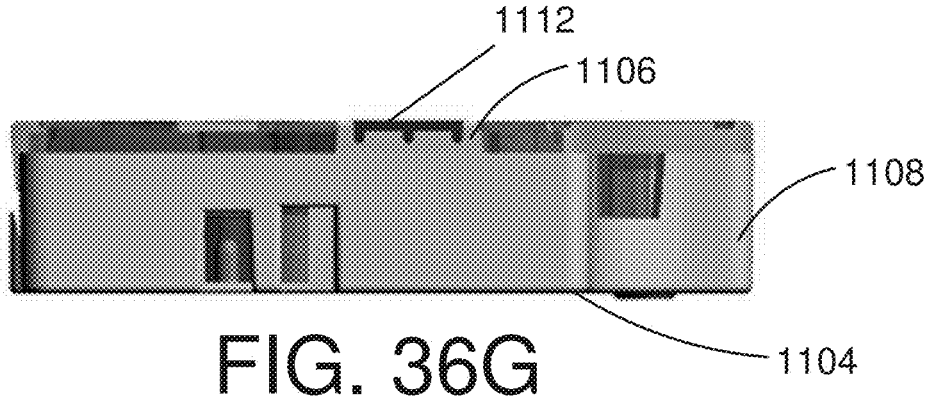
FIG. 36G is a left side view of the cassette of FIG. 36A.

Although in FIGS. 29, 31 and 32 the contact pads 704 of the locking elements 26', 32' are shown to cut into the second contact surfaces 617 *b*, 619 *b* of the contact pads 617, 619, the skilled person would understand that the contact pads 704 actually flex when brought into contact with the cassette 600. FIG. 35 provides a more accurate illustration of the actual interface between the locking elements 26', 32' and cassette 600.

In this embodiment, this biasing towards the respective resting positions of the contact pads 702, 704 is provided by the inherent resilience of the material from which the conductive members 703, 705 are formed. In other embodiments one or both of the contact pads 702, 704 may not be bent and one or both of the contact pads 702, 704 may at a portion between the ends of the conductive members 703, 705. In other embodiments, other means for biasing the contact pads 702, 704 away from the bodies 37' of the locking elements 26', 32' may instead be provided. For example, the contact pads 702, 704 may be the ends of respective pins, which pins are mounted on respective bases attached to the locking elements 26', 32'. The biasing may then be provided by springs, such as coil springs, between the contact pads 702, 704 and the bases. Other alternative methods for biasing contact pads 702, 704 away from the bodies 37' of the locking elements 26', 32' will be obvious to the skilled person.

The cassette detection circuitry 710 may work as described above for the cassette detection circuitry 310. For example, if a voltage is applied to the first contact pad 702 of one of the locking elements 26', 32', then a current will flow between the first and second contact pads 702, 704 of that locking element via one of the respective conductive contact pads 617, 619 of the cassette 600. Accordingly, the cassette detection circuitry 710 can determine whether the first and second locking elements 26', 32' are properly engaged with the cassette 600 by detecting the flow of current.

The discussion above relating to FIGS. 21(*i*) and 21(*ii*) is also applicable to this further embodiment of FIGS. 27 to 35, with contact pads 702, 704 taking the place of contact pads 302, 304, cassette 600 taking the place of cassette 400, and cassette detection circuitry 710 taking the place of cassette detection circuitry 310. Thus, the cassette detection circuitry 710 can detect whether the locking elements 26', 32' are engaged with the cassette 600 (and thus determine whether the cassette 600 is correctly inserted) and enable printing to commence, or whether one or both of the locking elements 26', 32' is not engaged properly with the cassette 600. In the latter case, printing may be prevented, and in some embodiments, the controller may inform a user via a display means (which may be a liquid crystal display) that the cassette 600 is not properly inserted.

The cassette detection circuitry 710 may be operable to determine which of the locking elements 26', 32' is not properly engaged with the cassette 600. Accordingly, the controller may inform the user via the display means as to which locking element/s are not engaged with the cassette 600, and may further inform the user as to what action is required in order to correctly insert the cassette. For example, the control may display a diagram similar to FIG. 21(H) on the display means, to indicate which side of the cassette 600 must be pressed in order for the cassette 600 to be inserted properly.

In a further alternative embodiment, only one of the locking elements 26, 32 shown in FIGS. 27 to 33 may be provided with contact pads 702, 704 for detecting engagement of that particular locking element with the cassette 600. In this case, the user may be informed of whether or not the locking element provided with the contact pads 702, 704 is properly engaged with the cassette 600. The one locking element provided with contact pads 702, 704 may be positioned adjacent the printhead 16', such that it is detected whether the cassette 600 is positioned correctly adjacent the position where the image is formed on the tape.

In another further embodiment, the label printer 2 is provided with only a single locking element for retaining a cassette 600 in the cassette-receiving bay 8. In this case, the single locking element could be provided with contact pads 702, 704 for detecting the insertion of a cassette 600 as described above with reference to FIGS. 27 to 35. The single locking element may be positioned adjacent the printhead 16'.

In yet another further embodiment, the printer includes a first locking element 26' that is provided with only a single one of the two contact pads 702, 704, which is connected to cassette detection circuitry by means of a respective one of the first and second conduction connections 706, 708. Similarly, the printer includes a second locking element 32' that is provided with only a single one of the two contact pads 702, 704, which is similarly connected to the cassette detection circuitry by means of another respective one of the first and second conduction connections 706, 708.

A cassette for use in such a printer could take the same general format as that best illustrated in FIG. 33, with the exception that the contact pad 617 is connected to contact pad 619 by a continuous conductive connection following a path between the pads 617, 619. Such a continuous conductive connection could take any format and could be a form of conductive strip, tape or paint on a surface of the cassette, or a thicker conductive member, which follows a path between the conductive contact pads 617, 619. The continuous conductive connection may be arranged in the interior of the cassette, such as along a surface inside the cassette or as a component in the cassette. The continuous conductive connection could be similar to the metal track 420 discussed above. The continuous conductive connection may be integrally formed with one or both of the contact pads 617, 619, or be a separately manufactured component. When the cassette is correctly inserted in the cassette-receiving bay, the contact pad of the first locking element 26' would be in contact with the contact pad 619, and the contact pad of the second locking element 32' would be in contact with the contact pad 617. The cassette detection circuitry can therefore detect that the cassette has been properly engaged by both the first and second locking elements 26', 32' by, for example, by measuring the resistance, voltage or current, or by substituting the measured values with an analogue or digital measurement, flowing between the contact pads of the first and second locking elements 26', 32', via the continuous conductive connection of the cassette.

In alternative embodiments, the cassette detection means 310, 710 may be operable to determine characteristics relating to a cassette inserted into the cassette-receiving bay in addition to whether the locking elements are properly engaged with the cassette. For example, by providing each different type of cassette with conductive contact pads having different electrical resistances, it would be possible for the controller to distinguish between the cassettes in dependence on the magnitude of the current/resistance detected by the cassette detection circuitry. In the case of cassettes provided with the conductive connection in the form of a metal track 420, this could be achieved by providing different types of cassette with different widths of metal track 420, in order to change the resistance.

It will be appreciated by those skilled in the art that the teachings of the present disclosure may equally be applied to a printer having a fixed printhead and a movable platen. It will also be appreciated by the person skilled in the art, that the teachings of the present disclosure may be applied equally to a label printer in which the image receiving medium is a continuous tape and to one in which the image receiving medium is a plurality of die-cut labels arranged on a continuous backing layer.

Figure 26:
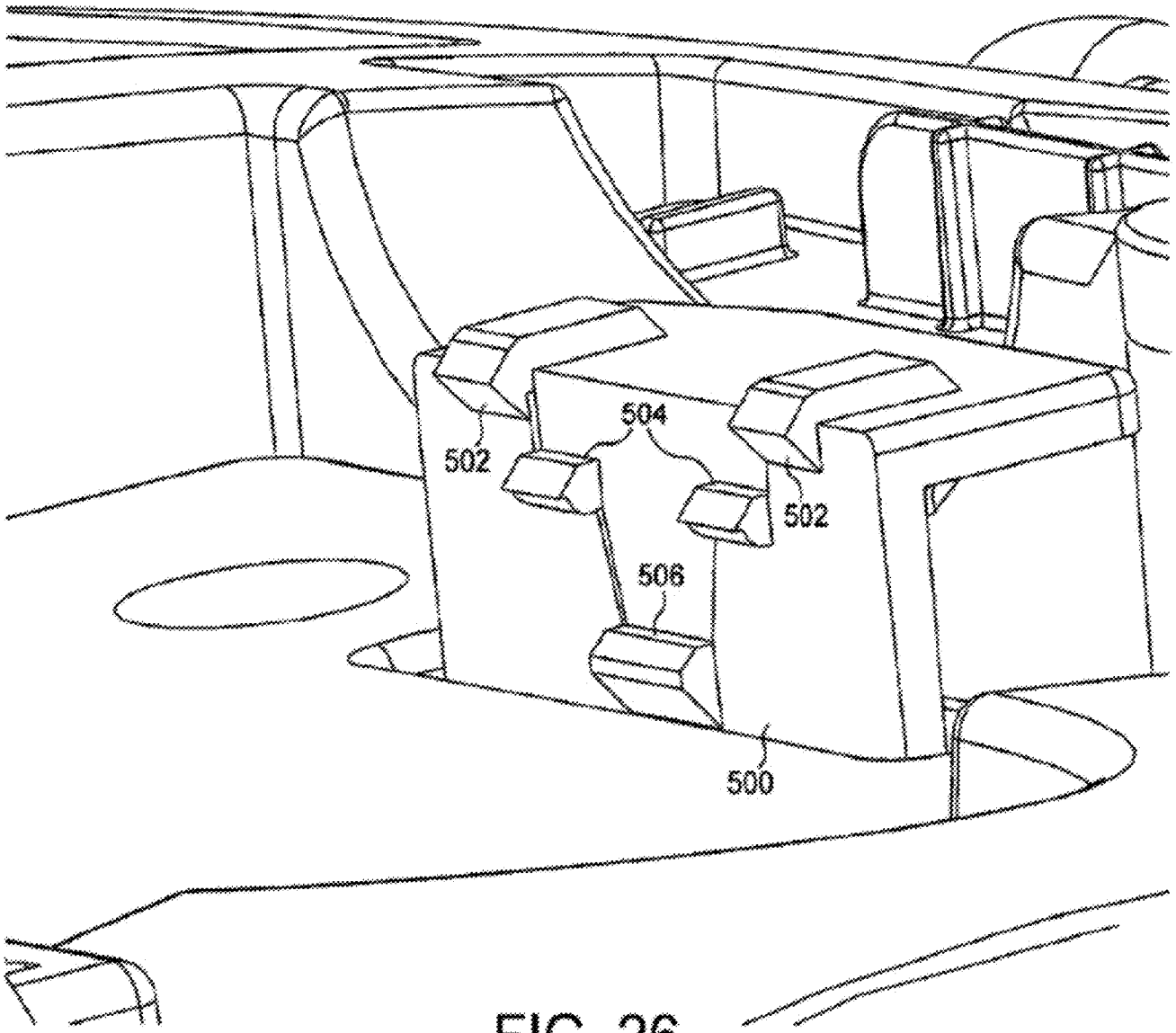
FIG. 26 shows an arrangement where a locking arrangement is provided on a printhead support.

In yet one alternative embodiment, at least one locking element is provided on the printhead support part 500 as shown in FIG. 26. A first pair of locking elements 502 is arranged at a first height with a second pair of locking elements 504 is arranged at a second height and a third locking element 506 at a third height. The first height is greater than the second height, which is greater than the third height. One or more of these locking elements may be provided. Each of the locking elements 502, 504 and 506 are positioned such that cassettes of different width are locked in the correct position.

In yet another alternative embodiment, the locking element is arranged to engage a rib or similar projection on the cassette. This may be provided on a sidewall of the cassette or any other suitable surface. A similar electrical contact arrangement can be used with such an embodiment.

Figure 37A:
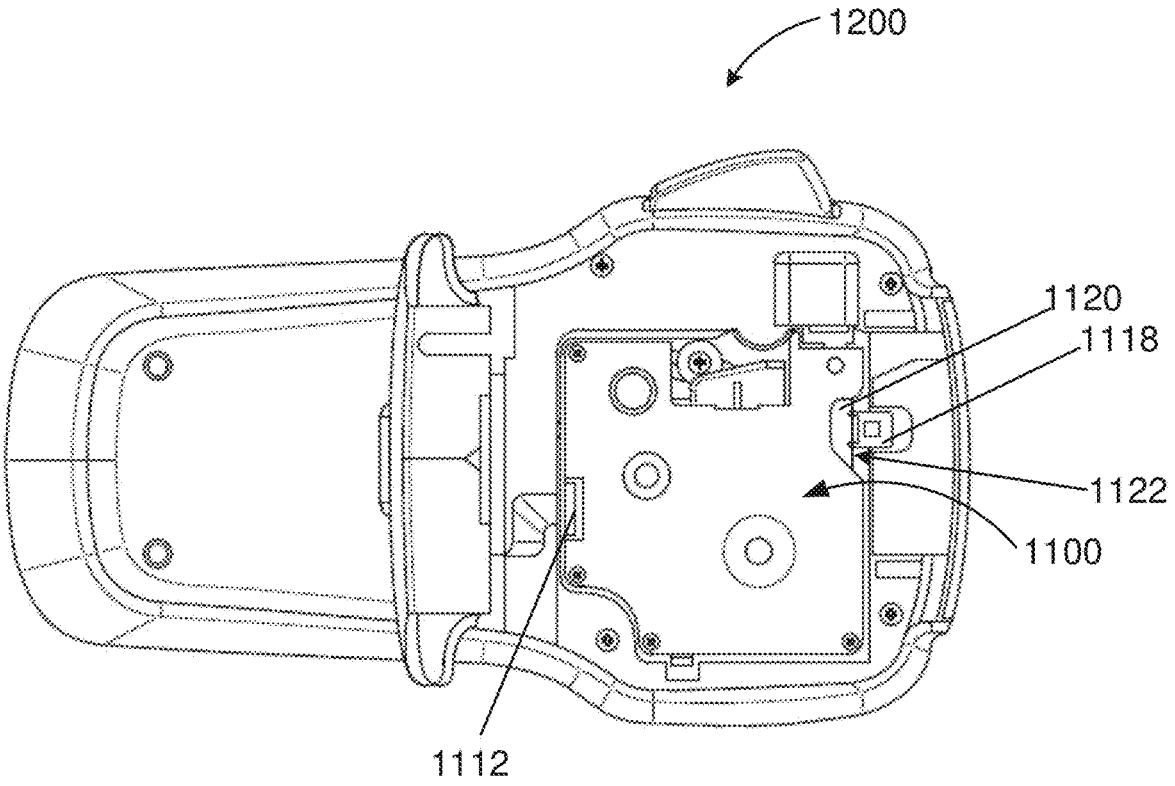
FIG. 37A is a view of one embodiment of a label printer with an open cassette compartment and a cassette.
Figure 37B:
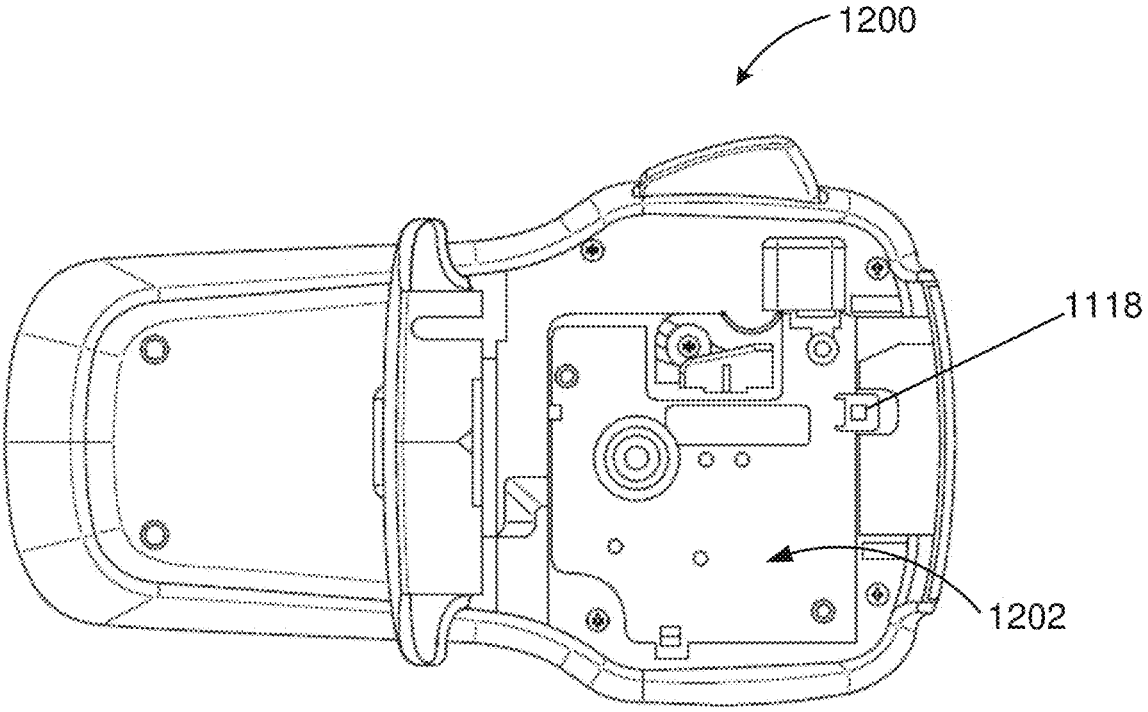
FIG. 37B is a view of the label printer of FIG. 37A with an open cassette compartment.
Figure 38A:
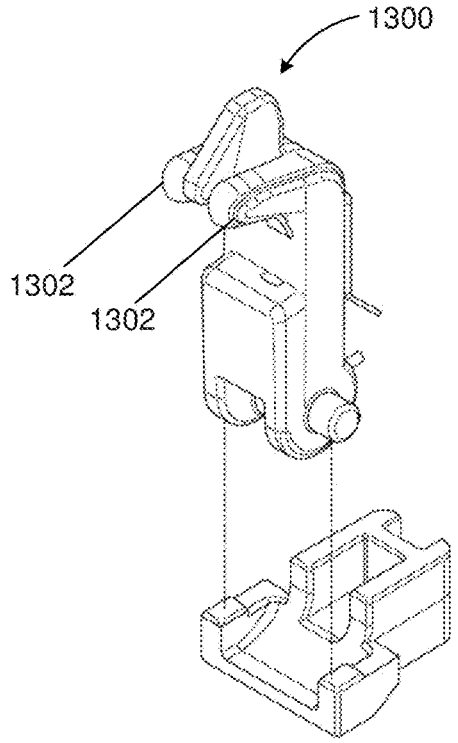
FIG. 38A is an exploded perspective view of one embodiment of a locking element of a label printer.
Figure 38B:
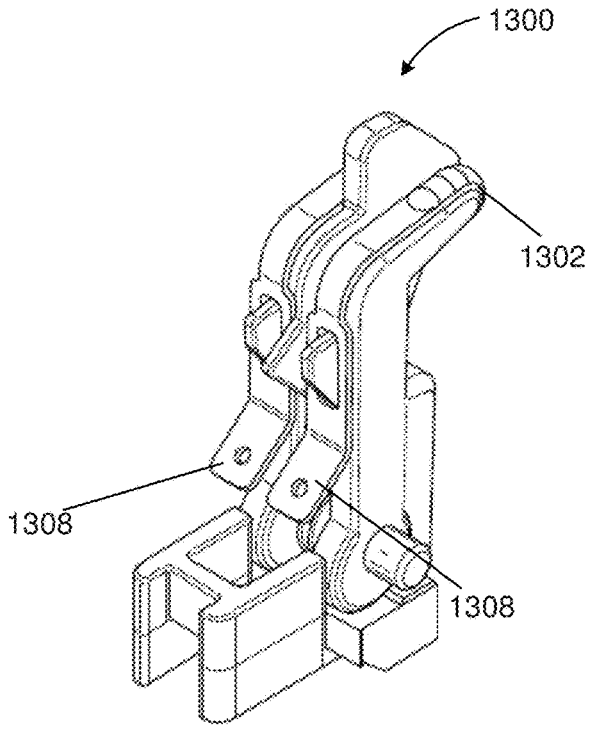
FIG. 38B is a perspective view of the locking element of FIG. 38A.
Figure 38C:
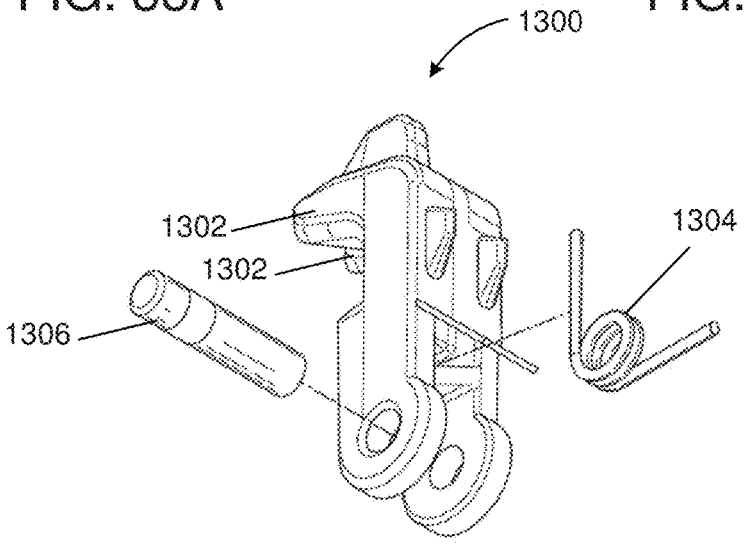
FIG. 38C is a bottom perspective exploded view of the locking element of FIG. 38A within a locking element assembly.
Figure 39:
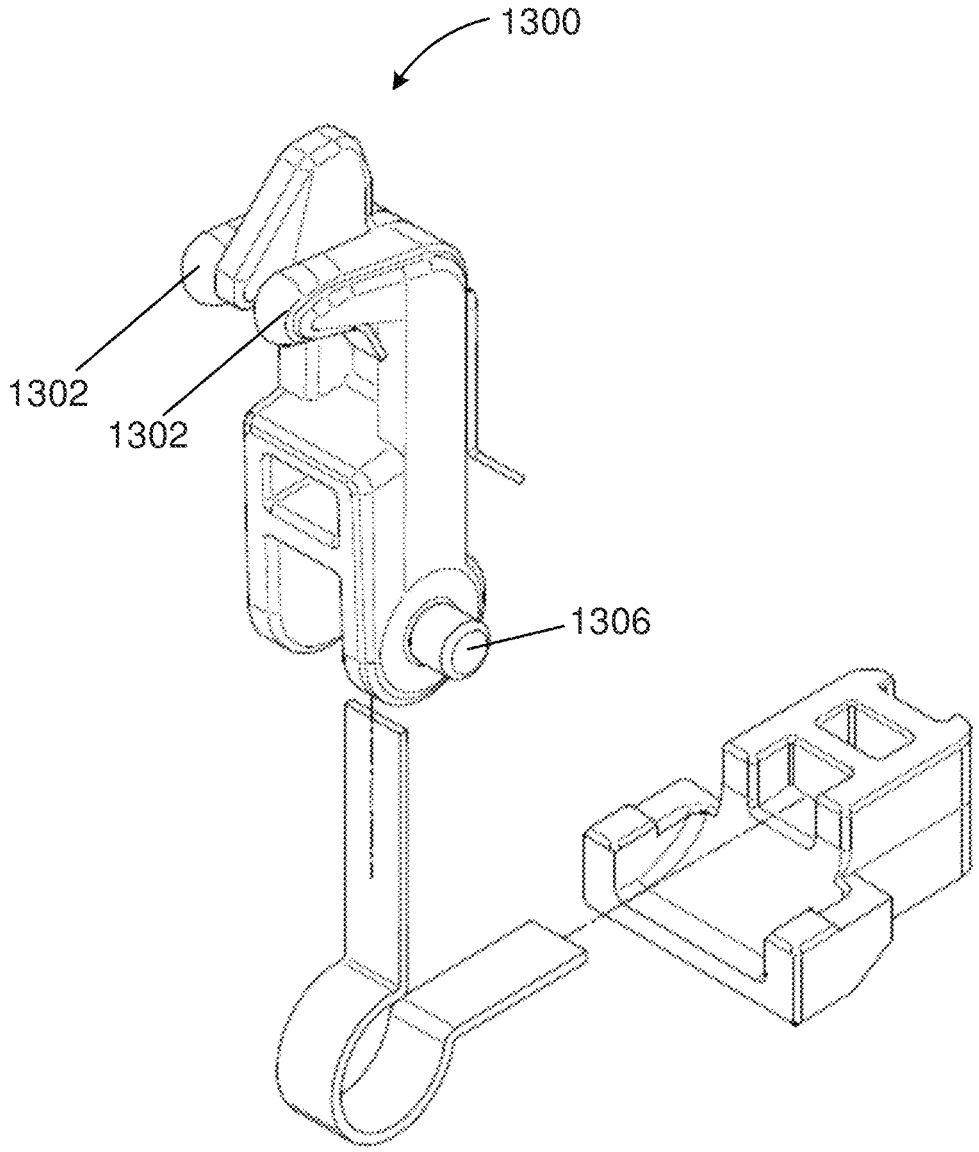
FIG. 39 is a perspective front view of one embodiment of a locking element assembly.

In some embodiments, as shown in FIGS. 36A-36G and 42-44, a cassette 1100 includes a plurality of surfaces 1102. For example, the plurality of surfaces 1102 may include a base surface 1104, a top surface 1106, and at least one side surface 1108 that together form an external surface of the cassette 1100. In some instances, the at least one side surface 1108 may extend between the base surface 1104 and the top surface 1106. The base surface 1104 and the top surface 1106 may be in substantially parallel planes, and the at least one side surface 1108 may be substantially perpendicular to the base surface 1104 and the top surface 1106. In other instances, the at least one side surface 1108 may be angled between the base surface 1104 and the top surface 1106. In some embodiments, at shown in FIG. 36A, the plurality of surfaces 1102 define an internal volume (i.e., the internal volume of the cassette) for dispensably receiving a supply of label material (e.g., a roll, cartridge, or other supply of label material), such as those that are described herein. Each of these surfaces may have a shape and dimension to complement the shape of a cassette compartment 1202 of a label printer 1200 (e.g., as shown in FIG. 37B).

The plurality of surfaces forming the cassette may be formed of any suitable material. In some instances, the plurality of surfaces may be composed of general-purpose polystyrene. In other instances, the plurality of surfaces may be composed of high impact polystyrene, acrylonitrile butadiene styrene, polyethylene terephthalate, high-density polyethylene, polyvinyl chloride, low-density polyethylene, polyoxymethylene, polypropylene, polystyrene, acrylic, polycarbonate, polyactic fibers, nylon, and/or fiberglass. Any number of components contained within the cassette and label printer may be composed of the materials described herein.

In some embodiments, the cassette 1100 includes a conductive area 1112 disposed on at least one surface of the plurality of surfaces 1102. The conductive area 1112 may be configured to engage a corresponding conductive area of the label printer 1200. In some instances, the label printer 1200 provides a current to the corresponding conductive area, such as described throughout this disclosure. That is, the label printer 1200 may include a power source and at least one circuit assembly connected to the corresponding conductive area. The conductive area(s) 1112, 1120 of the cassette 1100 may align with the corresponding conductive area of the label printer 1200 (e.g., as shown in FIG. 37A).

Once engaged, the conductive area(s) of the cassette 1100 may complete a circuit within the label printer 1200 and provide a resistance in current to the label printer 1200. For example, the label printer 1200 may detect a resistance between 0 and 2500 ohms in the completed circuit. In certain embodiments, the label printer 1200 may be pre-set at a baseline voltage and when the conductive area(s) of the cassette 1100 engages the corresponding conductive area of the label printer, the label printer 1200 may detect a resistance in the completed circuit. For example, the label printer 1200 may include a multimeter, ohmmeter, or other suitable instrument configured to detect a resistance set along the circuit.

In some instances, when the cassette 1100 is not in place within the label printer 1200 or is not properly loaded in the cassette compartment 1202, the label printer 1200 may read a resistance of greater than 2500 ohms. In other instances, when the cassette is not properly loaded within the cassette compartment 1202 of the label printer 1200, the multimeter or other similar device may detect a resistance or lack thereof within pre-set detection parameters. For example, if there is no cassette placed within the label printer 1200, the multimeter may not provide a reading to the label printer or may provide a reading above 2500 ohms. In this manner, the label printer will not function as loading of a corresponding cassette and/or cassette proper placement has not yet occurred. As discussed herein, the label printer may detect the cassette 1100 by continuously supplying a current to the corresponding conductive area of the label printer 1200. Once the cassette 1100 is set within the label printer 1200, the cassette 1100 may complete a circuit within the label printer and a multimeter or other device may detect a resistance within the pre-set detection parameters. In this case, the label printer will provide its full functionality.

In some embodiments, as shown in FIGS. 36A-36G, the conductive area 1112 forms a flat surface that is a portion of the top surface 1106 of the cassette 1100 and extends onto a portion of the sidewall 1108. That is, the conductive area 1112 defines or is formed on an edge of the surfaces 1102, such that it extends onto two of the walls. In some embodiments, in addition to or instead of conductive area 1112, the cassette includes a conductive area 1120 that is formed on the edge of the upper and side surfaces of a ledge, step, notch, or similar structure of the cartridge. For example, as shown in FIGS. 36A-36G, a cassette 1100 may include conductive area 1112 that extends from the top surface 1106 to a side surface 1108 of the cassette, as well as a conductive area 1120 that extends from the upper surface of an inset ledge on the opposed sidewall 1108 (relative to the sidewall in which conductive area 1112 is disposed) to a sidewall surface formed at the ledge.

In other embodiments, the conductive area is in the form of a bar, for example as described above with reference to FIG. 33. For example, the conductive area may be a rectangular bar, cylinder, or another shaped elongated bar, any of which may form a flat surface with the relevant surface of the plurality of surfaces. For example, the conductive area may be a cylindrical bar disposed on or associated with one of the plurality of surfaces and configured to engage a corresponding conductive surface of the label printer. In some embodiments, the cylindrical bar is configured with respect to the surfaces of the cassette such that the exposed portion of the bar forms a flush surface with the respective surfaces of the cassette.

Figure 42A:
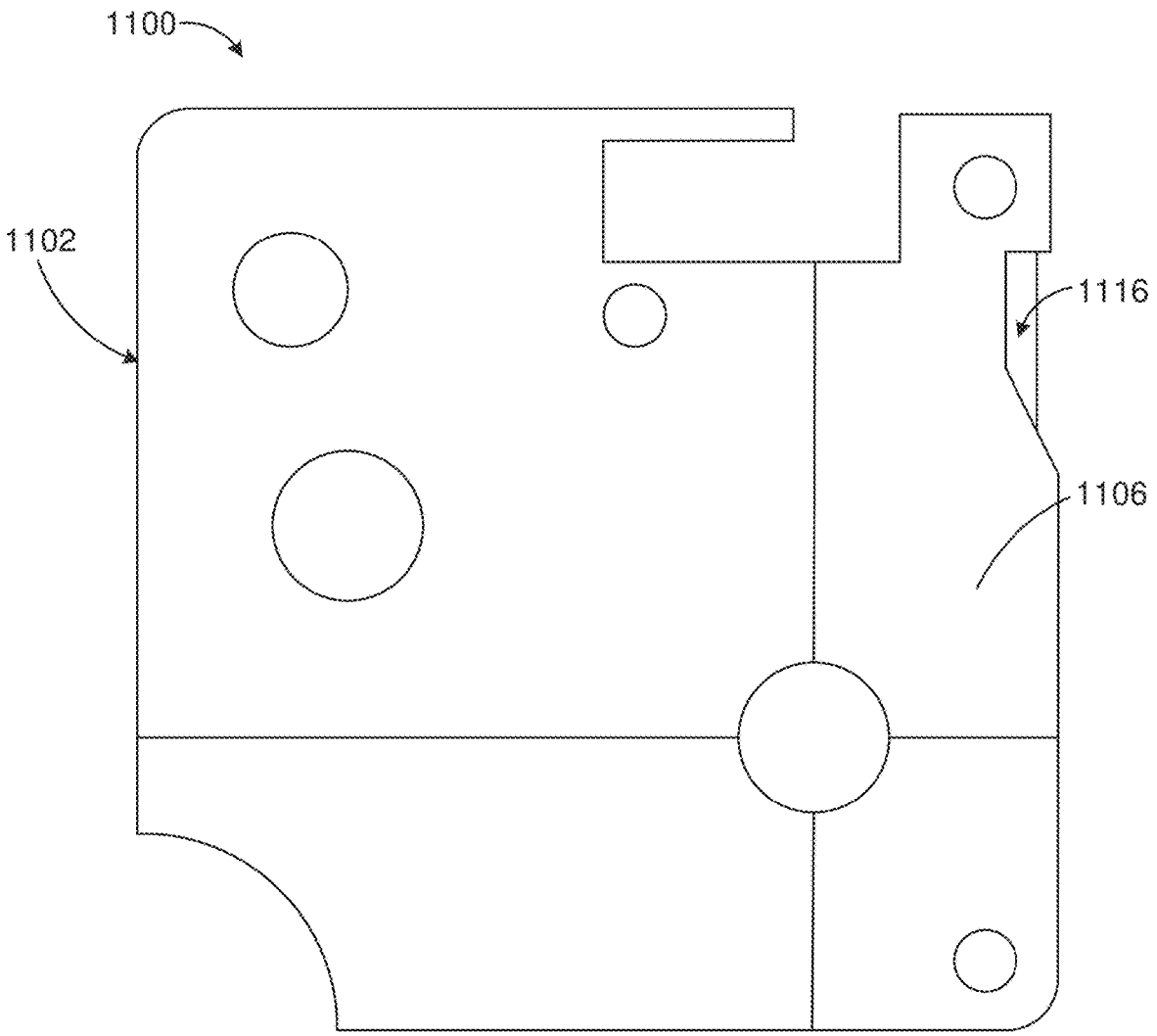
FIG. 42A is a top view of one embodiment of a cassette.
Figure 42B:
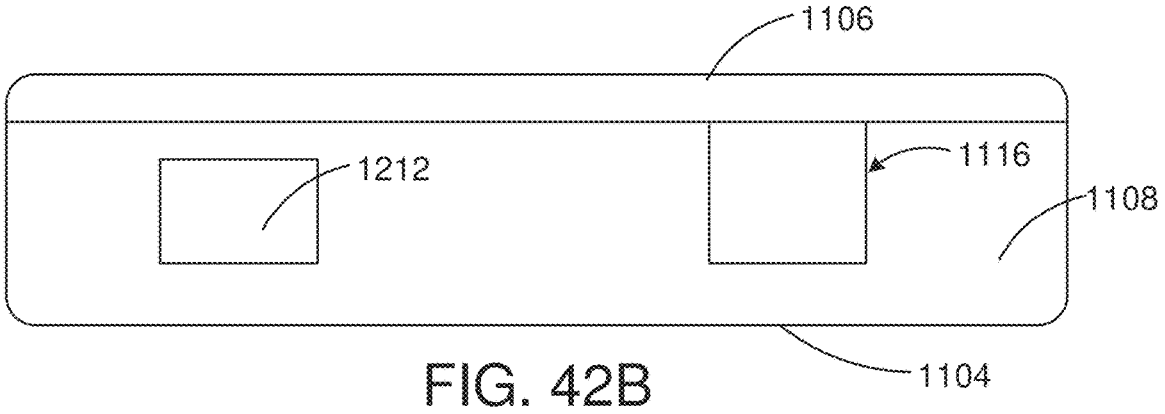
FIG. 42B is a side view of the cassette of FIG. 42A.

In other embodiments, as shown in FIG. 42A-B, the conductive area 1212 is a first flat conductive area disposed on the at least one side surface 1108. In some instances the first flat conductive area disposed on the at least one side surface 1108 is substantially perpendicular to the base surface 1104 and the top surface 1106. For example, the conductive area 1212 may form a plane extending along one surface of the plurality of surfaces 1102.

Figure 43A:
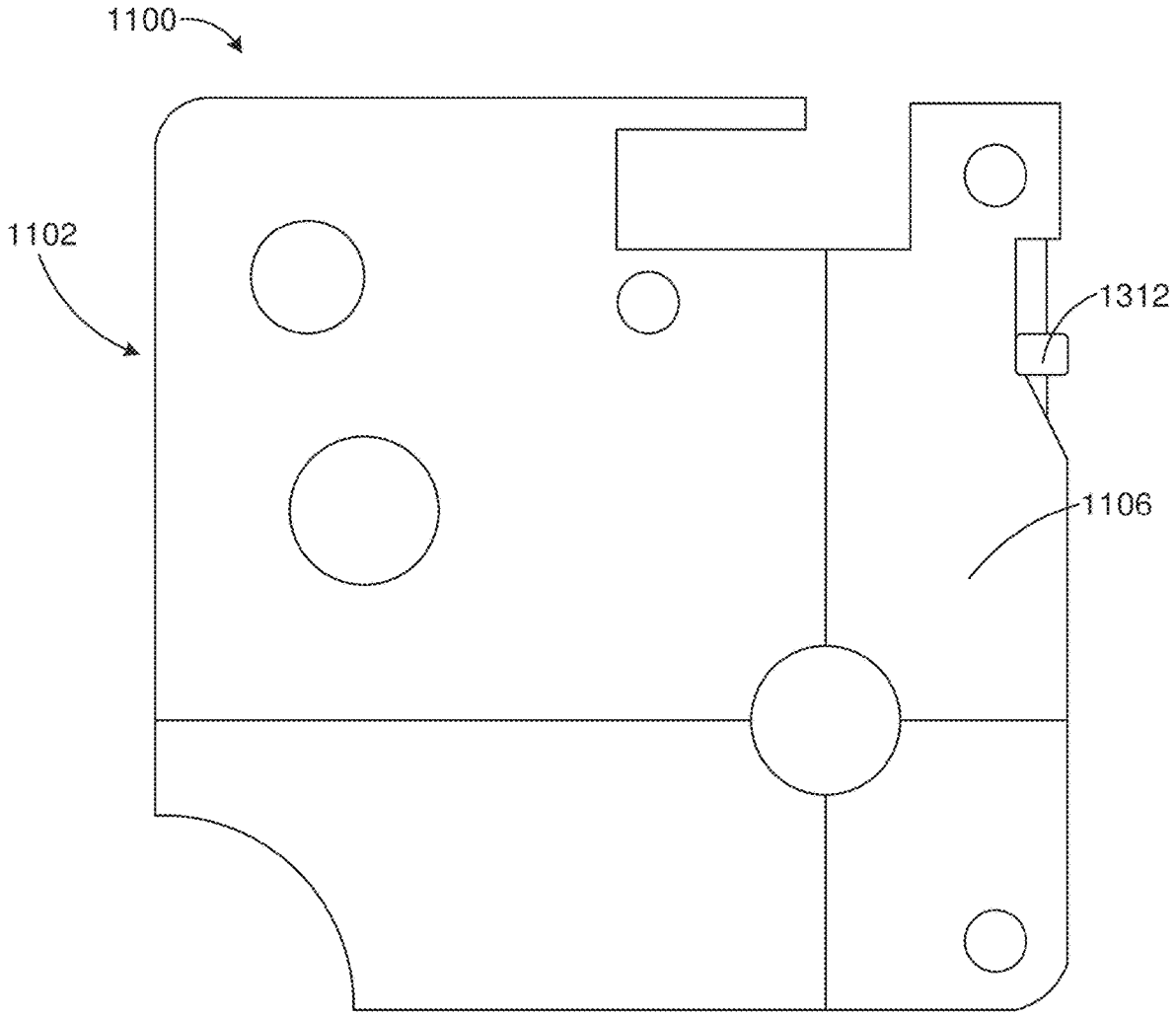
FIG. 43A is a top view of one embodiment of a cassette.
Figure 43B:
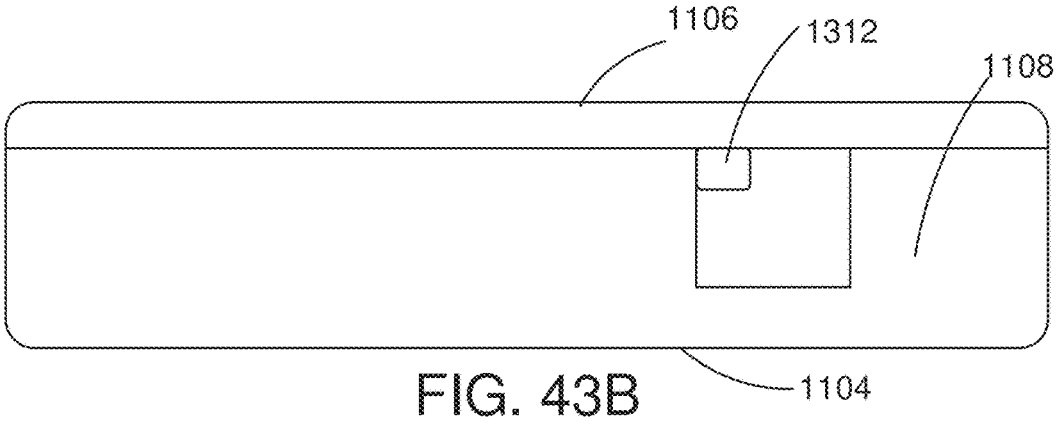
FIG. 43B is a side view of the cassette of FIG. 43A.

In yet another embodiment, as shown in FIG. 43A-B, the conductive area 1312 is in the form of a conductive bar protruding from one of the plurality of surfaces 1102.

Each of the conductive areas 1112, 1120, 1212, 1312 may have a corresponding conductive area associated with the label printer to provide a signal of engagement with the cassette to the label printer 1200.

In some instances, the conductive areas 1112, 1120, 1212, 1312 described herein may be a conductive tape strip, a conductive paint path, or some other conductive member configured to transfer a current. The conductive areas 1112, 1120, 1212, 1312, may be composed of hot stamp foil. For example, a hot stamp foil may be composed of gold or silver. For example, the conductive area may be a highly conductive thermoplastic elastomer. In other instances, the conductive areas 1112, 1120, 1212, 1312 described herein may be composed of a copper (e.g., beryllium copper) or another metal alloy.

In some instances, as described herein, the conductive areas 1112, 1120, 1212, 1312 may also be configured to be or may otherwise be associated with the locking portion of the cassette. That is, in some embodiments, the conductive area may receive the locking element from the label printer 1200 to secure the cassette. In other instances, the conductive area may be separate from the locking portion. In some embodiments, as shown in FIGS. 42A-B, the locking portion 1116 includes a ledge configured to engage the locking element 1118 (as shown in FIGS. 37A-B) of the label printer. In some embodiments, the conductive area 1212 of the cassette 1100 is disposed on the same sidewall surface 1108 as the locking portion 1116, but is separate therefrom, as shown in FIG. 42B. Thus, the conductive area 1212 may engage with the label printer 1200 separately from the locking portion 1116.

Figure 44:
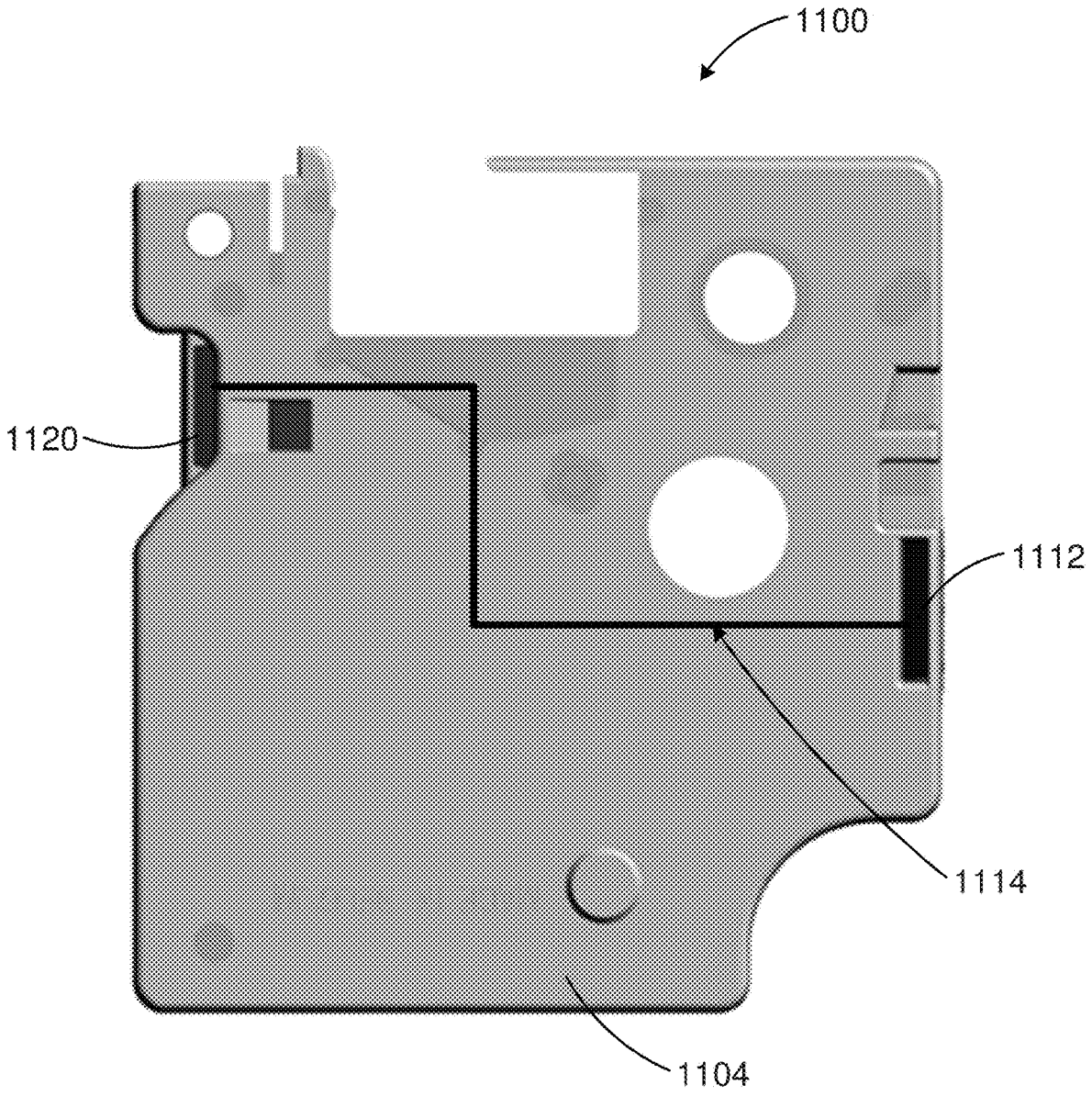
FIG. 44 is a bottom view of one embodiment of a cassette.

In some embodiments, as shown in FIG. 44, the cassette 1100 includes a conductive connection 1114. In some instances, the conductive connection 1114 may be configured to complete an electric circuit. For example, the cassette 1100 may include multiple conductive areas 1112, 1120 and the conductive connection 1114 may link the two conductive areas together. In some instances, the conductive connection 1114 may be a conductive tape strip, a conductive paint path, or some other conductive member configured to transfer a current. The current, as previously mentioned, may be configured to provide resistance to the label printer. The resistance of the conductive areas 1112, 1120, 1212, 1312 and conductive connection 1114 may be an indication sent to the label printer processor. For example, as discussed herein, the indication may be at least one parameter ranging between 0-2500 ohms.

In some instances, the conductive connection 1114 may be disposed within the volume formed by the plurality of surfaces 1102 (i.e., internal to the housing of the cassette). For example, the conductive connection 1114 may be disposed substantially along the internal surfaces of the plurality of surfaces 1102. In some instances, the conductive connection 1114 may be embedded within the material of the plurality of surfaces 1102. In other instances, the conductive connection 1114 may be disposed on the exterior of the cassette, opposite the interior volume, formed by the plurality of surfaces 1102. The exterior surface may be one of the plurality of surfaces 1102 and/or a conductive area on one of the plurality of surfaces. For example, the conductive connection 1114 may be disposed on the exterior of the base surface 1104. In some instances, the conductive connection 1114 may be disposed on the top surface, the at least one side surface, or some combination thereof.

In some embodiments, as shown in FIG. 36A-G, the cassette 1100 includes an outlet 1110 on one or more of the plurality of surfaces. The outlet 1110 may be configured to provide an opening for dispense of the supply of label material from the cassette. For example, the cassette 1110 may form a volume by the plurality of surfaces 1102, in which the supply of label material is contained. The outlet 1110 disposed on one of the plurality of surfaces 1102 may be one method of dispensing the label material from within the volume of the cassette 1110. In some instances, the outlet 1110 may be disposed on an indented surface formed by the plurality of surfaces 1102. For example, the outlet 1110 may be surrounded by one or more side surfaces 1108 formed by the plurality of surfaces 1102 of the cassette. The one or more side surfaces 1108 may form a receded enclosure on one side of the cassette configured to wrap around a receiving element contained within the cassette compartment 1202 of the label printer. That is, once the cassette 1100 properly engages the receiving element, the receiving element is configured to receive and feed the supply of label material.

In some embodiments, as shown in FIGS. 36 and 37A, the cassette 1100 may include at least one locking portion 1122 configured to receive at least one corresponding locking element of a label printer. For example, the locking portion 1122 may be a ledge, an aperture, or another suitable element configured to securely receive the locking element of the label printer. In some instances, the locking portion may include a conductive area 1120 configured to correspond to the conductive area of the label printer. That is, the conductive areas may form a completed circuit, and the completed circuit may provide an indicator to the label printer processor indicating an engaged cassette, as discussed herein.

Figure 40:
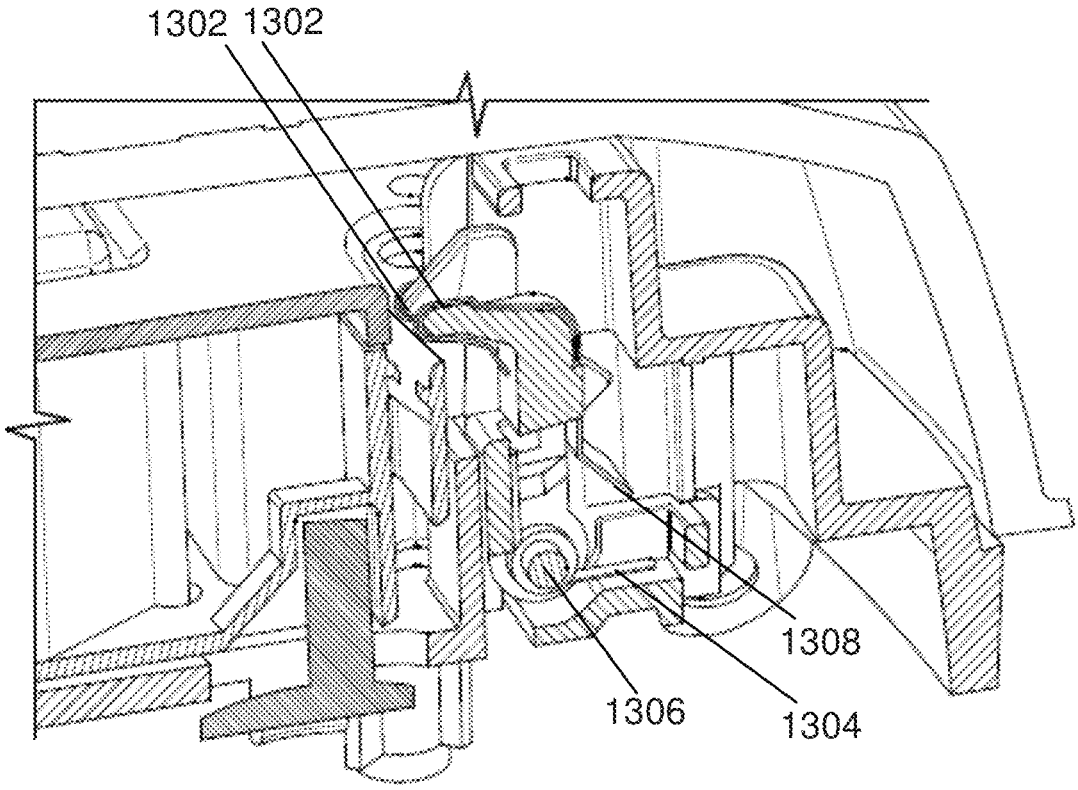
FIG. 40 is a cross-sectional view of one embodiment of a locking element within a label printer.
Figure 41:
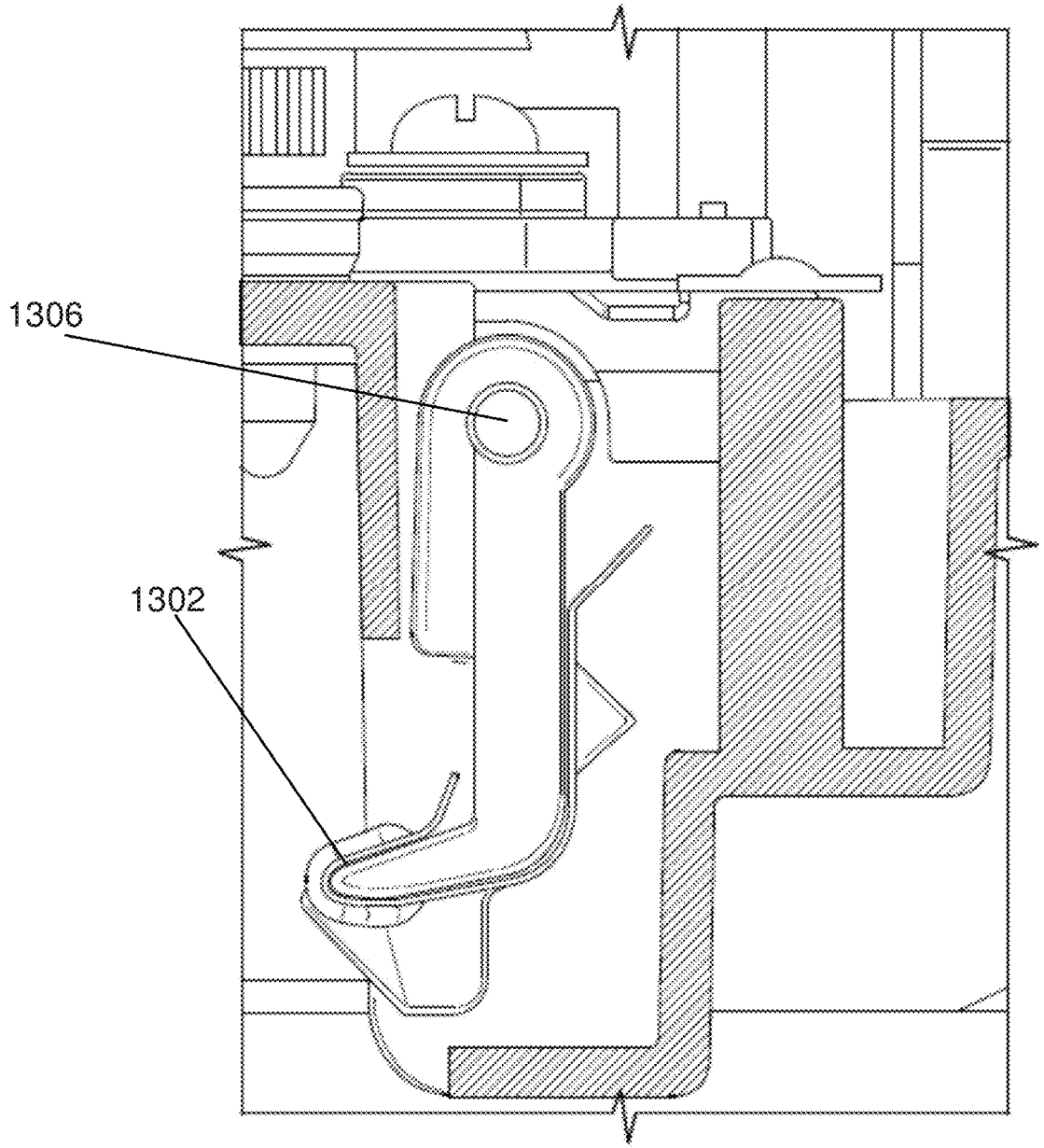
FIG. 41 is a cross-sectional view of one embodiment of a locking element within a label printer.

In some instances, locking element 1300 of the label printer may include at least two conductive contacts 1302 disposed on a distal end of the locking element (as shown in FIGS. 38A-41). That is, the distal end may be configured to engage at least one of the conductive areas disposed on one of the plurality of surfaces of the cassette. For example, as shown in FIGS. 38B and 40, the conductive contacts 1302 may extend to, or be otherwise electrically connected to, connection point 1308, which may be soldered or otherwise electrically connected within to the circuit of the printer. For example, the connection point 1308 may be soldered to electrically connect the conductive contacts 1302 to a printed circuit board or other electric circuit component within the print.

In some instances, the conductive contacts may be composed of copper, nickel, and/or gold plated materials.

In certain embodiments, as shown in FIGS. 38A-41, the locking element 1300 may include a suitable spring or similar structure to bias the locking element 1300 toward a locking position, such that upon introduction of a cassette 1100 into the printer, the locking element 1300 may be transiently moved into a loading position and then return to the locking position once the cassette is in place within the cassette compartment 1202. For example, FIG. 38C illustrates how shaft 1306 is positioned through the coil of torsion spring 1304, with the non-knurled side being inserted first through the apertures of the locking element base. The knurled side of the shaft 1306 may provide a press-fit coupling between the shaft and the base.

In some embodiments, a cassette assembly is provided that includes an adapter configured to be associated with a cassette having a supply of label material to together form a cassette assembly to be operably loaded into a label printer as described herein. For example, the adapter may complement the shape of the cassette compartment 1202 and include a similar conductive area as disclosed herein. In some instances, the cassette and the adapter may be configured to collectively be secured within a cavity of the label printer.

In some embodiments, the cassette assembly includes an adapter configured to be associated with a cassette housing a supply of label material, to together form a cassette assembly for operable loading in a label printer configured for cassette detection. For example, the adapter may be configured to supplement and/or complement the shape of the label printer cassette such that collectively the cassette and adapter are shaped and dimensioned to be received in a cassette compartment 1202 of a label printer. For example, the adapter may be in the form of a label, tag, sleeve, case or casing, covering, frame, enclosure, inset, wrap, or other suitable structure for mating with a cassette to form a cassette assembly configured for operable loading in a label printer. In certain embodiments, the adapter may have a housing with one or more surfaces 1102 similar to those described with respect to the housing for cassette 1100.

The adapter may include a conductive area in any form or design described herein and/or a locking portion in any form or design described herein. That is, the adapter may be configured to provide the necessary circuit completion and/or cassette securement functionality necessary for a particular cassette. For example, the adapter may provide a resistance within the pre-set detection range for a cassette with a complementary shape of the cassette compartment 1202 of the label printer.

In some embodiments, the adapter may have an adhesive configured to mount the adapter to a cassette and provide a conductive area. In other embodiments, the adapter may have another means, such as mechanical means, for securing the adapter to the cassette. In some embodiments, the adapter may be configured to snap fit, friction fit, or otherwise shape fit on the cassette. In some embodiments, the adapter may encapsulate a cassette. In this manner, the adapter complements the shape of the cassette compartment 1202 of the label printer and a cassette fits within the adapter. In some instances, the adapter may be a sleeve configured to slidably cover at least a portion of the cassette. In some instances, the adapter may cover a portion or all of the cassette. In each of the embodiments described herein, the adapter may have a locking portion together or separate from a conductive area configured to align with the complementary conductive area and locking element of a label printer. In some instances, the adapter may include a plurality of surfaces and within the plurality of surfaces is a volume. The volume may be configured to accept a cassette filled with a label material. That is, the adapter with complementary cassette may be configured to complete the conductive connection of the label printer and supply label material to the label printer through an outlet on the adapter.

In some instances, the adapter may include a first conductive area disposed on a surface of the adapter. The conductive area may be flat, as described above with reference to conductive areas on the surface of the cassette. In some instances, the locking portion may be non-conductive, such as disposed adjacent to the conductive area. In this manner, the cassette that is configured to be associated with the adapter may not include a conductive area as described herein. In other instances, the cassette and the adapter may both have a conductive area. In some instances, the adapter may include a locking portion configured to receive a locking element of a label printer. In other instances, the adapter may be configured to load within the label printer without locking onto the locking element.

While the disclosure has been described with reference to a number of embodiments, it will be understood by those skilled in the art that the disclosure is not limited to such disclosed embodiments. Rather, the disclosed embodiments can be modified to incorporate any number of variations, alterations, substitutions, or equivalent arrangements not described herein, but which are commensurate with the scope of the disclosure.

What is claimed is:

1. A cassette, comprising:

a plurality of surfaces comprising a base surface, a top surface, and at least one side surface extending between the base surface and the top surface, wherein the plurality of surfaces at least partially define a volume for dispensably containing a supply of label material;

an outlet disposed on one of the plurality of surfaces, wherein the outlet provides a path to dispense the supply of label material from the volume;

at least one locking portion configured to receive at least one locking element of a label printer, wherein the locking portion is nonconductive; and a first flat conductive area disposed on the at least one side surface, wherein the first flat conductive area is configured to engage a corresponding conductive area of the label printer.

2. The cassette of claim 1, further comprising a conductive connection connected to the first flat conductive area, wherein the conductive connection is configured to provide an indication of at least one parameter of the cassette to the label printer.

3. The cassette of claim 2, further comprising a second flat conductive area on the at least one side surface, wherein the first flat conductive area and the second flat conductive area are connected via the conductive connection.

4. The cassette of claim 2, wherein the at least one parameter is a resistance reading by the label printer that is between 0 and 2500 ohms indicating that a cassette is secured within the label printer.

5. The cassette of claim 2, wherein the conductive connection comprises a conductive tape strip or a conductive paint path on the cassette.

6. The cassette of claim 1, wherein the first flat conductive area comprises a conductive hot stamp foil, a surface of a metal pin that is flush with or extends along the at least one side surface, a conductive tape strip, a conductive paint, or a conductive pad.

7. The cassette of claim 1, wherein the first flat conductive surface is disposed in a configuration that is substantially perpendicular to the base surface and the top surface.

8. A cassette, comprising:

a plurality of surfaces comprising a base surface, a top surface, and at least one side surface extending between the base surface and the top surface, wherein the plurality of surfaces at least partially define a volume for dispensably containing a supply of label material;

an outlet disposed on one of the plurality of surfaces, wherein the outlet provides a path to dispense the supply of label material from the volume;

at least two conductive areas disposed on the at least one side surface, wherein the at least two conductive areas are connected via a conductive connection; and a locking portion for engaging a complementary locking element of a label printer, wherein at least one of the two conductive areas extends from the at least one side surface to and along the top surface.

9. The cassette of claim 8, wherein the conductive connection comprises a conductive tape strip or a conductive paint path on the cassette.

10. The cassette of claim 8, wherein the conductive connection is disposed on an interior surface of the cassette.

11. The cassette of claim 8, wherein the conductive connection is disposed on an exterior surface of the cassette.

12. The cassette of claim 8, wherein the conductive connection is configured to provide an indication of at least one parameter of the cassette to the label printer.

13. The cassette of claim 12, wherein the at least one parameter is a resistance reading by the label printer that is greater than 2500 ohms indicating that a cassette is not secured within the label printer.

14. The cassette of claim 12, wherein the at least one parameter is a resistance reading by the label printer that is between 0 and 2500 ohms indicating that a cassette is secured within the label printer.

15. A cassette, comprising:

a plurality of surfaces comprising a base surface, a top surface, and at least one side surface extending between the base surface and the top surface, wherein the plurality of surfaces at least partially define a volume for dispensably containing a supply of label material;

a locking portion configured to receive a locking element of a label printer;

an outlet for the supply of label material, wherein the outlet provides a path to dispense the supply of label material from the volume; and at least one conductive bar protruding from at least one of the plurality of surfaces and configured to engage a corresponding conductive area of the label printer, wherein the at least one conductive bar is configured to conductively engage the label printer at a position separate from the locking element.

16. The cassette of claim 15, wherein the at least one conductive bar is arranged to provide an indication of at least one parameter of the cassette to the label printer.

17. The cassette of claim 16, wherein the at least one parameter is a resistance reading by the label printer that is greater than 2500 ohms indicating that a cassette is not secured within the label printer.

18. The cassette of claim 16, wherein the at least one parameter is a resistance reading by the label printer that is between 0 and 2500 ohms indicating that a cassette is secured within the label printer.

19. The cassette of claim 18, wherein:

the at least one conductive bar comprises at least two conductive bars, and the cassette further comprises a conductive connection connecting the at least two conductive bars.

20. The cassette of claim 19, wherein the conductive connection comprises a conductive tape strip or a conductive paint path.

* * * * *